US011015433B2

(12) United States Patent
Li et al.

(10) Patent No.: US 11,015,433 B2
(45) Date of Patent: May 25, 2021

(54) BORE TRAJECTORY SYSTEM

(71) Applicant: Schlumberger Technology Corporation, Sugar Land, TX (US)

(72) Inventors: Haifeng Li, Beijing (CN); Qing Liu, Beijing (CN); Miroslaw Magiera, Beijing (CN); Paul Bolchover, Beijing (CN); Yan Zhang, Beijing (CN); Yann Trevelot, Beijing (CN); Yang Yuan, Beijing (CN); Hongze Zhao, Beijing (CN); Kai Feng Zhao, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 517 days.

(21) Appl. No.: 15/681,606

(22) Filed: Aug. 21, 2017

(65) Prior Publication Data

US 2018/0051552 A1 Feb. 22, 2018

(30) Foreign Application Priority Data

Aug. 22, 2016 (WO) ..... PCT/CN2016/096173

(51) Int. Cl.
*E21B 47/024* (2006.01)
*E21B 7/04* (2006.01)
*E21B 44/00* (2006.01)

(52) U.S. Cl.
CPC ..... *E21B 47/024* (2013.01); *E21B 7/04* (2013.01); *E21B 44/00* (2013.01)

(58) Field of Classification Search
CPC ..... E21B 47/024; E21B 7/04; E21B 44/00
USPC ..... 703/10
See application file for complete search history.

(56) References Cited

U.S. PATENT DOCUMENTS 3,938,383 A * 2/1976 Sayer ..... G01N 25/18 73/152.13
7,302,373 B2 * 11/2007 Fleury ..... G01V 11/00 703/10
7,707,009 B2 * 4/2010 Steinke ..... G05B 23/0283 702/182
8,210,283 B1 * 7/2012 Benson ..... E21B 47/10 175/61

(Continued)

FOREIGN PATENT DOCUMENTS

CN 1782739 A 6/2006
EP 2944757 A1 11/2015
WO 2016/049272 A1 3/2016

OTHER PUBLICATIONS

Yingzhuo et al. ("Research of 3D Visualization for Wellbore Trajectory", 2010 International Conference on Web Information Systems and Mining, pp. 1-5) (Year: 2010).*

(Continued)

*Primary Examiner* — Iftekhar A Khan
(74) *Attorney, Agent, or Firm* — Alec J. McGinn

(57) ABSTRACT

A method includes acquiring trajectory information; based at least in part on a portion of the trajectory information, generating a set of candidate trajectories with associated performance indicator values; rendering a graphical user interface to a display; via the graphical user interface, receiving input that adjusts one of the performance indicator values; and, responsive to the adjustment of the one of the performance indicator values, selecting one of the set of candidate trajectories.

20 Claims, 38 Drawing Sheets

(56) References Cited

U.S. PATENT DOCUMENTS 8,996,396 B2 * 3/2015 Benson ..... G06Q 50/02 705/7.35
9,464,482 B1 * 10/2016 Bargach ..... E21B 41/0085
10,316,653 B2 * 6/2019 Coffman ..... E21B 49/003
10,422,212 B2 * 9/2019 Sayed ..... E21B 49/00
10,508,530 B2 * 12/2019 Gillan ..... E21B 47/09
2003/0120427 A1 * 6/2003 Chapman ..... E21B 7/04 702/6
2005/0217896 A1 * 10/2005 Terentyev ..... E21B 44/00 175/40
2006/0075645 A1 * 4/2006 Seigel ..... E21B 47/022 33/313
2006/0293872 A1 * 12/2006 Zamora ..... E21B 47/002 703/10
2009/0152005 A1 * 6/2009 Chapman ..... E21B 7/00 175/24
2010/0185427 A1 * 7/2010 Tilke ..... E21B 43/00 703/10
2010/0211893 A1 * 8/2010 Fanning ..... G06F 8/38 715/760
2011/0077924 A1 * 3/2011 Ertas ..... E21B 7/00 703/2
2012/0188091 A1 * 7/2012 Calleja ..... G01V 1/40 340/854.1
2012/0191354 A1 * 7/2012 Caycedo ..... E21B 47/022 702/9
2013/0161097 A1 * 6/2013 Benson ..... E21B 47/12 175/26
2014/0095134 A1 * 4/2014 Cariveau ..... E21B 10/00 703/7
2015/0075274 A1 * 3/2015 Kpetehoto ..... E21B 47/007 73/152.48
2015/0109341 A1 * 4/2015 Abadie ..... G01V 1/50 345/636
2015/0167427 A1 * 6/2015 Simpson ..... E21B 34/102 166/374
2015/0226052 A1 * 8/2015 Samuel ..... E21B 47/022 700/275
2015/0275646 A1 10/2015 Benson et al.
2015/0330209 A1 * 11/2015 Panchal ..... E21B 7/04 700/275
2016/0041302 A1 * 2/2016 Priezzhev ..... E21B 7/04 703/2
2016/0130916 A1 * 5/2016 Abadie ..... G01V 1/50 703/10
2016/0153239 A1 * 6/2016 Randall ..... E21B 41/0078 175/4.57
2016/0163100 A1 * 6/2016 Fitzsimmons ..... G06T 15/20 345/419
2016/0230465 A1 * 8/2016 Holtz ..... E21B 7/068
2016/0290117 A1 * 10/2016 Dykstra ..... E21B 44/04
2016/0312552 A1 * 10/2016 Early ..... E21B 41/00
2016/0312598 A1 * 10/2016 Samuel ..... G05B 11/36
2017/0243383 A1 * 8/2017 Gillan ..... E21B 47/024
2017/0306702 A1 * 10/2017 Summers ..... E21B 44/02
2018/0003031 A1 * 1/2018 Samuel ..... G01B 21/20
2018/0075544 A1 * 3/2018 Passolt ..... G06Q 50/02
2018/0334896 A1 * 11/2018 Samuel ..... E21B 7/04

OTHER PUBLICATIONS

International Search Report and Written Opinion for the equivalent International patent application PCT/CN2016/096173 dated May 24, 2017.
International Preliminary Report on Patentability for the equivalent International patent application PCT/CN2016/096173 dated Mar. 7, 2019.
Extended Search Report for the counterpart European patent application 16913685.0 dated Feb. 27, 2020.

* cited by examiner

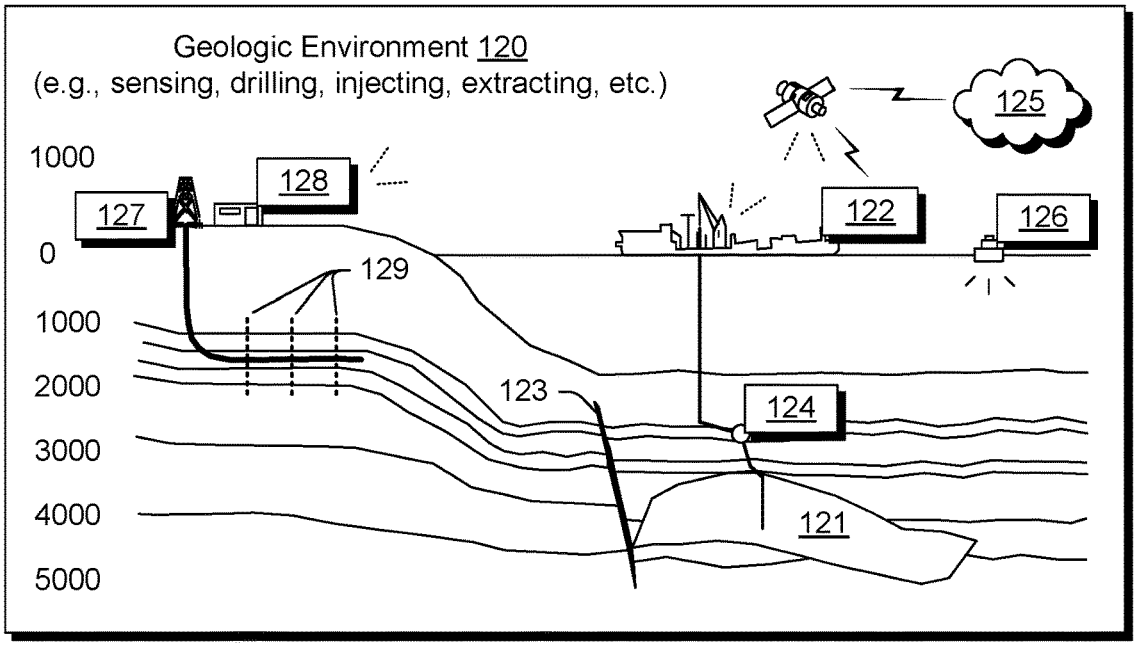
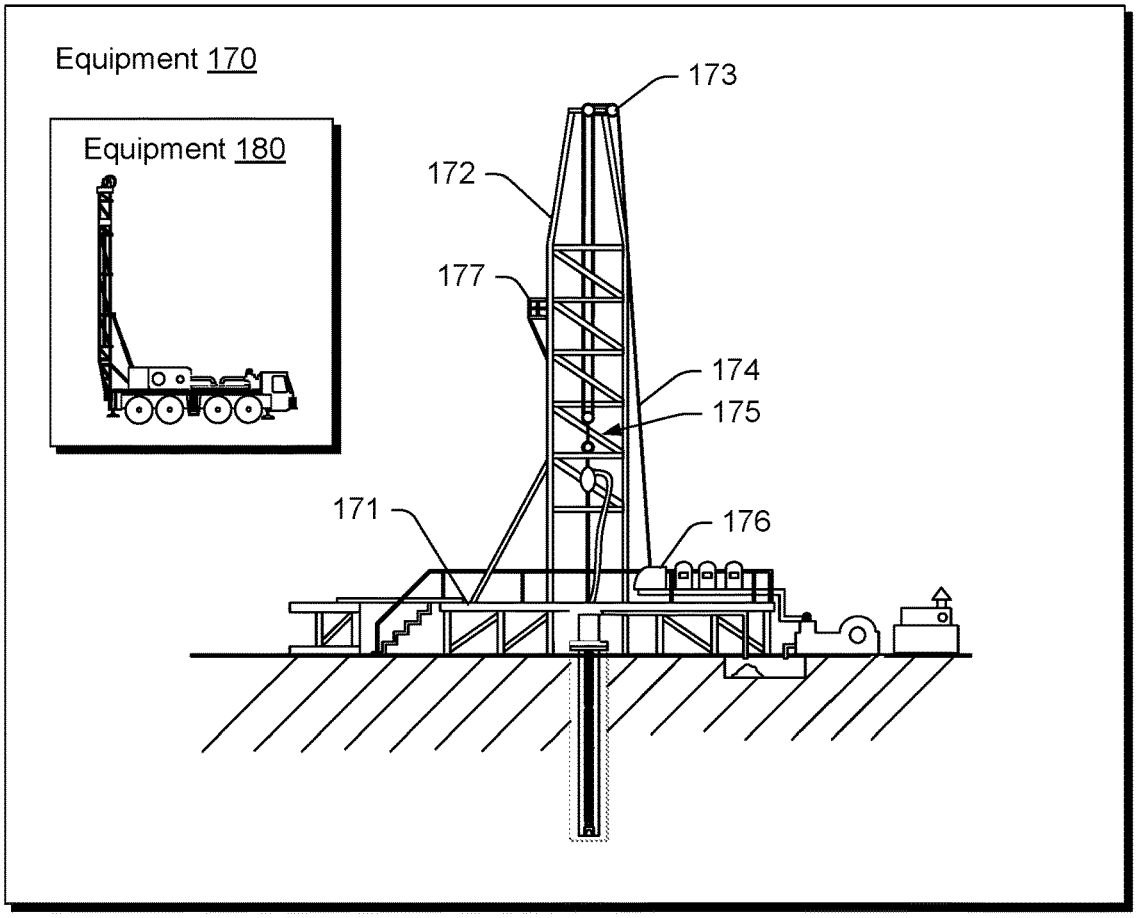
Fig. 1

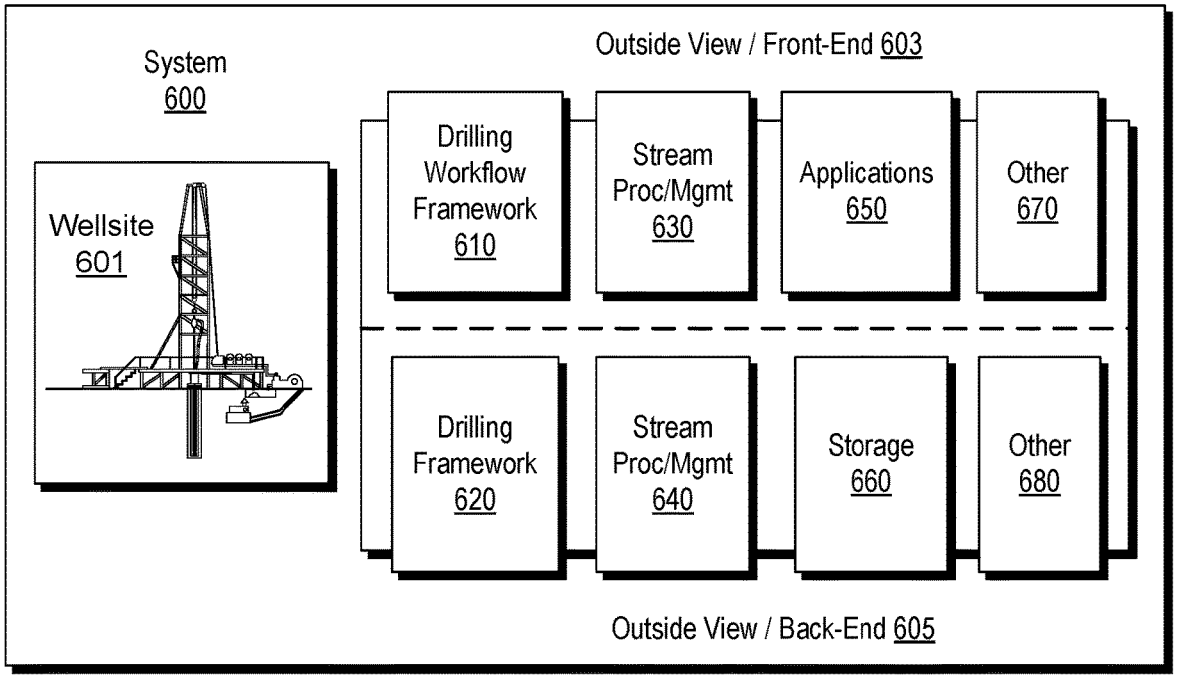
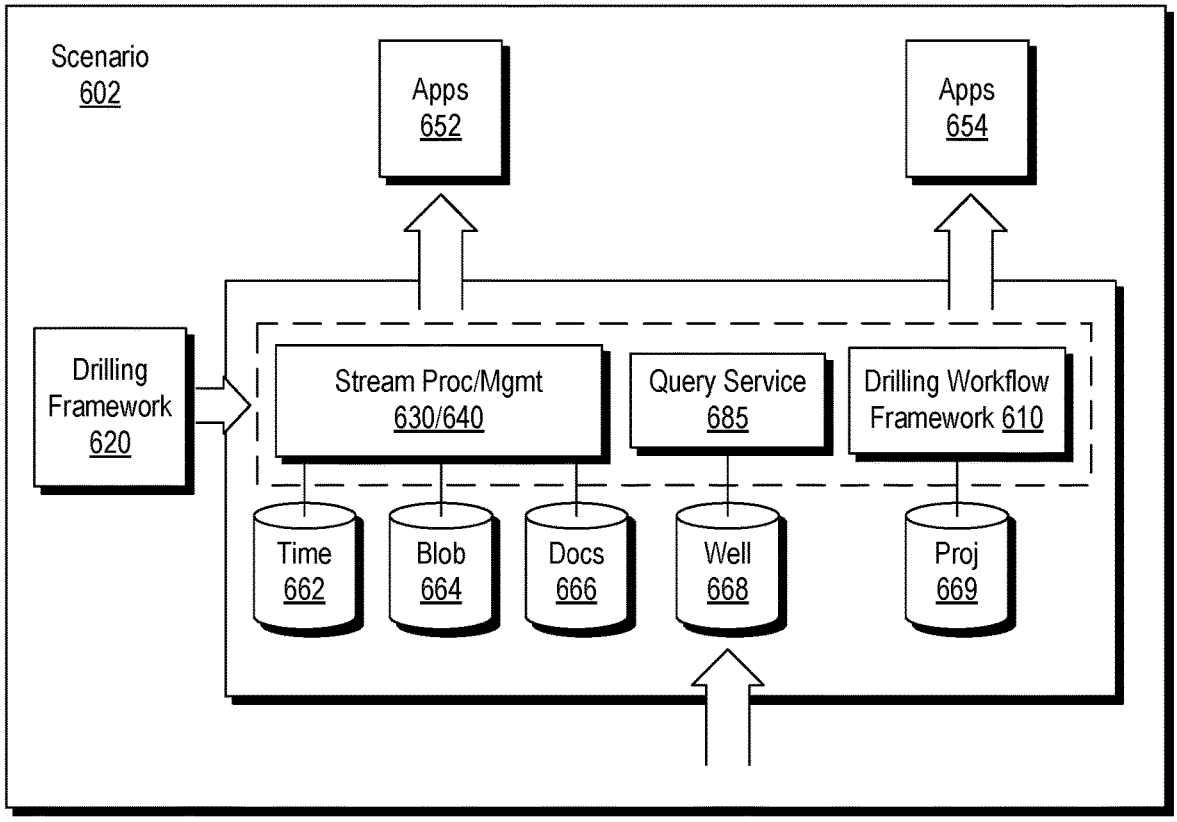
Fig. 6

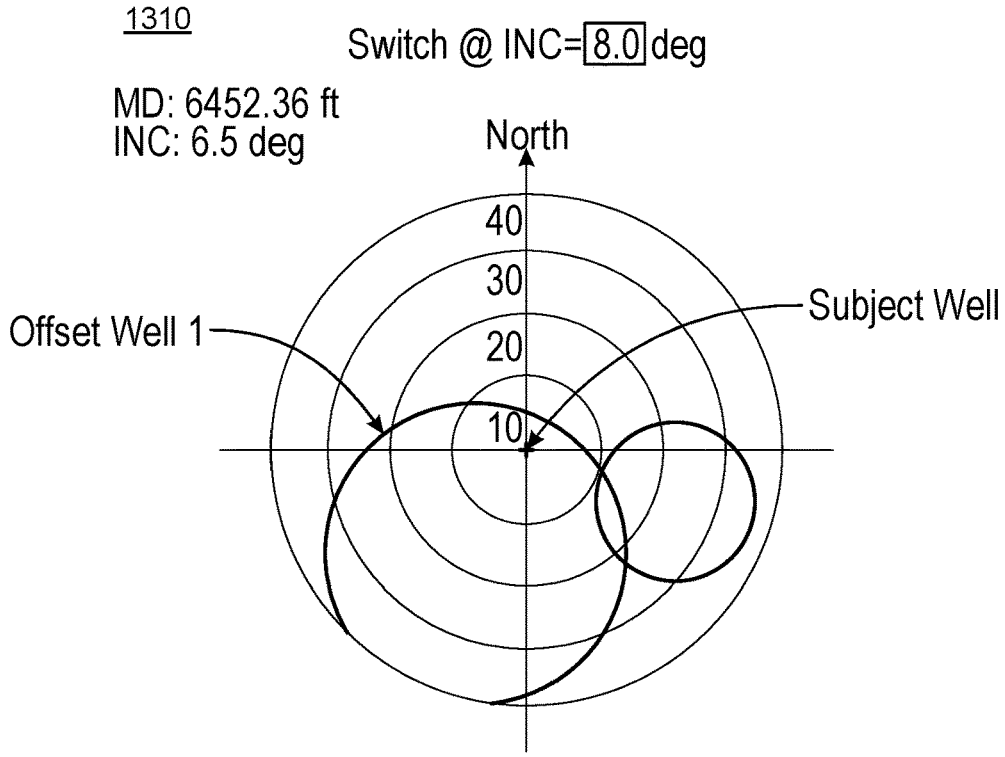
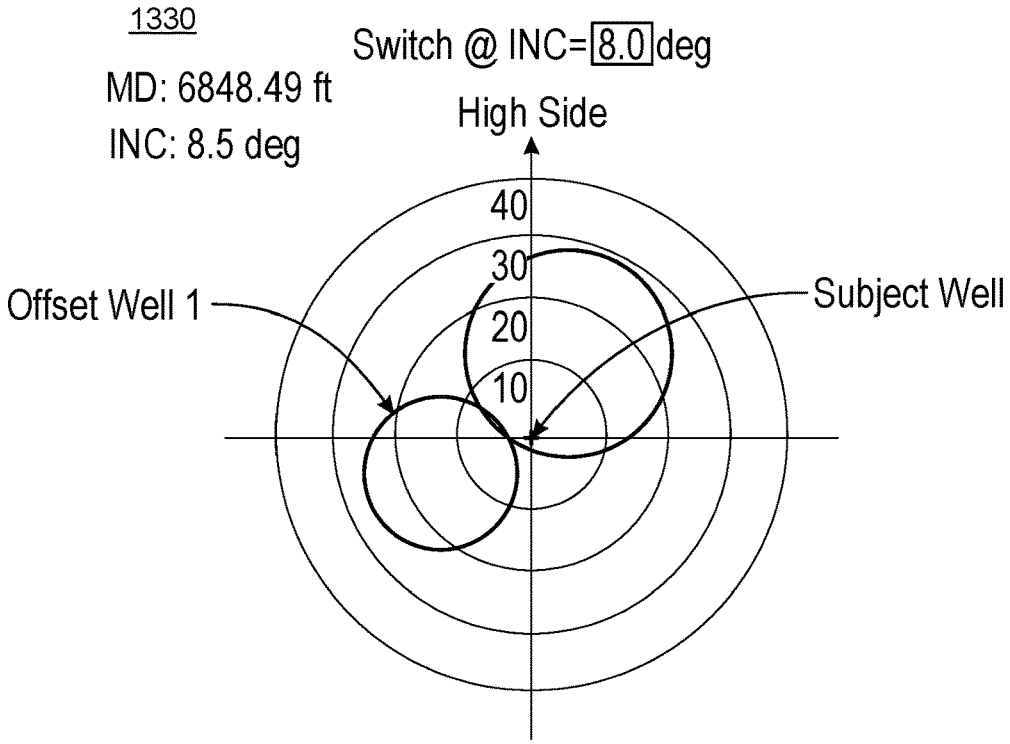
Fig. 13

Trajectory Table 2510

| Comment | MD ft | Incl deg | Azim deg | TVD ft | NS ft | EW ft | DLS deg/100ft | Closure ft | deg |
|---|---|---|---|---|---|---|---|---|---|
| | 0.00 | 0.00 | 231.93 | 0.00 | 0.00 | 0.00 | | | |
| | 2410.00 | 0.00 | 231.93 | 2410.00 | 0.00 | 0.00 | 0.00 | | |
| | 2986.66 | 6.92 | 231.93 | 2985.26 | -21.45 | -27.38 | 1.20 | | |
| | 3284.31 | 6.92 | 231.93 | 3280.74 | -43.56 | -55.62 | 0.00 | | |
| | 3860.97 | 0.00 | 231.93 | 3856.00 | -65.00 | -83.00 | 1.20 | | |
| | 6160.97 | 0.00 | 231.93 | 6156.00 | -65.00 | -83.00 | 0.00 | | |
| | 6753.87 | 35.87 | 6.67 | 6710.92 | 113.39 | -62.14 | 6.05 | | |
| | 6945.59 | 35.87 | 6.67 | 6866.28 | 224.97 | -49.09 | 0.00 | | |

| Part | SEQ | Survey Tool (Survey Tool Code) | Service Provider | Hole (Size) | Casing (Size) | Depth Interval (From) | Depth Interval (TO) | Survey Frequency | |
|---|---|---|---|---|---|---|---|---|---|
| 1 | 1 | A001Ma_MWD | N/A | N/A | N/A | 0.00 | 11477.67 | N/A | |

Fig. 25

Trajectory Table 2610

| Comment | MD ft | Incl deg | Azim deg | TVD ft | NS ft | EW ft | DLS deg/100ft | Closure ft | deg |
|---|---|---|---|---|---|---|---|---|---|
| | 0.00 | 0.00 | 358.99 | 0.00 | 0.00 | 0.00 | | | |
| | 6156.74 | 0.00 | 358.99 | 6156.74 | 0.00 | 0.00 | 0.00 | | |
| | 6439.29 | 17.08 | 358.99 | 6435.12 | 41.81 | -0.73 | 6.05 | | |
| | 6603.09 | 17.08 | 358.99 | 6591.70 | 89.92 | -1.58 | 0.00 | | |
| | 7807.11 | 89.89 | 359.00 | 7260.88 | 993.67 | -17.32 | 6.05 | | |
| | 11441.17 | 89.89 | 359.00 | 7268.04 | 4627.17 | -80.44 | 0.00 | | |

| Part | SEQ | Survey Tool (Survey Tool Code) | Service Provider | Hole (Size) | Casing (Size) | Depth Interval (From) | Depth Interval (TO) | Survey Frequency | |
|---|---|---|---|---|---|---|---|---|---|
| 1 | 1 | A001Ma_MWD | N/A | N/A | N/A | 0.00 | 11477.67 | N/A | |

Fig. 26

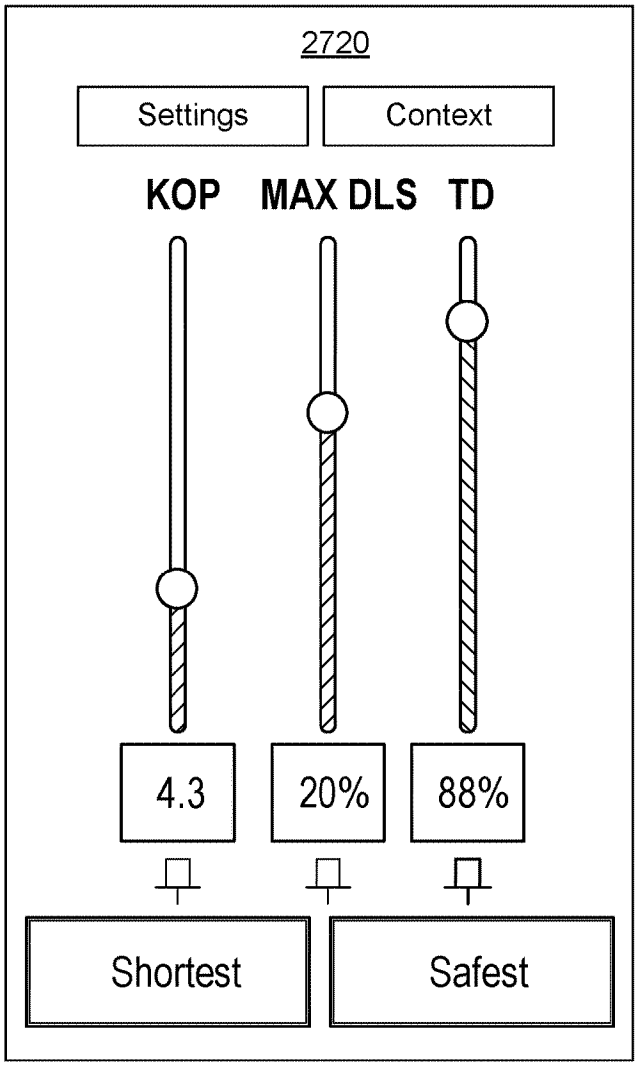
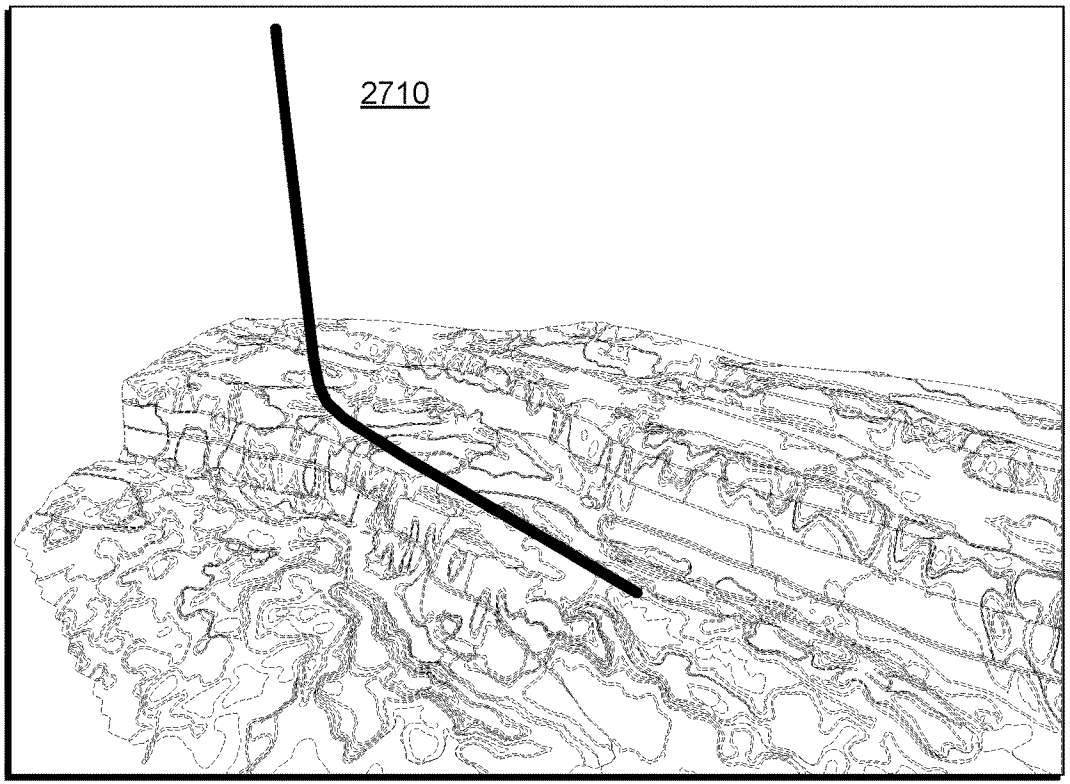
Fig. 27

1. When the Icon is activated, the slider lock its position

2. Changing the values, will change the sliders positions. Changing the sliders positions, will change the values.

3. Selecting these buttons will automatically change the values and the sliders position.

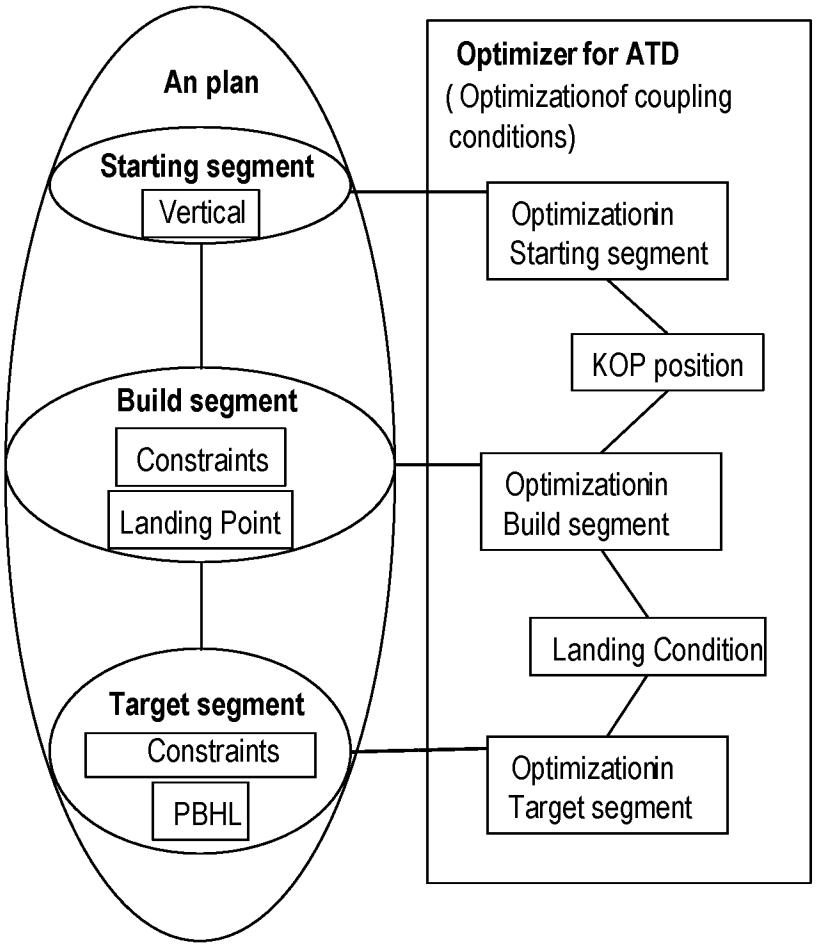
3000
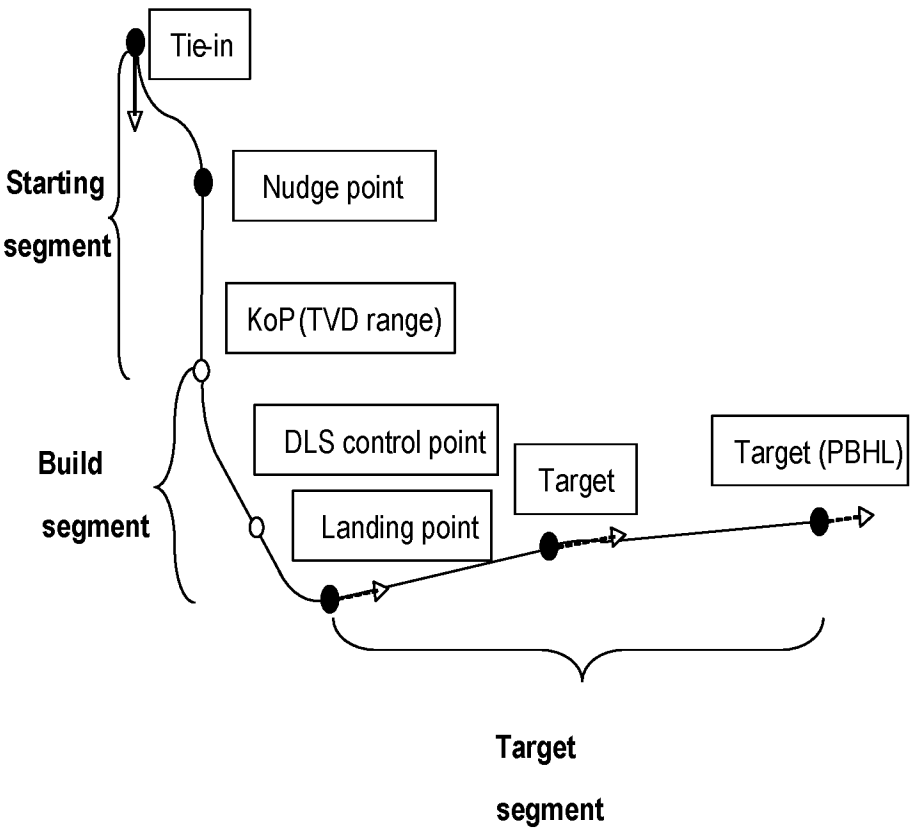
Fig. 30

3400

| Section | Comments | MD | Incl | Azim True | TVD | VSEC | NS | EW | Northing | Easting | DLS |
|---|---|---|---|---|---|---|---|---|---|---|---|
| | Surface | 0 | 0 | 0 | 0 | 0 | 0 | 0 | 7225542 | 2129090 | 0 |
| | KOP, Build 2 DLS | 1100 | 0 | 16 | 1100 | 0 | 0 | 0 | 7225542 | 2129090 | 0 |
| | Hold | 1350 | 5 | 16 | 1349 | 10 | 10 | 3 | 7225543 | 2129092 | 2 |
| | KOP, Drop 2 DLS | 2768 | 5 | 16 | 2762 | 129 | 129 | 38 | 7225672 | 2129095 | 0 |
| | Hold Vertical | 3018 | 0 | 16 | 3012 | 139 | 139 | 41 | 7225683 | 2129128 | 2 |
| | KOP, Build 10 DLS | 6010 | 0 | 16 | 6004 | 139 | 139 | 41 | 7225683 | 2129128 | 0 |
| | Landing Point, Hold TD | 6883 | 87.3 | 359 | 6576 | 686 | 686 | 40 | 7226228 | 2129116 | 10 |
| | PBHL | 11503 | 87.3 | 359 | 6794 | 5300 | 5300 | 32 | 7230480 | 2129018 | 0 |

Fig. 34

Automated Trajectory Design Constraints 3500 ×

1.VERTICAL SEGMENT

Nudge on Vertical Segment? ⦿ Yes ○ No

Nudge From: 100.00 m

Nudge Build DLS: 3.00 deg/30m

Nudge Drop DLS: 3.00 deg/30m

Nudge Options: ⦿ Nudge to XY Position ○ Manual Azimuth and Nudge Offset

Nudge Position: 1.Target: ADP (V3) ▽

Your Desired Kick-Off Depth?

Kick-Off Depth: 300.00 – m

2.BUILD SEGMENT

DLS: 12.00 – 12.00 deg/30m

3.TARGETS SEGMENT 3520

DLS: 12.00 – 12.00 deg/30m

Landing Options
- ⦿ Landing on Target
- ○ Landing on Line
- ○ Landing on Line ( TVD @ LP)
- ○ Landing on Line ( TVD @ 0VS)

Select Targets:
- 1. Target: ADP (V3) ☐
- 2. Target: Heel (V3) ☑
- 3. Target: Toe (V2) ☑
- 4. Target: Horizontal Target (V5) ☐

Rerun ATD

Cancel

Fig. 35

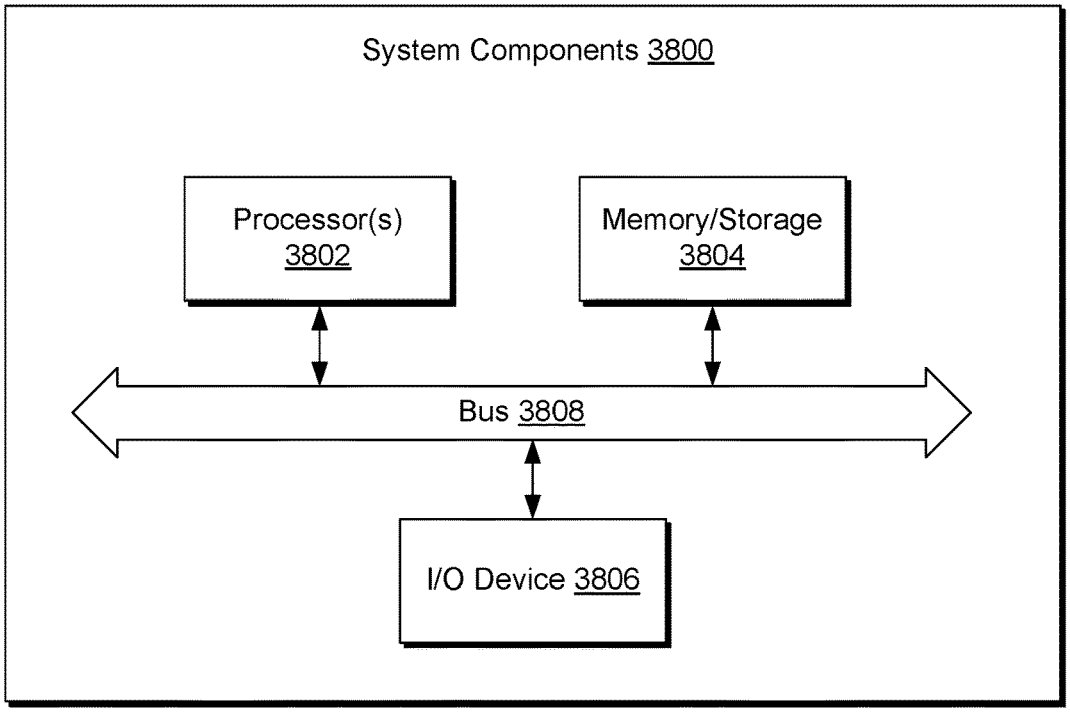
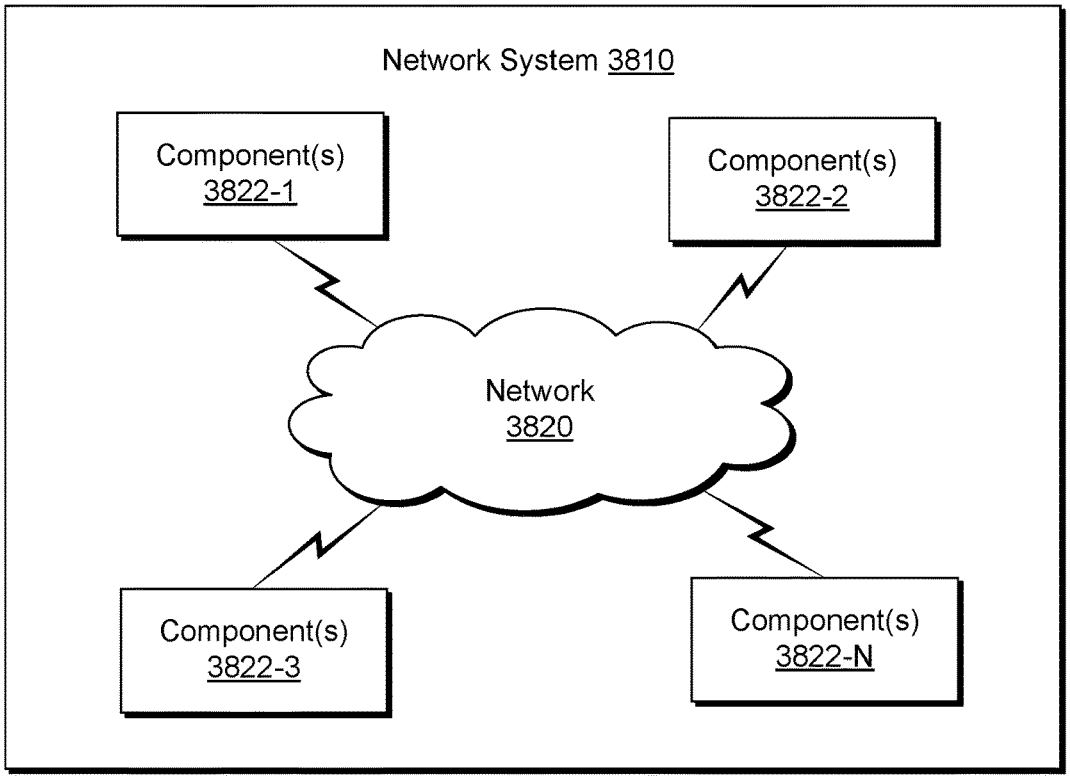
Fig. 38

BORE TRAJECTORY SYSTEM

RELATED APPLICATION

This application claims the benefit of, and priority to, International Patent Application No. PCT/CN2016/096173, filed Aug. 22, 2016 and titled "Bore Trajectory System." The foregoing application is incorporated herein by this reference in its entirety.

BACKGROUND

A bore can be drilled into a geologic environment where the bore may be utilized to form a well. A rig may be a system of components that can be operated to form a bore in a geologic environment, to transport equipment into and out of a bore in a geologic environment, etc. As an example, a rig may include a system that can be used to drill a bore and to acquire information about a geologic environment, drilling, etc. As an example, a rig can include one or more of the following components and/or equipment: a mud tank, a mud pump, a derrick or a mast, drawworks, a rotary table or a top drive, a drillstring, power generation equipment and auxiliary equipment. As an example, an offshore rig may include one or more of such components, which may be on a vessel or a drilling platform.

SUMMARY

A method includes acquiring trajectory information; based at least in part on a portion of the trajectory information, generating a set of candidate trajectories with associated performance indicator values; rendering a graphical user interface to a display; via the graphical user interface, receiving input that adjusts one of the performance indicator values; and, responsive to the adjustment of the one of the performance indicator values, selecting one of the set of candidate trajectories. A system can include one or more processors; memory operatively coupled to the one or more processors; and processor-executable instructions stored in the memory and executable by at least one of the one or more processors to instruct the system to: acquire trajectory information; based at least in part on a portion of the trajectory information, generate a set of candidate trajectories with associated performance indicator values; render a graphical user interface to a display; via the graphical user interface, receive input that adjusts one of the performance indicator values; and, responsive to the adjustment of the one of the performance indicator values, select one of the set of candidate trajectories. One or more computer-readable storage media can include computer-executable instructions executable to instruct a computing system to: acquire trajectory information; based at least in part on a portion of the trajectory information, generate a set of candidate trajectories with associated performance indicator values; render a graphical user interface to a display; via the graphical user interface, receive input that adjusts one of the performance indicator values; and, responsive to the adjustment of the one of the performance indicator values, select one of the set of candidate trajectories. In such an example, the instructions can include instructions to render a nudge tool graphical user interface to the display that includes at least one graphical control to position at least a portion of the selected one of the set of candidate trajectories. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

FIG. 1 illustrates examples of equipment in a geologic environment;

FIG. 6 illustrates an example of a system and an example of a scenario;

FIG. 13 illustrates examples of GUIs;

FIG. 25 illustrates an example of a GUI;

FIG. 26 illustrates an example of a GUI;

FIG. 27 illustrates examples of GUIs;

FIG. 30 illustrates an example of a GUI;

FIG. 34 illustrates an example of a table;

FIG. 35 illustrates examples of GUIs;

FIG. 38 illustrates example components of a system and a networked system.

DETAILED DESCRIPTION

Figure 2:
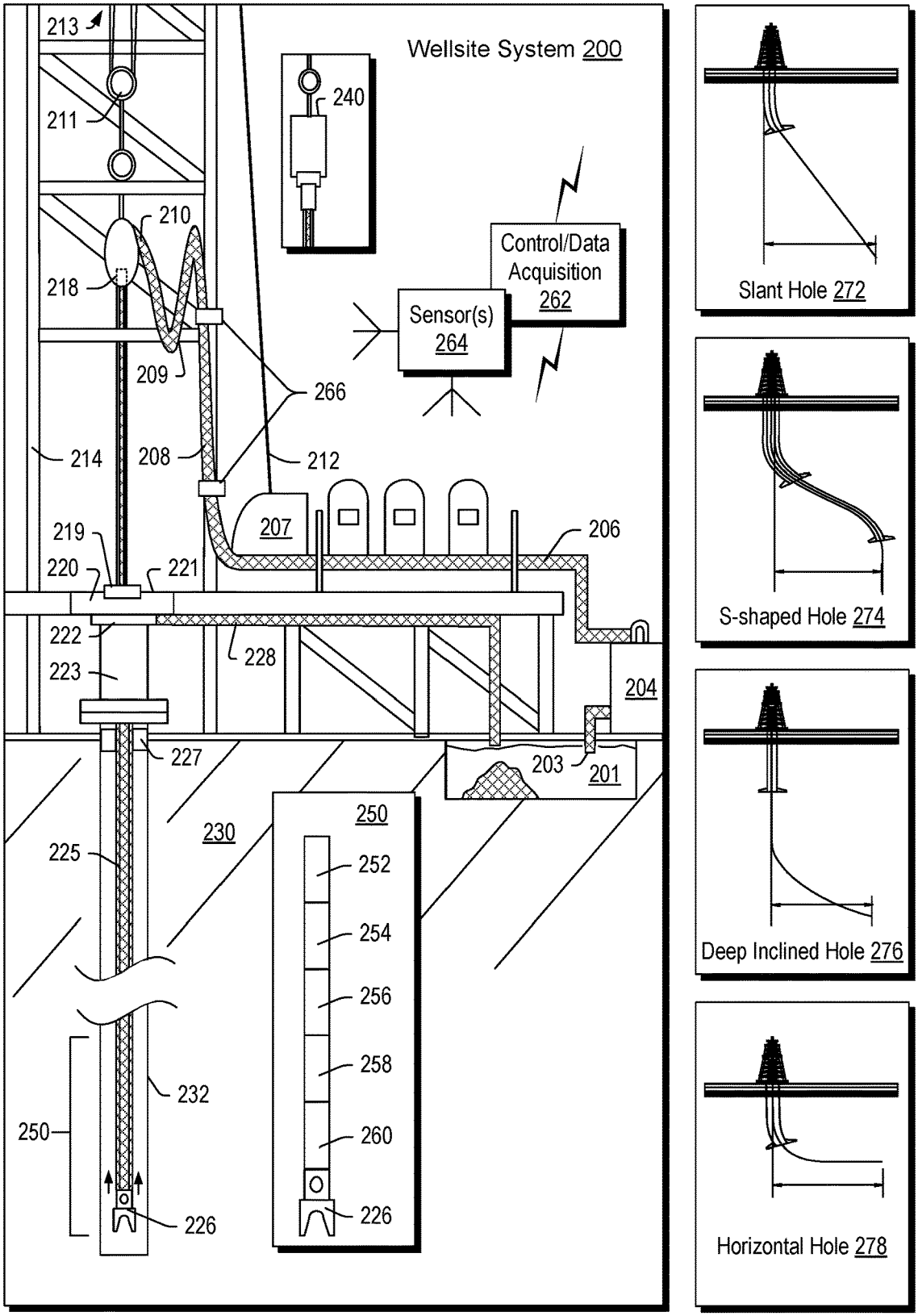
FIG. 2 illustrates an example of a system and examples of types of holes.

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

Well planning is a process by which a path of a well can be mapped, so as to reach a reservoir, for example, to produce fluids therefrom or, for example, to inject fluids into the reservoir; noting that a field may utilize one or more production wells and one or more injection wells.

As an example, constraints can be imposed on a design of a well, for example, a well trajectory may be constrained via one or more physical phenomena that may impact viability of a bore in earth, ease of drilling into earth, etc. Thus, for example, one or more constraints may be imposed based at least in part on known geology of a subterranean domain or, for example, presence of one or more other wells in the area (e.g., collision avoidance). As an example, one or more other constraints may be imposed, for example, consider one or more constraints germane to capabilities of tools being used and/or one or more constraints related to drilling time and risk tolerance.

As an example, a method can include designing a trajectory to be drilled from a surface location to one or more subterranean targets. Such a method can include defining two or more performance indicators (PIs) relating to the trajectory, creating a set of possible trajectories from the surface location to one or more of the targets, evaluating at least a portion of the set of possible trajectories with respect to at least some of the defined PIs, and render a graphic user interface to a display, for example, as a tool that can receive input (e.g., user input) to interrogate of one or more of the PIs and, for example, that can output a single trajectory from the set of possible trajectories and/or receive input (e.g., user input) to select a single trajectory from the set of possible trajectories. As to interrogation of the one or more of the PIs, the tool can allow for trade-offs between multiple PIs. For example, a slider tool (e.g., as a graphical control) may include individual slider controls for individual PIs where moving one slider control causes movement of one or more of the other individual slider controls to allow a user to visualize one or more trade-offs.

While the aforementioned method mentions a trajectory to be drilled, such a method may, for example, be implemented during drilling. For example, drilling can commence according to a digital well plan where the drilling progresses along a portion of a trajectory of the digital well plan. In such an example, based on one or more types of information, a method can include rendering a graphical user interface to a display that allows for revising the digital well plan as to one or more portions of the trajectory that has yet to be drilled.

As an example, a well plan (e.g., a digital well plan) can be generated based at least in part on imposed constraints and known information. As an example, a well plan may be provided to a well owner, approved, and then implemented by a drilling service provider (e.g., a directional driller or "DD"). In such an example, a rig may be used to drill, for example, according to a well plan. During a period of time during which a well plan is implemented, a rig may transition from one state to another state, which may be referred to as rigstates. As an example, a state may be a drilling state or may be a state where drilling into a formation (e.g., rock) is not occurring (e.g., an idle state, a tripping-in state, a tripping-out state, etc.).

As an example, a well design system can account for one or more capabilities of a drilling system or drilling systems that may be utilized at a wellsite. As an example, a drilling engineer may be called upon to take such capabilities into account, for example, as one or more of various designs and specifications are created. As an example, a state such as a rigstate may correspond to a capability, for example, while the capability is being utilized.

As an example, a well design system, which may be a well planning system, may take into account automation. For example, where a wellsite includes wellsite equipment that can be automated, for example, via a local and/or a remote automation command, a well plan may be generated in digital form that can be utilized in a well drilling system where at least some amount of automation is possible and desired. For example, a digital well plan can be accessible by a well drilling system where information in the digital well plan can be utilized via one or more automation mechanisms of the well drilling system to automate one or more operations at a wellsite.

As an example, states such as rigstates may be utilized in planning, implementation, diagnostics, automation, etc. For example, state information may be acquired and stored and/or analyzed. In such an example, analysis of state information may allow for making determinations as to whether a plan is being adequately followed, equipment is operating as expected, etc.

As an example, a database or databases may store state information. As an example, a search engine may be utilized to identify one or more states. For example, consider a query that is a series of two or more states that may have occurred during implementation of a well plan where the search engine may search a database to identify other occurrences of the two or more states. As an example, a match algorithm may find exactly matching occurrences of states responsive to a search and/or approximate occurrences of states responsive to a search.

Various examples of types of environments, various examples of types of equipment and various examples of types of methods, operations, etc. are described below.

FIG. 1 shows an example of a geologic environment 120. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and/or to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more pieces of equipment may provide for measurement, collection, communication, storage, analysis, etc. of data (e.g., for one or more produced resources, etc.). As an example, one or more satellites may be provided for purposes of communications, data acquisition, geolocation, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, injection, production, etc. As an example, the equipment 127 and/or 128 may provide for measurement, collection, communication, storage, analysis, etc. of data such as, for example, production data (e.g., for one or more produced resources). As an example, one or more satellites may be provided for purposes of communications, data acquisition, etc.

FIG. 1 also shows an example of equipment 170 and an example of equipment 180. Such equipment, which may be systems of components, may be suitable for use in the geologic environment 120. While the equipment 170 and 180 are illustrated as land-based, various components may be suitable for use in an offshore system. As shown in FIG. 1, the equipment 180 can be mobile as carried by a vehicle; noting that the equipment 170 can be assembled, disassembled, transported and re-assembled, etc.

The equipment 170 includes a platform 171, a derrick 172, a crown block 173, a line 174, a traveling block assembly 175, drawworks 176 and a landing 177 (e.g., a monkeyboard). As an example, the line 174 may be controlled at least in part via the drawworks 176 such that the traveling block assembly 175 travels in a vertical direction with respect to the platform 171. For example, by drawing the line 174 in, the drawworks 176 may cause the line 174 to run through the crown block 173 and lift the traveling block assembly 175 skyward away from the platform 171; whereas, by allowing the line 174 out, the drawworks 176 may cause the line 174 to run through the crown block 173 and lower the traveling block assembly 175 toward the platform 171. Where the traveling block assembly 175 carries pipe (e.g., casing, etc.), tracking of movement of the traveling block 175 may provide an indication as to how much pipe has been deployed.

A derrick can be a structure used to support a crown block and a traveling block operatively coupled to the crown block at least in part via line. A derrick may be pyramidal in shape and offer a suitable strength-to-weight ratio. A derrick may be movable as a unit or in a piece by piece manner (e.g., to be assembled and disassembled).

As an example, drawworks may include a spool, brakes, a power source and assorted auxiliary devices. Drawworks may controllably reel out and reel in line. Line may be reeled over a crown block and coupled to a traveling block to gain mechanical advantage in a "block and tackle" or "pulley" fashion. Reeling out and in of line can cause a traveling block (e.g., and whatever may be hanging underneath it), to be lowered into or raised out of a bore. Reeling out of line may be powered by gravity and reeling in by a motor, an engine, etc. (e.g., an electric motor, a diesel engine, etc.).

As an example, a crown block can include a set of pulleys (e.g., sheaves) that can be located at or near a top of a derrick or a mast, over which line is threaded. A traveling block can include a set of sheaves that can be moved up and down in a derrick or a mast via line threaded in the set of sheaves of the traveling block and in the set of sheaves of a crown block. A crown block, a traveling block and a line can form a pulley system of a derrick or a mast, which may enable handling of heavy loads (e.g., drillstring, pipe, casing, liners, etc.) to be lifted out of or lowered into a bore. As an example, line may be about a centimeter to about five centimeters in diameter as, for example, steel cable. Through use of a set of sheaves, such line may carry loads heavier than the line could support as a single strand.

As an example, a derrick person may be a rig crew member that works on a platform attached to a derrick or a mast. A derrick can include a landing on which a derrick person may stand. As an example, such a landing may be about 10 meters or more above a rig floor. In an operation referred to as trip out of the hole (TOH), a derrick person may wear a safety harness that enables leaning out from the work landing (e.g., monkeyboard) to reach pipe in located at or near the center of a derrick or a mast and to throw a line around the pipe and pull it back into its storage location (e.g., fingerboards), for example, until it a time at which it may be desirable to run the pipe back into the bore. As an example, a rig may include automated pipe-handling equipment such that the derrick person controls the machinery rather than physically handling the pipe.

As an example, a trip may refer to the act of pulling equipment from a bore and/or placing equipment in a bore. As an example, equipment may include a drillstring that can be pulled out of the hole and/or place or replaced in the hole. As an example, a pipe trip may be performed where a drill bit has dulled or has otherwise ceased to drill efficiently and is to be replaced.

FIG. 2 shows an example of a wellsite system 200 (e.g., at a wellsite that may be onshore or offshore). As shown, the wellsite system 200 can include a mud tank 201 for holding mud and other material (e.g., where mud can be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 can provide for operation of the drillstring 225 and other operations. As shown, the wellsite system 200 includes the platform 211 and the derrick 214 positioned over the borehole 232. As mentioned, the wellsite system 200 can include the rotary table 220 where the drillstring 225 pass through an opening in the rotary table 220.

As shown in the example of FIG. 2, the wellsite system 200 can include the kelly 218 and associated components, etc., or a top drive 240 and associated components. As to a kelly example, the kelly 218 may be a square or hexagonal metal/alloy bar with a hole drilled therein that serves as a mud flow path. The kelly 218 can be used to transmit rotary motion from the rotary table 220 via the kelly drive bushing 219 to the drillstring 225, while allowing the drillstring 225 to be lowered or raised during rotation. The kelly 218 can pass through the kelly drive bushing 219, which can be driven by the rotary table 220. As an example, the rotary table 220 can include a master bushing that operatively couples to the kelly drive bushing 219 such that rotation of the rotary table 220 can turn the kelly drive bushing 219 and hence the kelly 218. The kelly drive bushing 219 can include an inside profile matching an outside profile (e.g., square, hexagonal, etc.) of the kelly 218; however, with slightly larger dimensions so that the kelly 218 can freely move up and down inside the kelly drive bushing 219.

As to a top drive example, the top drive 240 can provide functions performed by a kelly and a rotary table. The top drive 240 can turn the drillstring 225. As an example, the top drive 240 can include one or more motors (e.g., electric and/or hydraulic) connected with appropriate gearing to a short section of pipe called a quill, that in turn may be screwed into a saver sub or the drillstring 225 itself. The top drive 240 can be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 can hold mud, which can be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via a the lines 206, 208 and 209 to a port of the kelly 218 or, for example, to a port of the top drive 240. The mud can then flow via a passage (e.g., or passages) in the drillstring 225 and out of ports located on the drill bit 226 (see, e.g., a directional arrow). As the mud exits the drillstring 225 via ports in the drill bit 226, it can then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drill string 225 may be pulled from a wellbore and optionally replaced, for example, with a new or sharpened drill bit, a smaller diameter drill string, etc. As mentioned, the act of pulling a drill string out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drill string 225 at a bottom of a wellbore, pumping of the mud commences to lubricate the drill bit 226 for purposes of drilling to enlarge the wellbore. As mentioned, the mud can be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud can cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measuring-while-drilling (MWD) module 256, an optional module 258, a roto-steerable system and motor 260, and the drill bit 226.

The LWD module 254 may be housed in a suitable type of drill collar and can contain one or a plurality of selected types of logging tools. It will also be understood that more than one LWD and/or MWD module can be employed, for example, as represented at by the module 256 of the drillstring assembly 250. Where the position of an LWD module is mentioned, as an example, it may refer to a module at the position of the LWD module 254, the module 256, etc. An LWD module can include capabilities for measuring, processing, and storing information, as well as for communicating with the surface equipment. In the illustrated example, the LWD module 254 may include a seismic measuring device.

The MWD module 256 may be housed in a suitable type of drill collar and can contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller can generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation can include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well can include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring can include a positive displacement motor (PDM).

As an example, a system may be a steerable system and include equipment to perform method such as geosteering. As an example, a steerable system can include a PDM or of a turbine on a lower part of a drillstring which, just above a drill bit, a bent sub can be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment can make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, can allow for implementing a geosteering method. Such a method can include navigating a subsurface environment, for example, to follow a desired route to reach a desired target or targets.

As an example, a drillstring can include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering can include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 can include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 can be provided for tracking pipe, tracking movement of at least a portion of a drillstring, etc.

As an example, the system 200 can include one or more sensors 266 that can sense and/or transmit signals to a fluid conduit such as a drilling fluid conduit (e.g., a drilling mud conduit). For example, in the system 200, the one or more sensors 266 can be operatively coupled to portions of the standpipe 208 through which mud flows. As an example, a downhole tool can generate pulses that can travel through the mud and be sensed by one or more of the one or more sensors 266. In such an example, the downhole tool can include associated circuitry such as, for example, encoding circuitry that can encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 can include a transmitter that can generate signals that can be transmitted downhole via mud (e.g., drilling fluid) as a transmission medium.

As an example, one or more portions of a drillstring may become stuck. The term stuck can refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", the can refer to a portion of a drillstring that cannot be rotated or moved axially. As an example, a condition referred to as "differential sticking" can be a condition whereby the drillstring cannot be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking can have time and financial cost.

As an example, a sticking force can be a product of the differential pressure between the wellbore and the reservoir and the area that the differential pressure is acting upon. This means that a relatively low differential pressure (delta p) applied over a large working area can be just as effective in sticking pipe as can a high differential pressure applied over a small area.

As an example, a condition referred to as "mechanical sticking" can be a condition where limiting or prevention of motion of the drillstring by a mechanism other than differential pressure sticking occurs. Mechanical sticking can be caused, for example, by one or more of junk in the hole, wellbore geometry anomalies, cement, keyseats or a buildup of cuttings in the annulus.

Figure 3:
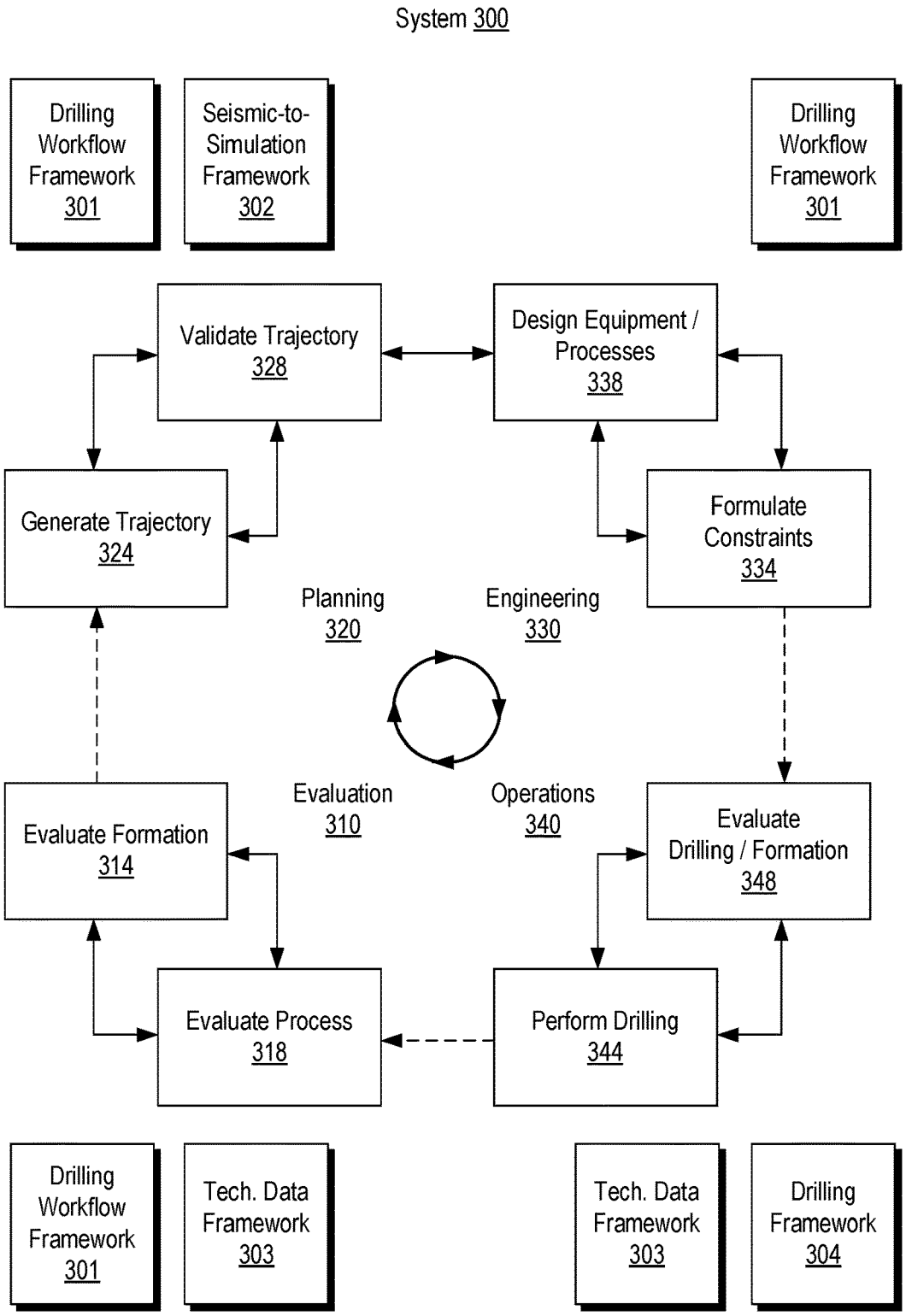
FIG. 3 illustrates an example of a system.

FIG. 3 shows an example of a system 300 that includes various equipment for evaluation 310, planning 320, engineering 330 and operations 340. For example, a drilling workflow framework 301, a seismic-to-simulation framework 302, a technical data framework 303 and a drilling framework 304 may be implemented to perform one or more processes such as a evaluating a formation 314, evaluating a process 318, generating a trajectory 324, validating a trajectory 328, formulating constraints 334, designing equipment and/or processes based at least in part on constraints 338, performing drilling 344 and evaluating drilling and/or formation 348.

In the example of FIG. 3, the seismic-to-simulation framework 302 can be, for example, the PETREL® framework (Schlumberger Limited, Houston, Tex.) and the technical data framework 303 can be, for example, the TECHLOG® framework (Schlumberger Limited, Houston, Tex.).

As an example, a framework can include entities that may include earth entities, geological objects or other objects such as wells, surfaces, reservoirs, etc. Entities can include virtual representations of actual physical entities that are reconstructed for purposes of one or more of evaluation, planning, engineering, operations, etc.

Entities may include entities based on data acquired via sensing, observation, etc. (e.g., seismic data and/or other information). An entity may be characterized by one or more properties (e.g., a geometrical pillar grid entity of an earth model may be characterized by a porosity property). Such properties may represent one or more measurements (e.g., acquired data), calculations, etc.

A framework may be an object-based framework. In such a framework, entities may include entities based on predefined classes, for example, to facilitate modeling, analysis, simulation, etc. A commercially available example of an object-based framework is the MICROSOFT™.NET™ framework (Redmond, Wash.), which provides a set of extensible object classes. In the .NET™ framework, an object class encapsulates a module of reusable code and associated data structures. Object classes can be used to instantiate object instances for use in by a program, script, etc. For example, borehole classes may define objects for representing boreholes based on well data.

As an example, a framework can include an analysis component that may allow for interaction with a model or model-based results (e.g., simulation results, etc.). As to simulation, a framework may operatively link to or include a simulator such as the ECLIPSE® reservoir simulator (Schlumberger Limited, Houston Tex.), the INTERSECT® reservoir simulator (Schlumberger Limited, Houston Tex.), etc.

The aforementioned PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, well engineers, reservoir engineers, etc.) can develop collaborative workflows and integrate operations to streamline processes. Such a framework may be considered an application and may be considered a data-driven application (e.g., where data is input for purposes of modeling, simulating, etc.).

As an example, one or more frameworks may be interoperative and/or run upon one or another. As an example, consider the commercially available framework environment marketed as the OCEAN® framework environment (Schlumberger Limited, Houston, Tex.), which allows for integration of add-ons (or plug-ins) into a PETREL® framework workflow. The OCEAN® framework environment leverages .NET™ tools (Microsoft Corporation, Redmond, Wash.) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

As an example, a framework can include a model simulation layer along with a framework services layer, a framework core layer and a modules layer. The framework may include the commercially available OCEAN® framework where the model simulation layer can include or operatively link to the commercially available PETREL® model-centric software package that hosts OCEAN® framework applications. In an example embodiment, the PETREL® software may be considered a data-driven application. The PETREL® software can include a framework for model building and visualization. Such a model may include one or more grids.

As an example, the model simulation layer may provide domain objects, act as a data source, provide for rendering and provide for various user interfaces. Rendering may provide a graphical environment in which applications can display their data while the user interfaces may provide a common look and feel for application user interface components.

As an example, domain objects can include entity objects, property objects and optionally other objects. Entity objects may be used to geometrically represent wells, surfaces, reservoirs, etc., while property objects may be used to provide property values as well as data versions and display parameters. For example, an entity object may represent a well where a property object provides log information as well as version information and display information (e.g., to display the well as part of a model).

As an example, data may be stored in one or more data sources (or data stores, generally physical data storage devices), which may be at the same or different physical sites and accessible via one or more networks. As an example, a model simulation layer may be configured to model projects. As such, a particular project may be stored where stored project information may include inputs, models, results and cases. Thus, upon completion of a modeling session, a user may store a project. At a later time, the project can be accessed and restored using the model simulation layer, which can recreate instances of the relevant domain objects.

As an example, the system 300 may be used to perform one or more workflows. A workflow may be a process that includes a number of worksteps. A workstep may operate on data, for example, to create new data, to update existing data, etc. As an example, a workflow may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable at least in part in the PETREL® software, for example, that operates on seismic data, seismic attribute(s), etc.

As an example, seismic data can be data acquired via a seismic survey where sources and receivers are positioned in a geologic environment to emit and receive seismic energy where at least a portion of such energy can reflect off subsurface structures. As an example, a seismic data analysis framework or frameworks (e.g., consider the OMEGA® framework, marketed by Schlumberger Limited, Houston, Tex.) may be utilized to determine depth, extent, properties, etc. of subsurface structures. As an example, seismic data analysis can include forward modeling and/or inversion, for example, to iteratively build a model of a subsurface region of a geologic environment. As an example, a seismic data analysis framework may be part of or operatively coupled to a seismic-to-simulation framework (e.g., the PETREL® framework, etc.).

As an example, a workflow may be a process implementable at least in part in the OCEAN® framework. As an example, a workflow may include one or more worksteps that access a module such as a plug-in (e.g., external executable code, etc.).

As an example, a framework may provide for modeling petroleum systems. For example, the commercially available modeling framework marketed as the PETROMOD® framework (Schlumberger Limited, Houston, Tex.) includes features for input of various types of information (e.g., seismic, well, geological, etc.) to model evolution of a sedimentary basin. The PETROMOD® framework provides for petroleum systems modeling via input of various data such as seismic data, well data and other geological data, for example, to model evolution of a sedimentary basin. The PETROMOD® framework may predict if, and how, a reservoir has been charged with hydrocarbons, including, for example, the source and timing of hydrocarbon generation, migration routes, quantities, pore pressure and hydrocarbon type in the subsurface or at surface conditions. In combination with a framework such as the PETREL® framework, workflows may be constructed to provide basin-to-prospect scale exploration solutions. Data exchange between frameworks can facilitate construction of models, analysis of data (e.g., PETROMOD® framework data analyzed using PETREL® framework capabilities), and coupling of workflows.

As mentioned, a drillstring can include various tools that may make measurements. As an example, a wireline tool or another type of tool may be utilized to make measurements. As an example, a tool may be configured to acquire electrical borehole images. As an example, the fullbore Formation MicroImager (FMI) tool (Schlumberger Limited, Houston, Tex.) can acquire borehole image data. A data acquisition sequence for such a tool can include running the tool into a borehole with acquisition pads closed, opening and pressing the pads against a wall of the borehole, delivering electrical current into the material defining the borehole while translating the tool in the borehole, and sensing current remotely, which is altered by interactions with the material.

Analysis of formation information may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). As an example, information acquired by a tool or tools may be analyzed using a framework such as the TECHLOG® framework. As an example, the TECHLOG® framework can be interoperable with one or more other frameworks such as, for example, the PETREL® framework.

Figure 4:
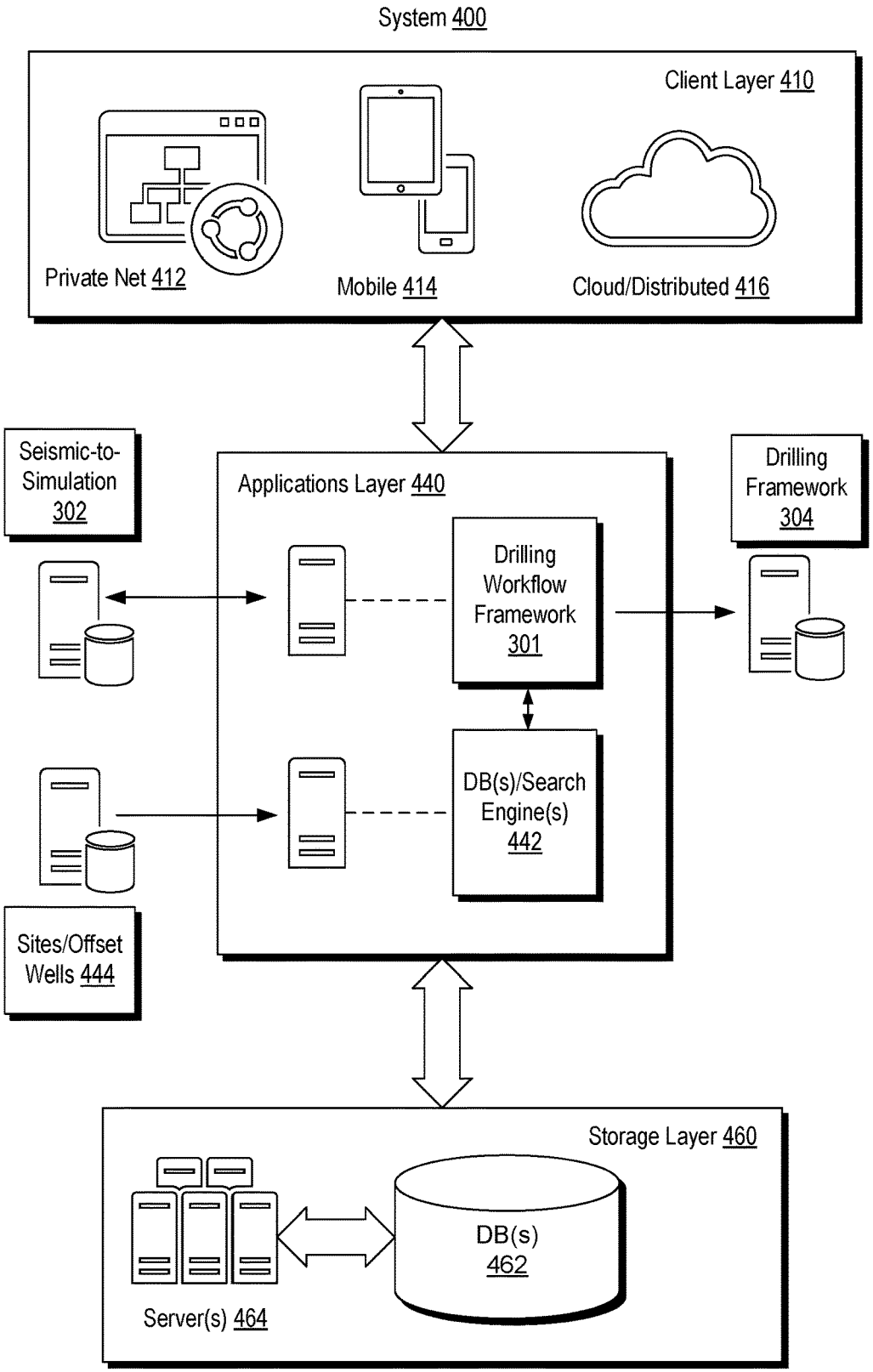
FIG. 4 illustrates an example of a system.

FIG. 4 shows an example of a system 400 that includes a client layer 410, an applications layer 440 and a storage layer 460. As shown the client layer 410 can be in communication with the applications layer 440 and the applications layer 440 can be in communication with the storage layer 460.

The client layer 410 can include features that allow for access and interactions via one or more private networks 412, one or more mobile platforms and/or mobile networks 414 and via the "cloud" 416, which may be considered to include distributed equipment that forms a network such as a network of networks.

In the example of FIG. 4, the applications layer 440 includes the drilling workflow framework 301 as mentioned with respect to the example of FIG. 3. The applications layer 440 also includes a database management component 442 that includes one or more search engines modules.

As an example, the database management component 442 can include one or more search engine modules that provide for searching one or more information that may be stored in one or more data repositories. As an example, the STUDIO E&P™ knowledge environment (Schlumberger Ltd., Houston, Tex.) includes STUDIO FIND™ search functionality, which provides a search engine. The STUDIO FIND™ search functionality also provides for indexing content, for example, to create one or more indexes. As an example, search functionality may provide for access to public content, private content or both, which may exist in one or more databases, for example, optionally distributed and accessible via an intranet, the Internet or one or more other networks. As an example, a search engine may be configured to apply one or more filters from a set or sets of filters, for example, to enable users to filter out data that may not be of interest.

As an example, a framework may provide for interaction with a search engine and, for example, associated features such as features of the STUDIO FIND™ search functionality. As an example, a framework may provide for implementation of one or more spatial filters (e.g., based on an area viewed on a display, static data, etc.). As an example, a search may provide access to dynamic data (e.g., "live" data from one or more sources), which may be available via one or more networks (e.g., wired, wireless, etc.). As an example, one or more modules may optionally be implemented within a framework or, for example, in a manner operatively coupled to a framework (e.g., as an add-on, a plug-in, etc.). As an example, a module for structuring search results (e.g., in a list, a hierarchical tree structure, etc.) may optionally be implemented within a framework or, for example, in a manner operatively coupled to a framework (e.g., as an add-on, a plug-in, etc.).

In the example of FIG. 4, the applications layer 440 can include communicating with one or more resources such as, for example, the seismic-to-simulation framework 302, the drilling framework 304 and/or one or more sites, which may be or include one or more offset wellsites. As an example, the applications layer 440 may be implemented for a particular wellsite where information can be processed as part of a workflow for operations such as, for example, operations performed, being performed and/or to be performed at the particular wellsite. As an example, an operation may involve directional drilling, for example, via geosteering.

In the example of FIG. 4, the storage layer 460 can include various types of data, information, etc., which may be stored in one or more databases 462. As an example, one or more servers 464 may provide for management, access, etc., to data, information, etc., stored in the one or more databases 462. As an example, the module 442 may provide for searching as to data, information, etc., stored in the one or more databases 462.

As an example, the module 442 may include features for indexing, etc. As an example, information may be indexed at least in part with respect to wellsite. For example, where the applications layer 440 is implemented to perform one or more workflows associated with a particular wellsite, data, information, etc., associated with that particular wellsite may be indexed based at least in part on the wellsite being an index parameter (e.g., a search parameter).

As an example, the system 400 of FIG. 4 may be implemented to perform one or more portions of one or more workflows associated with the system 300 of FIG. 3. For example, the drilling workflow framework 301 may interact with the technical data framework 303 and the drilling framework 304 before, during and/or after performance of one or more drilling operations. In such an example, the one or more drilling operations may be performed in a geologic environment (see, e.g., the environment 150 of FIG. 1) using one or more types of equipment (see, e.g., equipment of FIGS. 1 and 2).

Figure 5:
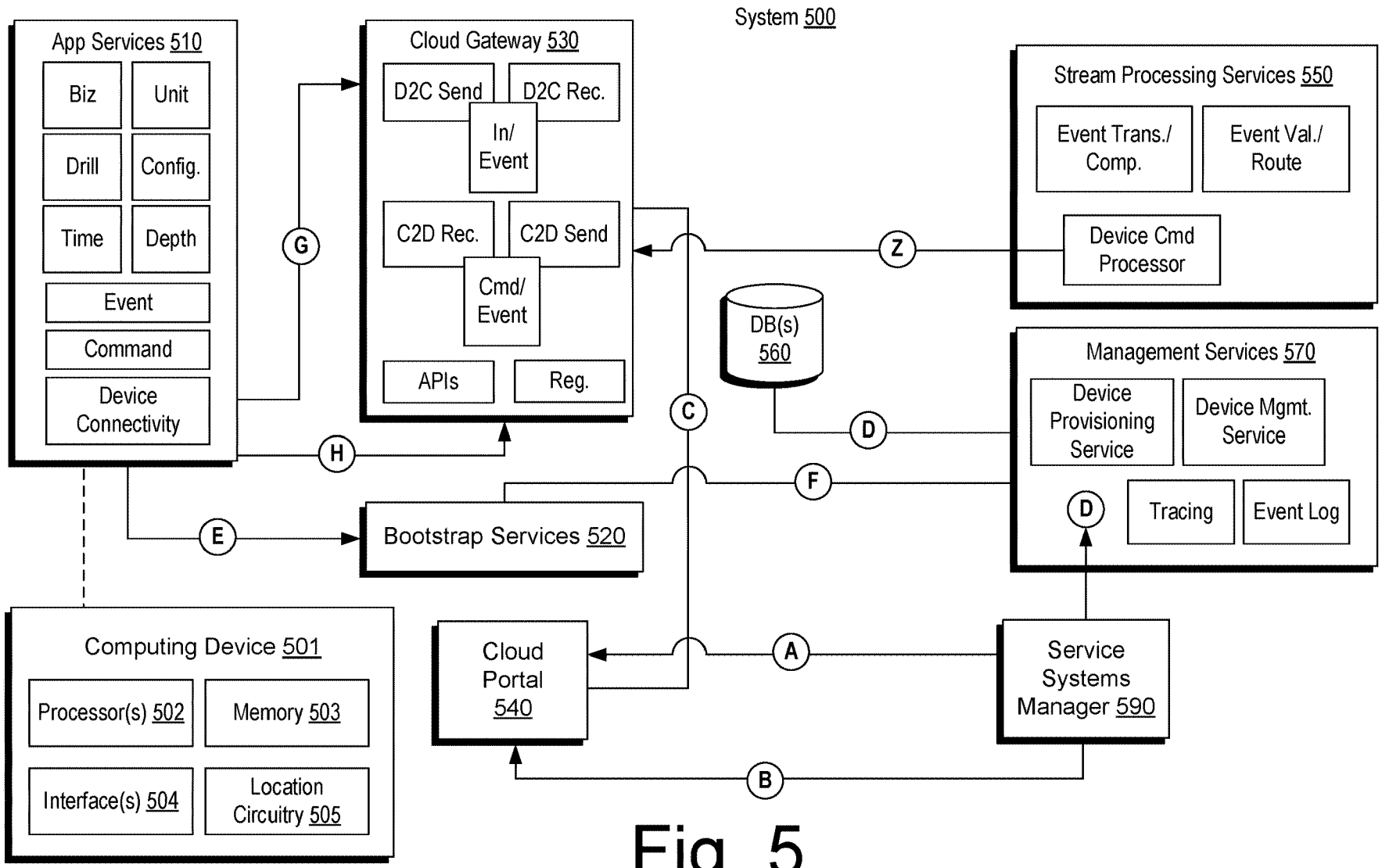
FIG. 5 illustrates an example of a system.

FIG. 5 shows an example of a system 500 that includes a computing device 501, an application services block 510, a bootstrap services block 520, a cloud gateway block 530, a cloud portal block 540, a stream processing services block 550, one or more databases 560, a management services block 570 and a service systems manager 590.

In the example of FIG. 5, the computing device 501 can include one or more processors 502, memory 503, one or more interfaces 504 and location circuitry 505 or, for example, one of the one or more interfaces 504 may be operatively coupled to location circuitry that can acquire local location information. For example, the computing device 501 can include GPS circuitry as location circuitry such that the approximate location of the computer device 501 can be determined. While GPS is mentioned (Global Positioning System), location circuitry may employ one or more types of locating techniques. For example, consider one or more of GLONASS, GALILEO, BeiDou-2, or another system (e.g., global navigation satellite system, "GNSS"). As an example, location circuitry may include cellular phone circuitry (e.g., LTE, 3G, 4G, etc.). As an example, location circuitry may include Wi-Fi circuitry.

As an example, the application services block 510 can be implemented via instructions executable using the computing device 501. As an example, the computing device 501 may be at a wellsite and part of wellsite equipment. As an example, the computing device 501 may be a mobile computing device (e.g., tablet, laptop, etc.) or a desktop computing device that may be mobile, for example, as part of wellsite equipment (e.g., doghouse equipment, rig equipment, vehicle equipment, etc.).

As an example, the system 500 can include performing various actions. For example, the system 500 may include a token that is utilized as a security measure to assure that information (e.g., data) is associated with appropriate permission or permissions for transmission, storage, access, etc.

In the example of FIG. 5, various circles are shown with labels A to H. As an example, A can be a process where an administrator creates a shared access policy (e.g., manually, via an API, etc.); B can be a process for allocating a shared access key for a device identifier (e.g., a device ID), which may be performed manually, via an API, etc.); C can be a process for creating a "device" that can be registered in a device registry and for allocating a symmetric key; D can be a process for persisting metadata where such metadata may be associated with a wellsite identifier (e.g., a well ID) and where, for example, location information (e.g., GPS based information, etc.) may be associated with a device ID and a well ID; E can be a process where a bootstrap message passes that includes a device ID (e.g., a trusted platform module (TPM) chip ID that may be embedded within a device) and that includes a well ID and location information such that bootstrap services (e.g., of the bootstrap services block 520) can proceed to obtain shared access signature (SAS) key(s) to a cloud service endpoint for authorization; F can be a process for provisioning a device, for example, if not already provisioned, where, for example, the process can include returning device keys and endpoint; G can be a process for getting a SAS token using an identifier and a key; and H can be a process that includes being ready to send a message using device credentials. Also shown in FIG. 5 is a process for getting a token and issuing a command for a well identifier (see label Z).

As an example, Shared Access Signatures can be an authentication mechanism based on, for example, SHA-256 secure hashes, URIs, etc. As an example, SAS may be used by one or more Service Bus services. SAS can be implemented via a Shared Access Policy and a Shared Access Signature, which may be referred to as a token. As an example, for SAS applications using the AZURE™.NET SDK with the Service Bus, .NET libraries can use SAS authorization through the SharedAccessSignatureTokenProvider class.

As an example, where a system gives an entity (e.g., a sender, a client, etc.) a SAS token, that entity does not have the key directly, and that entity cannot reverse the hash to obtain it. As such, there is control over what that entity can access and, for example, for how long access may exist. As an example, in SAS, for a change of the primary key in the policy, Shared Access Signatures created from it will be invalidated.

As an example, the system 500 of FIG. 5 can be implemented for provisioning of rig acquisition system and/or data delivery.

As an example, a method can include establishing an Internet of Things (IoT) hub or hubs. As an example, such a hub or hubs can include one or more device registries. In such an example, the hub or hubs may provide for storage of metadata associated with a device and, for example, a per-device authentication model. As an example, where location information indicates that a device (e.g., wellsite equipment, etc.) has been changed with respect to its location, a method can include revoking the device in a hub.

As an example, an architecture utilized in a system such as, for example, the system 500 may include features of the AZURE™ architecture (Microsoft Corporation, Redmond, Wash.). As an example, the cloud portal block 540 can include one or more features of an AZURE™ portal that can manage, mediate, etc. access to one or more services, data, connections, networks, devices, etc.

As an example, the system 500 can include a cloud computing platform and infrastructure, for example, for building, deploying, and managing applications and services (e.g., through a network of datacenters, etc.). As an example, such a cloud platform may provide PaaS and IaaS services and support one or more different programming languages, tools and frameworks, etc.

FIG. 6 shows an example of a system 600 associated with an example of a wellsite system 601 and also shows an example scenario 602. As shown in FIG. 6, the system 600 can include a front-end 603 and a back-end 605 from an outside or external perspective (e.g., external to the wellsite system 601, etc.). In the example of FIG. 6, the system 600 includes a drilling framework 620, a stream processing and/or management block 640, storage 660 and optionally one or more other features that can be defined as being back-end features. In the example of FIG. 6, the system 600 includes a drilling workflow framework 610, a stream processing and/or management block 630, applications 650 and optionally one or more other features that can be defined as being front-end features.

As an example, a user operating a user device can interact with the front-end 603 where the front-end 603 can interact with one or more features of the back-end 605. As an example, such interactions may be implemented via one or more networks, which may be associated with a cloud platform (e.g., cloud resources, etc.).

As to the example scenario 602, the drilling framework 620 can provide information associated with, for example, the wellsite system 601. As shown, the stream blocks 630 and 640, a query service 685 and the drilling workflow framework 610 may receive information and direct such information to storage, which may include a time series database 662, a blob storage database 664, a document database 666, a well information database 668, a project(s) database 669, etc. As an example, the well information database 668 may receive and store information such as, for example, customer information (e.g., from entities that may be owners of rights at a wellsite, service providers at a wellsite, etc.). As an example, the project database 669 can include information from a plurality of projects where a project may be, for example, a wellsite project.

As an example, the system 600 can be operable for a plurality of wellsites, which may include active and/or inactive wellsites and/or, for example, one or more planned wellsites. As an example, the system 600 can include various components of the system 300 of FIG. 3. As an example, the system 600 can include various components of the system 400 of FIG. 4. For example, the drilling workflow framework 610 can be a drilling workflow framework such as the drilling workflow framework 301 and/or, for example, the drilling framework 620 can be a drilling framework such as the drilling framework 304.

Figure 7:
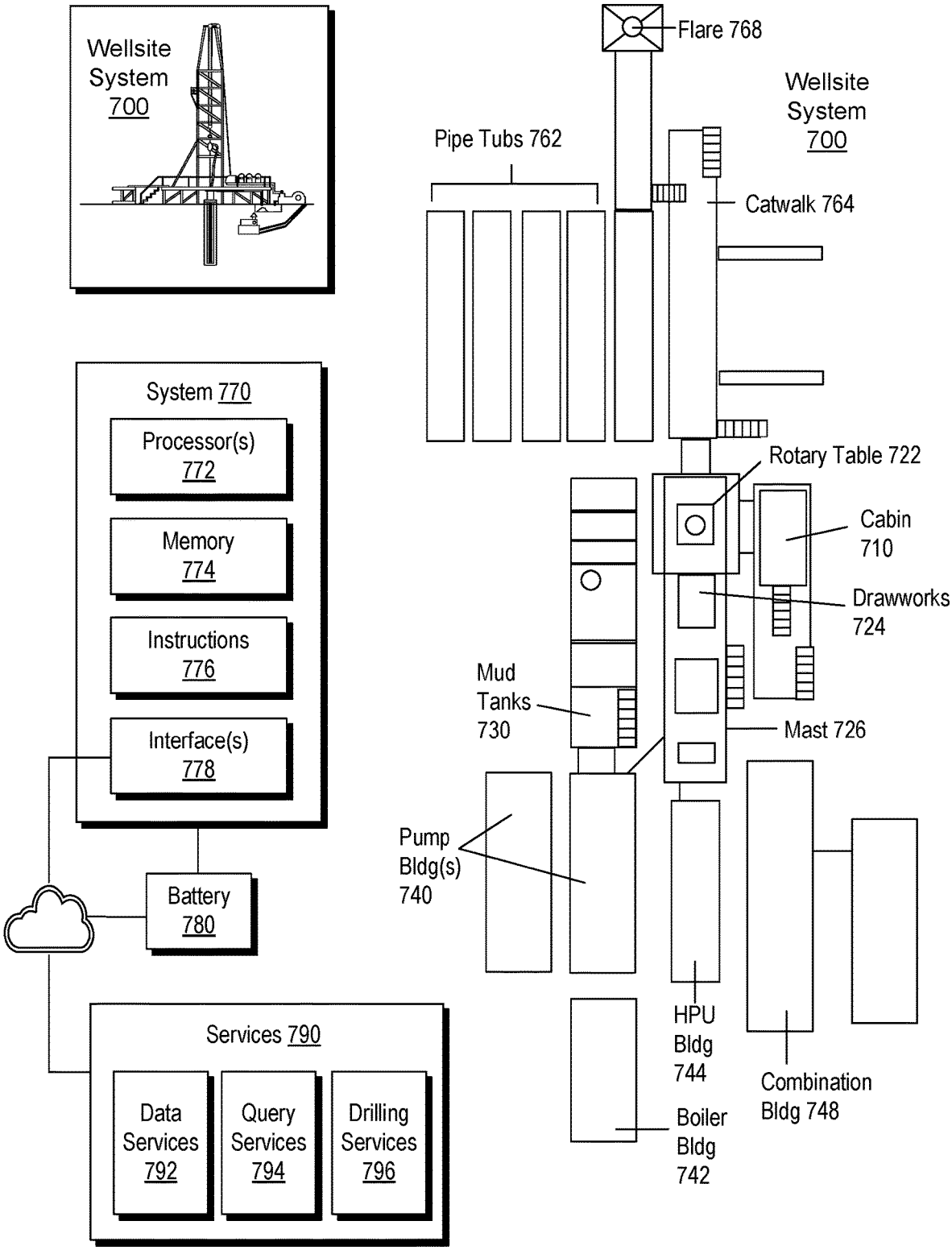
FIG. 7 illustrates an example of a wellsite system.

FIG. 7 shows an example of a wellsite system 700, specifically, FIG. 7 shows the wellsite system 700 in an approximate side view and an approximate plan view along with a block diagram of a system 770.

In the example of FIG. 7, the wellsite system 700 can include a cabin 710, a rotary table 722, drawworks 724, a mast 726 (e.g., optionally carrying a top drive, etc.), mud tanks 730 (e.g., with one or more pumps, one or more shakers, etc.), one or more pump buildings 740, a boiler building 742, an HPU building 744 (e.g., with a rig fuel tank, etc.), a combination building 748 (e.g., with one or more generators, etc.), pipe tubs 762, a catwalk 764, a flare 768, etc. Such equipment can include one or more associated functions and/or one or more associated operational risks, which may be risks as to time, resources, and/or humans.

As shown in the example of FIG. 7, the wellsite system 700 can include a system 770 that includes one or more processors 772, memory 774 operatively coupled to at least one of the one or more processors 772, instructions 776 that can be, for example, stored in the memory 774, and one or more interfaces 778. As an example, the system 770 can include one or more processor-readable media that include processor-executable instructions executable by at least one of the one or more processors 772 to cause the system 770 to control one or more aspects of the wellsite system 700. In such an example, the memory 774 can be or include the one or more processor-readable media where the processor-executable instructions can be or include instructions. As an example, a processor-readable medium can be a computer-readable storage medium that is not a signal and that is not a carrier wave.

FIG. 7 also shows a battery 780 that may be operatively coupled to the system 770, for example, to power the system 770. As an example, the battery 780 may be a back-up battery that operates when another power supply is unavailable for powering the system 770. As an example, the battery 780 may be operatively coupled to a network, which may be a cloud network. As an example, the battery 780 can include smart battery circuitry and may be operatively coupled to one or more pieces of equipment via a SMBus or other type of bus.

In the example of FIG. 7, services 790 are shown as being available, for example, via a cloud platform. Such services can include data services 792, query services 794 and drilling services 796. As an example, the services 790 may be part of a system such as the system 300 of FIG. 3, the system 400 of FIG. 4 and/or the system 600 of FIG. 6.

As an example, a system such as, for example, the system 300 of FIG. 3 may be utilized to perform a workflow. Such a system may be distributed and allow for collaborative workflow interactions and may be considered to be a platform (e.g., a framework for collaborative interactions, etc.).

As an example, one or more systems can be utilized to implement a workflow that can be performed collaboratively. As an example, the system 300 of FIG. 3 can be operated as a distributed, collaborative well-planning system. The system 300 can utilize one or more servers, one or more client devices, etc. and may maintain one or more databases, data files, etc., which may be accessed and modified by one or more client devices, for example, using a web browser, remote terminal, etc. As an example, a client device may modify a database or data files on-the-fly, and/or may include "sandboxes" that may permit one or more client devices to modify at least a portion of a database or data files optionally off-line, for example, without affecting a database or data files seen by one or more other client devices. As an example, a client device that includes a sandbox may modify a database or data file after completing an activity in the sandbox.

In some examples, client devices and/or servers may be remote with respect to one another and/or may individually include two or more remote processing units. As an example, two systems can be "remote" with respect to one another if they are not physically proximate to one another;

for example, two devices that are located at different sides of a room, in different rooms, in different buildings, in different cities, countries, etc. may be considered "remote" depending on the context. In some embodiments, two or more client devices may be proximate to one another, and/or one or more client devices and a server may be proximate to one another.

As an example, various aspects of a workflow may be completed automatically, may be partially automated, or may be completed manually, as by a human user interfacing with a software application. As an example, a workflow may be cyclic, and may include, as an example, four stages such as, for example, an evaluation stage (see, e.g., the evaluation equipment 310), a planning stage (see, e.g., the planning equipment 320), an engineering stage (see, e.g., the engineering equipment 330) and an execution stage (see, e.g., the operations equipment 340). As an example, a workflow may commence at one or more stages, which may progress to one or more other stages (e.g., in a serial manner, in a parallel manner, in a cyclical manner, etc.).

As an example, a workflow can commence with an evaluation stage, which may include a geological service provider evaluating a formation (see, e.g., the evaluation block 314). As an example, a geological service provider may undertake the formation evaluation using a computing system executing a software package tailored to such activity; or, for example, one or more other suitable geology platforms may be employed (e.g., alternatively or additionally). As an example, the geological service provider may evaluate the formation, for example, using earth models, geophysical models, basin models, petrotechnical models, combinations thereof, and/or the like. Such models may take into consideration a variety of different inputs, including offset well data, seismic data, pilot well data, other geologic data, etc. The models and/or the input may be stored in the database maintained by the server and accessed by the geological service provider.

As an example, a workflow may progress to a geology and geophysics ("G&G") service provider, which may generate a well trajectory (see, e.g., the generation block 324), which may involve execution of one or more G&G software packages. Examples of such software packages include the PETREL® framework. As an example, a G&G service provider may determine a well trajectory or a section thereof, based on, for example, one or more model(s) provided by a formation evaluation (e.g., per the evaluation block 314), and/or other data, e.g., as accessed from one or more databases (e.g., maintained by one or more servers, etc.). As an example, a well trajectory may take into consideration various "basis of design" (BOD) constraints, such as general surface location, target (e.g., reservoir) location, and the like. As an example, a trajectory may incorporate information about tools, bottom-hole assemblies, casing sizes, etc., that may be used in drilling the well. A well trajectory determination may take into consideration a variety of other parameters, including risk tolerances, fluid weights and/or plans, bottom-hole pressures, drilling time, etc.

As an example, a workflow may progress to a first engineering service provider (e.g., one or more processing machines associated therewith), which may validate a well trajectory and, for example, relief well design (see, e.g., the validation block 328). Such a validation process may include evaluating physical properties, calculations, risk tolerances, integration with other aspects of a workflow, etc. As an example, one or more parameters for such determinations may be maintained by a server and/or by the first engineering service provider; noting that one or more model(s), well trajectory(ies), etc. may be maintained by a server and accessed by the first engineering service provider. For example, the first engineering service provider may include one or more computing systems executing one or more software packages. As an example, where the first engineering service provider rejects or otherwise suggests an adjustment to a well trajectory, the well trajectory may be adjusted or a message or other notification sent to the G&G service provider requesting such modification.

As an example, one or more engineering service providers (e.g., first, second, etc.) may provide a casing design, bottom-hole assembly (BHA) design, fluid design, and/or the like, to implement a well trajectory (see, e.g., the design block 338). In some embodiments, a second engineering service provider may perform such design using one of more software applications. Such designs may be stored in one or more databases maintained by one or more servers, which may, for example, employ STUDIO® framework tools, and may be accessed by one or more of the other service providers in a workflow.

As an example, a second engineering service provider may seek approval from a third engineering service provider for one or more designs established along with a well trajectory. In such an example, the third engineering service provider may consider various factors as to whether the well engineering plan is acceptable, such as economic variables (e.g., oil production forecasts, costs per barrel, risk, drill time, etc.), and may request authorization for expenditure, such as from the operating company's representative, well-owner's representative, or the like (see, e.g., the formulation block 334). As an example, at least some of the data upon which such determinations are based may be stored in one or more database maintained by one or more servers. As an example, a first, a second, and/or a third engineering service provider may be provided by a single team of engineers or even a single engineer, and thus may or may not be separate entities.

As an example, where economics may be unacceptable or subject to authorization being withheld, an engineering service provider may suggest changes to casing, a bottom-hole assembly, and/or fluid design, or otherwise notify and/or return control to a different engineering service provider, so that adjustments may be made to casing, a bottom-hole assembly, and/or fluid design. Where modifying one or more of such designs is impracticable within well constraints, trajectory, etc., the engineering service provider may suggest an adjustment to the well trajectory and/or a workflow may return to or otherwise notify an initial engineering service provider and/or a G&G service provider such that either or both may modify the well trajectory.

As an example, a workflow can include considering a well trajectory, including an accepted well engineering plan, and a formation evaluation. Such a workflow may then pass control to a drilling service provider, which may implement the well engineering plan, establishing safe and efficient drilling, maintaining well integrity, and reporting progress as well as operating parameters (see, e.g., the blocks 344 and 348). As an example, operating parameters, formation encountered, data collected while drilling (e.g., using logging-while-drilling or measuring-while-drilling technology), may be returned to a geological service provider for evaluation. As an example, the geological service provider may then re-evaluate the well trajectory, or one or more other aspects of the well engineering plan, and may, in some cases, and potentially within predetermined constraints, adjust the well engineering plan according to the real-life drilling parameters (e.g., based on acquired data in the field, etc.).

Whether the well is entirely drilled, or a section thereof is completed, depending on the specific embodiment, a workflow may proceed to a post review (see, e.g., the evaluation block 318). As an example, a post review may include reviewing drilling performance. As an example, a post review may further include reporting the drilling performance (e.g., to one or more relevant engineering, geological, or G&G service providers).

Various activities of a workflow may be performed consecutively and/or may be performed out of order (e.g., based partially on information from templates, nearby wells, etc. to fill in any gaps in information that is to be provided by another service provider). As an example, undertaking one activity may affect the results or basis for another activity, and thus may, either manually or automatically, call for a variation in one or more workflow activities, work products, etc. As an example, a server may allow for storing information on a central database accessible to various service providers where variations may be sought by communication with an appropriate service provider, may be made automatically, or may otherwise appear as suggestions to the relevant service provider. Such an approach may be considered to be a holistic approach to a well workflow, in comparison to a sequential, piecemeal approach.

As an example, various actions of a workflow may be repeated multiple times during drilling of a wellbore. For example, in one or more automated systems, feedback from a drilling service provider may be provided at or near real-time, and the data acquired during drilling may be fed to one or more other service providers, which may adjust its piece of the workflow accordingly. As there may be dependencies in other areas of the workflow, such adjustments may permeate through the workflow, e.g., in an automated fashion. In some embodiments, a cyclic process may additionally or instead proceed after a certain drilling goal is reached, such as the completion of a section of the wellbore, and/or after the drilling of the entire wellbore, or on a per-day, week, month, etc. basis.

Well planning can include determining a path of a well that can extend to a reservoir, for example, to economically produce fluids such as hydrocarbons therefrom. Well planning can include selecting a drilling and/or completion assembly which may be used to implement a well plan. As an example, various constraints can be imposed as part of well planning that can impact design of a well. As an example, such constraints may be imposed based at least in part on information as to known geology of a subterranean domain, presence of one or more other wells (e.g., actual and/or planned, etc.) in an area (e.g., consider collision avoidance), etc. As an example, one or more constraints may be imposed based at least in part on characteristics of one or more tools, components, etc. As an example, one or more constraints may be based at least in part on factors associated with drilling time and/or risk tolerance.

As an example, a system can allow for a reduction in waste, for example, as may be defined according to LEAN. In the context of LEAN, consider one or more of the following types of waste: Transport (e.g., moving items unnecessarily, whether physical or data); Inventory (e.g., components, whether physical or informational, as work in process, and finished product not being processed); Motion (e.g., people or equipment moving or walking unnecessarily to perform desired processing); Waiting (e.g., waiting for information, interruptions of production during shift change, etc.); Overproduction (e.g., production of material, information, equipment, etc. ahead of demand); Over Processing (e.g., resulting from poor tool or product design creating activity); and Defects (e.g., effort involved in inspecting for and fixing defects whether in a plan, data, equipment, etc.). As an example, a system that allows for actions (e.g., methods, workflows, etc.) to be performed in a collaborative manner can help to reduce one or more types of waste.

As an example, a system can be utilized to implement a method for facilitating distributed well engineering, planning, and/or drilling system design across multiple computation devices where collaboration can occur among various different users (e.g., some being local, some being remote, some being mobile, etc.). In such a system, the various users via appropriate devices may be operatively coupled via one or more networks (e.g., local and/or wide area networks, public and/or private networks, land-based, marine-based and/or areal networks, etc.).

As an example, a system may allow well engineering, planning, and/or drilling system design to take place via a subsystems approach where a wellsite system is composed of various subsystem, which can include equipment subsystems and/or operational subsystems (e.g., control subsystems, etc.). As an example, computations may be performed using various computational platforms/devices that are operatively coupled via communication links (e.g., network links, etc.). As an example, one or more links may be operatively coupled to a common database (e.g., a server site, etc.). As an example, a particular server or servers may manage receipt of notifications from one or more devices and/or issuance of notifications to one or more devices. As an example, a system may be implemented for a project where the system can output a well plan, for example, as a digital well plan, a paper well plan, a digital and paper well plan, etc. Such a well plan can be a complete well engineering plan or design for the particular project.

Figure 8:
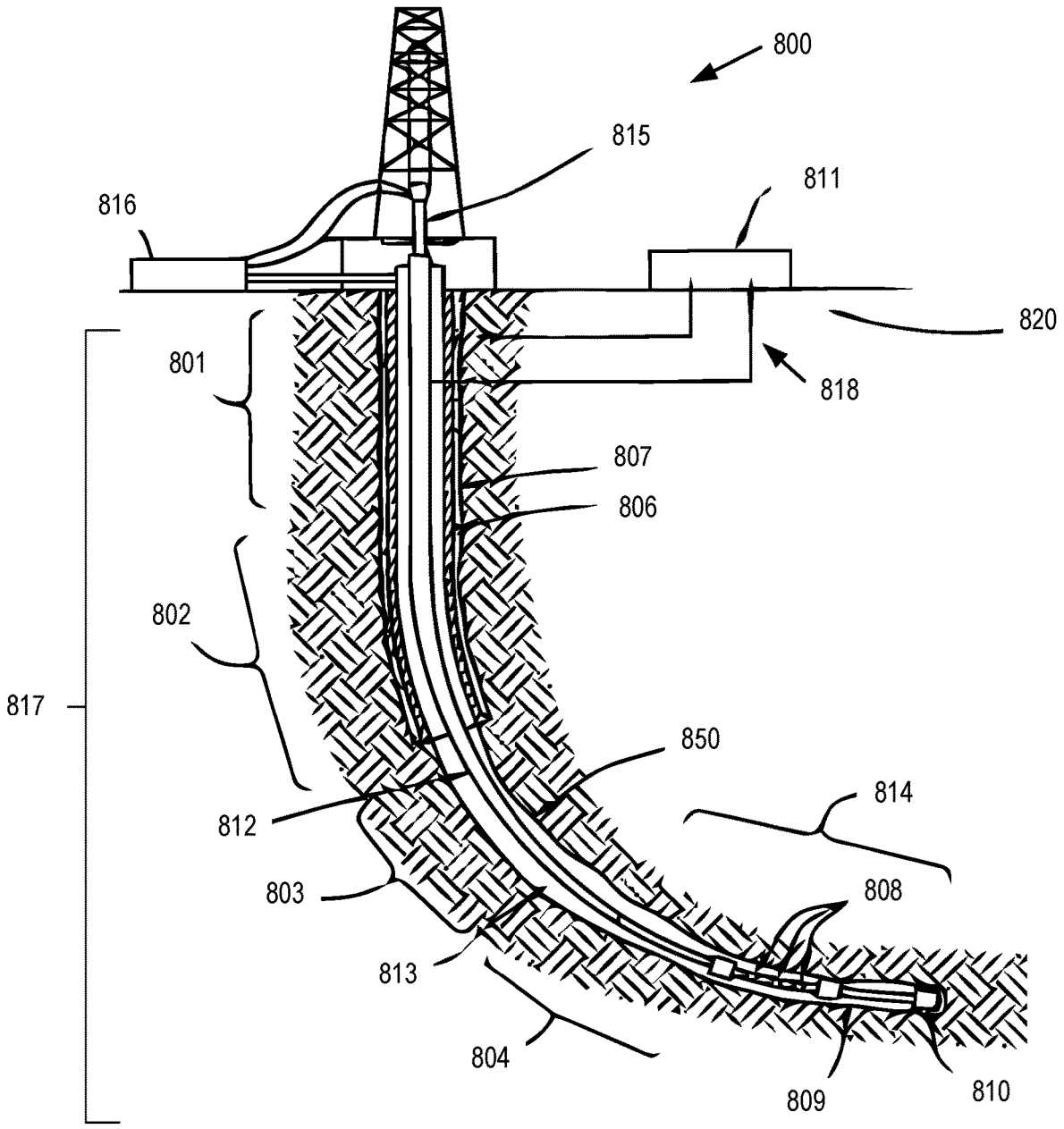
FIG. 8 illustrates an example of a system.

FIG. 8 shows a schematic diagram depicting an example of a drilling operation of a directional well in multiple sections. The drilling operation depicted in FIG. 8 includes a wellsite drilling system 800 and a field management tool 820 for managing various operations associated with drilling a bore hole 850 of a directional well 817. The wellsite drilling system 800 includes various components (e.g., drillstring 812, annulus 813, bottom hole assembly (BHA) 814, kelly 815, mud pit 816, etc.). As shown in the example of FIG. 8, a target reservoir may be located away from (as opposed to directly under) the surface location of the well 817. In such an example, special tools or techniques may be used to ensure that the path along the bore hole 850 reaches the particular location of the target reservoir.

As an example, the BHA 814 may include sensors 808, a rotary steerable system 809, and a bit 810 to direct the drilling toward the target guided by a pre-determined survey program for measuring location details in the well. Furthermore, the subterranean formation through which the directional well 817 is drilled may include multiple layers (not shown) with varying compositions, geophysical characteristics, and geological conditions. Both the drilling planning during the well design stage and the actual drilling according to the drilling plan in the drilling stage may be performed in multiple sections (e.g., sections 801, 802, 803 and 804) corresponding to the multiple layers in the subterranean formation. For example, certain sections (e.g., sections 801 and 802) may use cement 807 reinforced casing 806 due to the particular formation compositions, geophysical characteristics, and geological conditions.

In the example of FIG. 8, a surface unit 811 may be operatively linked to the wellsite drilling system 800 and the field management tool 820 via communication links 818. The surface unit 811 may be configured with functionalities to control and monitor the drilling activities by sections in real-time via the communication links 818. The field management tool 820 may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link 818 according to a drilling operation workflow. The communication links 818 may include a communication subassembly.

During various operations at a wellsite, data can be acquired for analysis and/or monitoring of one or more operations. Such data may include, for example, subterranean formation, equipment, historical and/or other data. Static data can relate to, for example, formation structure and geological stratigraphy that define the geological structures of the subterranean formation. Static data may also include data about a bore, such as inside diameters, outside diameters, and depths. Dynamic data can relate to, for example, fluids flowing through the geologic structures of the subterranean formation over time. The dynamic data may include, for example, pressures, fluid compositions (e.g. gas oil ratio, water cut, and/or other fluid compositional information), and states of various equipment, and other information.

The static and dynamic data collected via a bore, a formation, equipment, etc. may be used to create and/or update a three dimensional model of one or more subsurface formations. As an example, static and dynamic data from one or more other bores, fields, etc. may be used to create and/or update a three dimensional model. As an example, hardware sensors, core sampling, and well logging techniques may be used to collect data. As an example, static measurements may be gathered using downhole measurements, such as core sampling and well logging techniques. Well logging involves deployment of a downhole tool into the wellbore to collect various downhole measurements, such as density, resistivity, etc., at various depths. Such well logging may be performed using, for example, a drilling tool and/or a wireline tool, or sensors located on downhole production equipment. Once a well is formed and completed, depending on the purpose of the well (e.g., injection and/or production), fluid may flow to the surface (e.g., and/or from the surface) using tubing and other completion equipment. As fluid passes, various dynamic measurements, such as fluid flow rates, pressure, and composition may be monitored. These parameters may be used to determine various characteristics of a subterranean formation, downhole equipment, downhole operations, etc.

Figure 9:
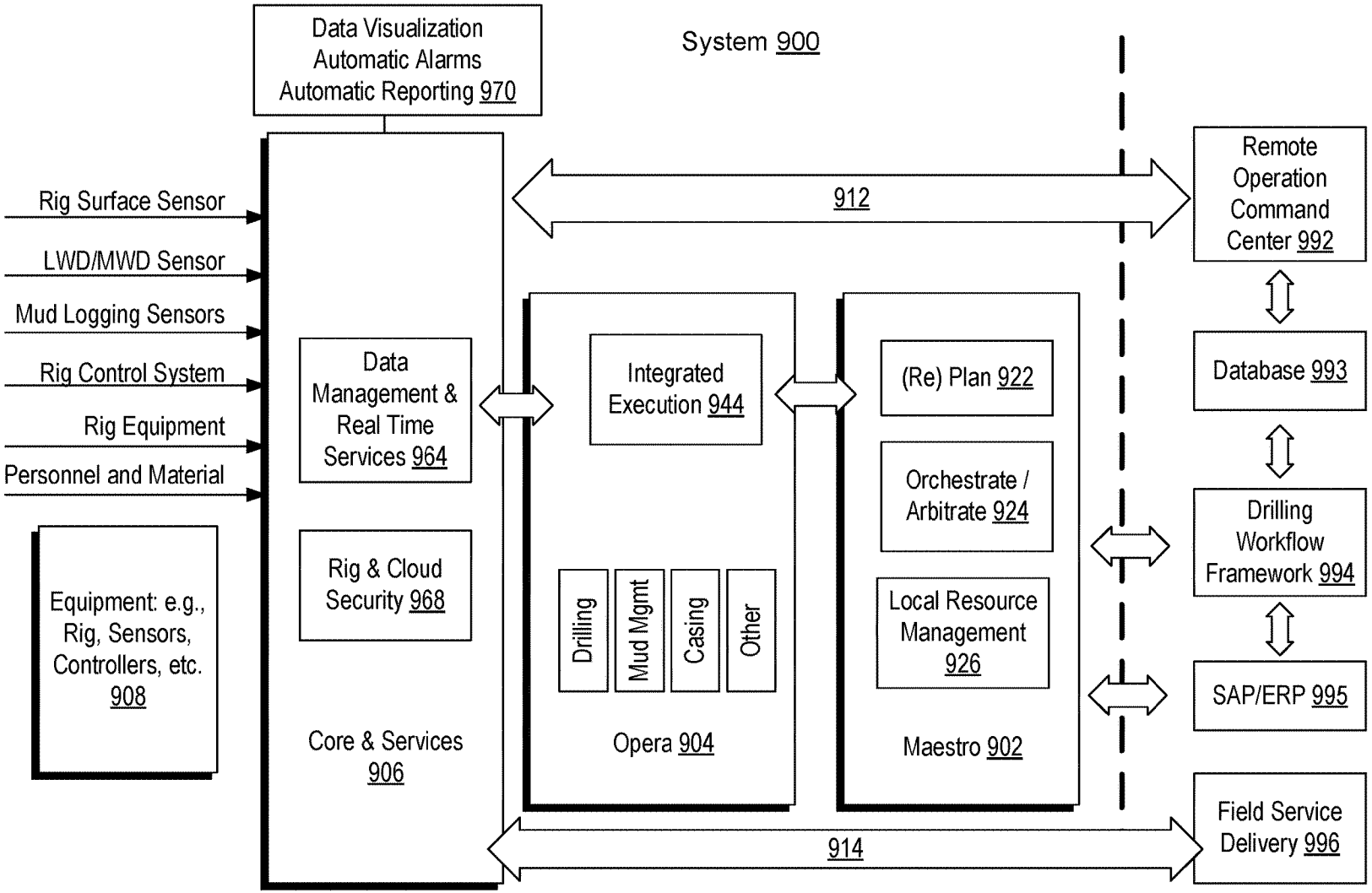
FIG. 9 illustrates an example of a system.

FIG. 9 shows an example of a system 900 that includes various components that can be local to a wellsite and includes various components that can be remote from a wellsite. As shown, the system 900 includes a block 902, a block 904, a block 906 and an equipment block 908. These blocks can be labeled in one or more manners other than as shown in the example of FIG. 9. In the example of FIG. 9, the blocks 902, 904, 906 and 908 can be defined by one or more of operational features, functions, relationships in an architecture, etc.

As an example, the block 902 can be associated with a well management level (e.g., well planning and/or orchestration) and can be associated with a rig management level (e.g., rig dynamic planning and/or orchestration). As an example, the block 904 can be associated with a process management level (e.g., rig integrated execution). As an example, the block 906 can be associated with a data management level (e.g., sensor, instrumentation, inventory, etc.). As an example, the equipment block 908 can be associated with a wellsite equipment level (e.g., wellsite subsystems, etc.).

In the example of FIG. 9, the block 902 includes a plan/replan block 922, an orchestrate/arbitrate block 924 and a local resource management block 926. In the example of FIG. 9, the block 904 includes an integrated execution block 944, which can include or be operatively coupled to blocks for various subsystems of a wellsite such as a drilling subsystem, a mud management subsystem (e.g., a hydraulics subsystem), a casing subsystem (e.g., casings and/or completions subsystem), and, for example, one or more other subsystems. In the example of FIG. 9, the block 906 includes a data management and real-time services block 964 (e.g., real-time or near real-time services) and a rig and cloud security block 968. In the example of FIG. 9, the equipment block 908 is shown as being capable of providing various types of information to the block 906. For example, consider information from a rig surface sensor, a LWD/MWD sensor, a mud logging sensor, a rig control system, rig equipment, personnel, material, etc. In the example, of FIG. 9, a block 970 can provide for one or more of data visualization, automatic alarms, automatic reporting, etc. As an example, the block 970 may be operatively coupled to the block 906 and/or one or more other blocks.

As mentioned, a portion of the system 900 can be remote from a wellsite. For example, to one side of a dashed line appear a remote operation command center block 992, a database block 993, a drilling workflow framework block 994, a SAP/ERP block 995 and a field services delivery block 996. Various blocks that may be remote can be operatively coupled to one or more blocks that may be local to a wellsite system. For example, a communication link 912 is illustrated in the example of FIG. 9 that can operatively couple the blocks 906 and 992 (e.g., as to monitoring, remote control, etc.), while another communication link 914 is illustrated in the example of FIG. 9 that can operatively couple the blocks 906 and 996 (e.g., as to equipment delivery, equipment services, etc.). Various other examples of possible communication links are also illustrated in the example of FIG. 9.

In the example of FIG. 9, various blocks can be components that may correspond to one or more software instruction sets (e.g., processor-executable instructions, add-ons, plug-ins, etc.), hardware infrastructure, firmware, equipment, or a combination thereof. Communication between the components may be local or remote, direct or indirect, via application programming interfaces, and procedure calls, or through one or more communication channels.

As an example, the block 906 (e.g., a core services block) can include functionality to manage individual pieces of equipment and/or equipment subsystems. As an example, such a block can include functionality to handle basic data structure of the oilfield, such as the rig, acquire metric data, produce reports, and manages resources of people and supplies. As an example, such a block may include a data acquirer and aggregator, a rig state identifier, a real-time (RT) drill services (e.g., near real-time), a reporter, a cloud, and an inventory manager.

As an example, a data acquirer and aggregator can include functionality to interface with individual equipment components and sensor and acquire data. As an example, a data acquirer and aggregator may further include functionality to interface with sensors located at the oilfield.

As an example, a rig state identifier can includes functionality to obtain data from the data acquirer and aggregator and transform the data into state information. As an example, state information may include health and operability of a rig as well as information about a particular task being performed by equipment.

As an example, RT drill services can include functionality to transmit and present information to individuals. In particular, the RT drill services can include functionality to transmit information to individuals involved according to roles and, for example, device types of each individual (e.g., mobile, desktop, etc.). In one or more embodiments, information presented by RT drill services can be context specific, and may include a dynamic display of information so that a human user may view details about items of interest.

As an example, a wellsite "cloud" framework can correspond to an information technology infrastructure locally at an oilfield, such as an individual rig in the oilfield. In such an example, the wellsite "cloud" framework may be an "Internet of Things" (IoT) framework. As an example, a wellsite "cloud" framework can be an edge of the cloud (e.g., a network of networks) or of a private network.

In the example of FIG. 9, the equipment block 908 can correspond to various controllers, control unit, control equipment, etc. that may be operatively coupled to and/or embedded into physical equipment at a wellsite such as, for example, rig equipment. For example, the equipment block 908 may correspond to software and control systems for individual items on the rig. As an example, the equipment block 908 may provide for monitoring sensors from multiple subsystems of a drilling rig and provide control commands to multiple subsystem of the drilling rig, such that sensor data from multiple subsystems may be used to provide control commands to the different subsystems of the drilling rig and/or other devices, etc. For example, a system may collect temporally and depth aligned surface data and downhole data from a drilling rig and transmit the collected data to data acquirers and aggregators in core services, which can store the collected data for access onsite at a drilling rig or offsite via a computing resource environment.

As an example, a system can include a framework that can acquire data such as, for example, real-time data associated with one or more operations such as, for example, a drilling operation or drilling operations. As an example, consider the PERFORM™ toolkit framework (Schlumberger Limited, Houston, Tex.).

As an example, a service can be or include one or more of OPTIDRILL™, OPTILOG™ and/or other services marketed by Schlumberger Limited, Houston, Tex.

The OPTIDRILL™ technology can help to manage downhole conditions and BHA dynamics as a real-time drilling intelligence service. The service can incorporate a rigsite display (e.g., a wellsite display) of integrated downhole and surface data that provides actionable information to mitigate risk and increase efficiency. As an example, such data may be stored, for example, to a database system (e.g., consider a database system associated with the STUDIO™ framework).

The OPTILOG™ technology can help to evaluate drilling system performance with single- or multiple-location measurements of drilling dynamics and internal temperature from a recorder. As an example, post-run data can be analyzed to provide input for future well planning.

As an example, information from a drill bit database may be accessed and utilized. For example, consider information from Smith Bits (Schlumberger Limited, Houston, Tex.), which may include information from various operations (e.g., drilling operations) as associated with various drill bits, drilling conditions, formation types, etc.

As an example, one or more QTRAC services (Schlumberger Limited, Houston Tex.) may be provided for one or more wellsite operations. In such an example, data may be acquired and stored where such data can include time series data that may be received and analyzed, etc.

As an example, one or more M-I SWACO™ services (M-I L.L.C., Houston, Tex.) may be provided for one or more wellsite operations. For example, consider services for value-added completion and reservoir drill-in fluids, additives, cleanup tools, and engineering. In such an example, data may be acquired and stored where such data can include time series data that may be received and analyzed, etc.

As an example, one or more ONE-TRAX™ services (e.g., via the ONE-TRAX software platform, M-I L.L.C., Houston, Tex.) may be provided for one or more wellsite operations. In such an example, data may be acquired and stored where such data can include time series data that may be received and analyzed, etc.

As mentioned, for a project that aims to develop or further develop a reservoir, a method can include generating a set of possible trajectories, which may be referred to as a set of candidate trajectories, and interrogating one or more of the candidates with respect to one or more performance indicators (PIs).

As an example, a wellbore trajectory can be defined as a geometric trace that connects a well surface location and one or more target locations. As an example, when a wellbore trajectory is designed by a drilling engineer, several rules (e.g., performance indicators (PIs)) may be specified that the trajectory may be expected to follow. For example, consider one or more of a kickoff point that is to be below a mudline, collision avoidance with one or more existing wells, and dogleg severity (DLS), which may be provided as an indicator of an ability for drilling tools to turn, not get stuck, etc.

As an example, a method may be implemented as an automated or semi-automated way to design one or more trajectories. As an example, a method may design a single trajectory or a group of trajectories, for example, without collision avoidance. As an example, a method can include modeling one or more trajectories as a multi-objective optimization problem. For example, PIs can be utilized as cost functions and rules as constraints.

As an example, a multi-objective optimization problem can be solved using a Pareto frontier approach (e.g., as to generation, filtering, etc. of candidate trajectories). A planning objective can be to design a well trajectory that is drillable with its PIs being the "best" possible; in other words, a planning objective can be to determine a planned trajectory that can be drilled with some assurances of low cost and risk. In a multi-objective optimization problem approach, complexity can mean that a unique solution may not exist. In the context of trajectory planning, complexity can arise due to PIs that may contradict each other. For example, less DLS and less total depth can be two PIs; however, less DLS can result in a greater total depth. In such a scenario, a trade-off may be made that aims to favor one over the other. In a Pareto frontier approach, a Pareto efficient set of candidate trajectories can be a set where associated PIs for individual members of the set are not "worse" than those of other individual members of the set. As an example, a Pareto efficient set may be determined using an iterative process that can include, for example, implementation of one or more evolutionary processes, which may provide for a more global solution.

Figure 10:
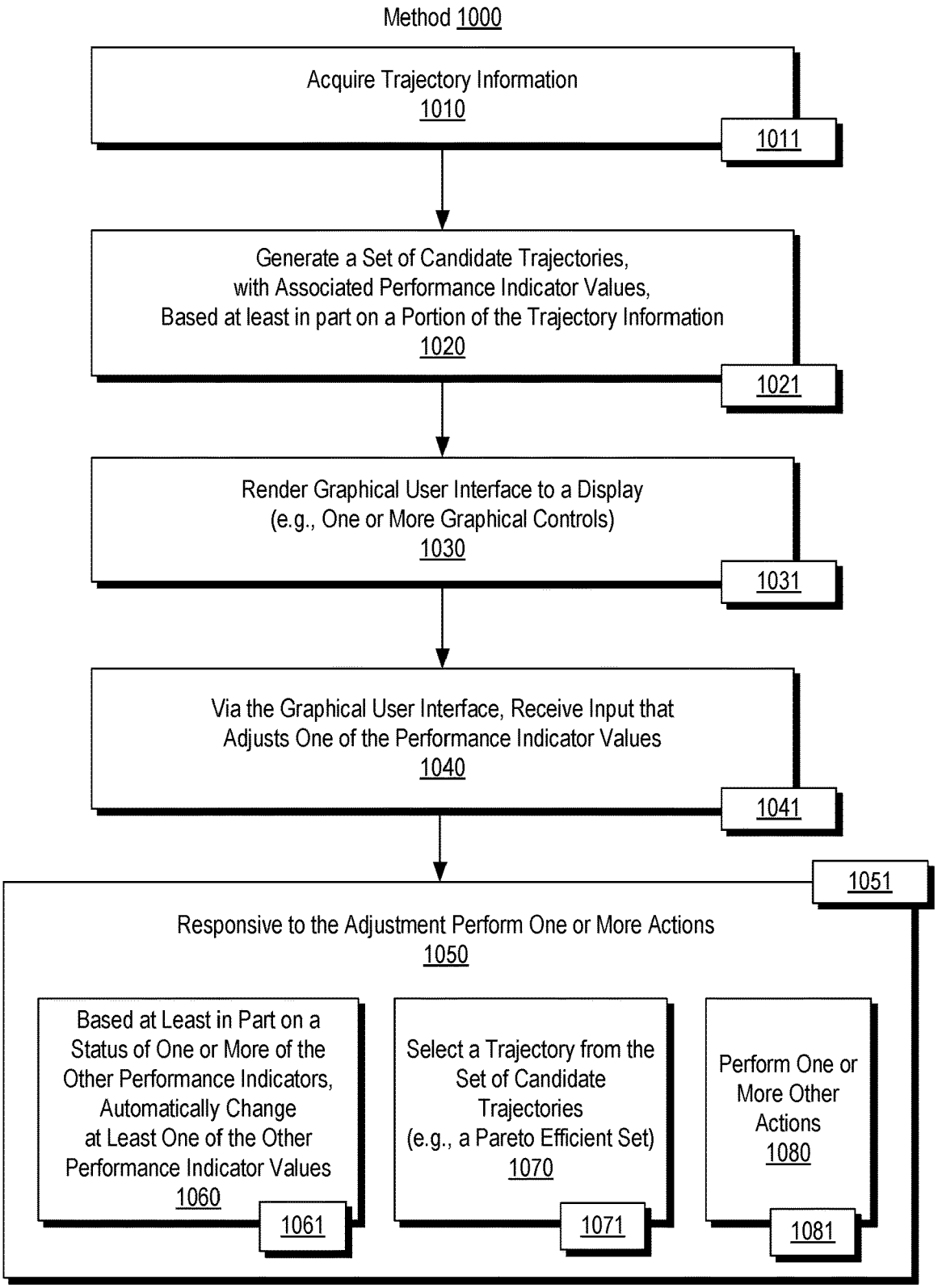
FIG. 10 illustrates an example of a method.

FIG. 10 shows an example of a method 1000 that includes an acquisition block 1010 for acquiring trajectory information; a generation block 1020 for, based at least in part on a portion of the trajectory information, generating a set of candidate trajectories with associated performance indicator values (PI values); a render block 1030 for rendering a graphical user interface (GUI) to a display; a reception block 1040 for, via the GUI, receiving input that adjusts one of the performance indicator values; and a performance block 1050 for, responsive to the adjustment to the one of the performance indicator values, performing one or more actions.

As shown in the example of FIG. 10, the performance block 1050 can include one or more blocks 1060, 1070 and 1080 for performing one or more of various actions. As shown in FIG. 10, the block 1060 provides for, based at least in part on a status of one or more of the other performance indicators, changing at least one of the other performance indicator values; the block 1070 provides for selecting a trajectory from the set of candidate trajectories where the set of candidate trajectories may be, as an example, a Pareto efficient set; and the block 1080 provides for performing one or more other actions. As an example, blocks 1060 and 1070 may be implemented together where an automatic change occurs for one or more of the other performance indicator values and where a selection occurs from a candidate set, which can be an automatic selection.

As an example, a GUI can include a scene of a subterranean environment where a trajectory can be rendered, for example, as a graphic from a surface location to a target location. In such an example, an adjustment to a performance indicator value may alter one or more aspects of the trajectory where the altered trajectory, as rendered, can be a different trajectory of a set of candidate trajectories that may adhere better to the adjusted performance indicator value (e.g., or values) than the previously rendered trajectory. To a user looking at the GUI, the alteration may occur without a user knowing that a different trajectory is being selected as, for example, the different trajectory may include one or more portions that overlap with the previously rendered trajectory. Visually, to a user, it may appear that the trajectory is merely being altered as to one or more of its characteristics. As members of a set of candidate trajectories may be members of a predetermined set associated with performance indicator values (e.g., a Pareto efficient set, etc.), a selection process can be rapid (e.g., real-time) such that as a user adjusts a graphical control for one or more performance indicator values, selection occurs along with rendering, which provide immediate visual feedback to a user of the GUI.

As an example, the aforementioned GUI may include slider graphics for a plurality of performance indicators. In such an example, upon adjustment of one slider graphic, the aforementioned method may automatically adjust one or more of the other slider graphics and/or may automatically render a selected trajectory to a display where, for example, the selected trajectory is a best matching trajectory of a set of trajectories to the one or more performance indicator values (see, e.g., examples of FIGS. 20 and 21).

As an example, as to status, a performance indicator may be in a locked state or an unlocked state. When in a locked state, a value of that performance indicator may be fixed (i.e., locked); whereas, when in an unlocked state, a value of that performance indicator may change in response to an adjustment in a value of another performance indicator for the individual candidate trajectory.

As an example, a method may be implemented in a manner that allows a user to interact with a computing system to investigate one or more adjustments to a trajectory that is under design, which may be via one or more adjustments to one or more performance indicators associated with that trajectory, which can be a trajectory that can be represented by one or more associated candidate trajectories. Such an investigation can include automatically changing one or more performance indicator values responsive to one or more adjustments.

As an example, the method 1000 of FIG. 10 can further include a selection block for selecting one of the individual candidate trajectories for inclusion in a well plan such as a digital well plan. In such an example, the method 1000 can further include generating and transmitting a digital well plan via one or more interfaces (e.g., network or other interfaces). As an example, the method 1000 of FIG. 10 can further include drilling a bore in a subterranean environment at least in part according to a trajectory, which may be an adjusted trajectory (e.g., per adjustment of one or more performance indicator values).

The example method 1000 of FIG. 10 may allow a user to instruct a computing system to fix one or more performance indicators such that a corresponding value or values does or do not change when another performance indicator value is adjusted. The example method 1000 of FIG. 10 may allow a user to see how one or more performance indicator values change responsive to an adjustment. In such examples, a user may tailor a trajectory that is under design according to one or more performance criteria.

As an example, a method for designing a trajectory to be drilled from a surface location to one or more targets may include defining two or more PIs relating to the trajectory, creating a set of possible trajectories from the surface location to one or more of the target(s), evaluating at least some of the possible trajectories against defined PIs, and providing a tool for a user to make a trade-off between the PIs and, for example, to select a single trajectory from the set, which may be, for example, an adjusted trajectory.

As an example, a surface location may be specified as a single point, an individual target may be specified as a single point, a surface location may be specified as an area and/or a volume and/or a target may be specified as an area and/or a volume. As an example, a target may be an intermediate target, for example, a point, an area and/or a volume that the trajectory is to pass through.

As an example, a method can include generating a set of candidate trajectories that satisfy one or more constraints. In such an example, the set of trajectories can be filtered to produce a Pareto frontier (e.g., a Pareto efficient set) prior to performing a trade-off analysis. For example, the method 1000 of FIG. 10 can include a filter block that can be utilized for generating the set of candidate trajectories. In such an example, the filter block may be part of the generation block 1020, be part of another block or may be a separate block that may optionally be selectable to filter a set of candidate trajectories.

As an example, a method can include utilization of one or more performance indicators (PIs) where a PI can include one or more of total length of a trajectory, a maximum rate of curvature (dogleg severity) of a trajectory, a depth of a kick-off point, a measure of an anti-collision risk (e.g., such as an oriented separation factor), a measure of a size of a mud-weight window, a measure of an average friction along a bore, etc.

As an example, one or more constraints can include one or more of a minimum depth of a kick-off point constraint, a maximum allowable anti-collision risk constraint, a maximum allowable rate of curvature of a trajectory constraint, a maximum allowable rate of curvature of a trajectory as a function of depth constraint, etc.

As an example, a constraint may be a physical constraint and/or a rights constraint. As an example, a physical constraint may pertain to one or more formation characteristics. As an example, a rights constraint may pertain to property and/or resource rights, which may be defined by a physical boundary or physical boundaries. For example, rights may pertain to one or more leasehold rights, one or more leaselines, etc. Such a type of constraint may be implemented as a physical boundary or physical boundaries and/or as a time factor or time factors, where a right or rights may be associated with time (e.g., consider a development time, a production time, etc.).

As an example, a method for creating a set of possible trajectories can include creating an initial set of trajectories, and then performing an iterative procedure of (i) creating new trajectories by combining the characteristics of existing trajectories in the set, (ii) creating new trajectory by modifying the characteristics of existing trajectories in the set, and (iii) removing the least fit trajectories according to a fitness criterion (e.g., an environmental fitness criterion, etc.). In such an example, a fitness criterion can be applied in a process that includes first evaluating trajectories according to a set of constraints, and then evaluating them according to a measure of how close the set of trajectories matches a Pareto frontier.

As an example, a method can include performing a trade-off analysis where the trade-off analysis includes allowing a user to specify values for one or more of PIs, and the proposed trajectory is a member of the set of trajectory that satisfies the specified PIs. In such an example, a user may repeatedly change one or more proposed values for one or more of the PIs, and after each change, a proposed trajectory that is the closest member of the set of the to the previously proposed trajectory may be one that satisfies the specified PIs.

As an example, a method can include utilizing one or more tools that allow for input that can edit a proposed trajectory. For example, consider a nudge tool that allows a user to nudge a position of at least a portion of a trajectory. As an example, another type of tool may allow a user to edit one or more pieces of equipment that are part of an assembly that is to be positioned at least in part in a bore formed according to a trajectory. As an example, a selected trajectory for use in a digital well plan may be a trajectory that has been adjusted using a tool such as a nudge tool.

The method 1000 is shown in FIG. 10 in association with various computer-readable medium (CRM) blocks 1011, 1021, 1031, 1041, 1051, 1061, 1071 and 1081. Such blocks generally include instructions suitable for execution by one or more processors (or cores) to instruct a computing device or system to perform one or more actions. While various blocks are shown, a single medium may be configured with instructions to allow for, at least in part, performance of various actions of the method 1000. As an example, a computer-readable medium (CRM) may be a computer-readable storage medium that is non-transitory and not a carrier wave.

As an example, a method can include solving a multi-objective optimization problem to generate a Pareto efficient set of candidates. Such a set of candidates may be nondominated in that individual candidates are considered, according to one or more criteria, to not include a dominant individual candidate (e.g., an optimal individual candidate). In such an example, a single solution may not exist for the multi-objective optimization problem, which may make the problem mathematically "nontrivial". For a nontrivial multi-objective optimization problem, it can be that no single solution exists that simultaneously optimizes each objective. In such an example, objective functions can be conflicting and a number of "Pareto optimal" solutions may exist. A solution may be referred to as nondominated, Pareto optimal, Pareto efficient or noninferior, where objective functions cannot be improved in value without degrading one or more other objective values.

Figure 11:
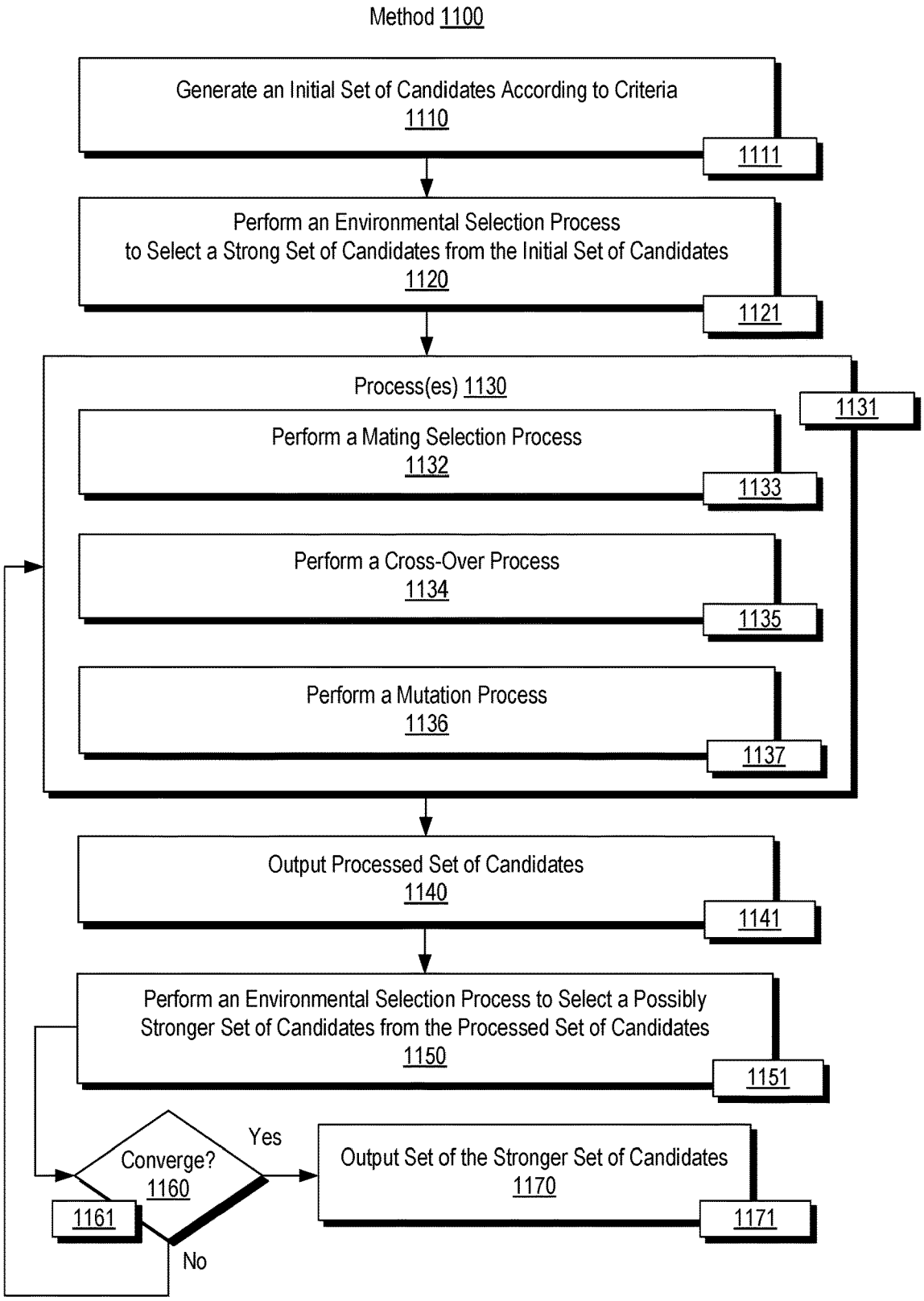
FIG. 11 illustrates an example of a method.

FIG. 11 shows an example of a method 1100 that may be utilized to generate a particular set of candidates such as a Pareto efficient set as a solution to a multi-objective optimization problem. As mentioned, such a set may be utilized as a set in the method 1000 of FIG. 10. In the example of FIG. 11, the method 1100 includes a generation block 1110 for generating an initial set of candidates according to criteria; a performance block 1120 for performing an environmental selection process to select a strong set of candidates from the initial set of candidates; a process block 1130 for performing one or more processes such as, for example, a mating selection process per a performance block 1132, a cross-over process per a performance block 1134 and/or a mutation process per a performance block 1136; an output block 1140 for outputting a processed set of candidates; a performance block 1150 for performing an environmental selection process to select a possibly stronger set of candidates from the processed set of candidates; a decision block 1160 for deciding whether convergence has been achieved with respect to the strong set of candidates and the possibly stronger set of candidates (e.g., whether the sets include same and/or similar members); and an output block 1170 for outputting the stronger set of candidates where convergence has been achieved. As shown, where convergence has not been achieved, the method 1100 may continue to the process block 1130.

As an example, the method 1100 of FIG. 11 may be considered to be an evolutionary method that operates according to multiple objectives to generate a set where members of the set can be considered for further analysis. As an example, one or more members of a set output by the method 1100 may be utilized in a method such as, for example, the method 1000 of FIG. 10. For example, the generation block 1020 of the method 1000 may optionally utilize one or more features (e.g., actions) of the method 1100 of FIG. 11. As an example, the output set of the block 1170 of FIG. 11 may be considered selected via environmental pressure and evolution. In such an example, the environmental pressure and/or evolution can be controlled via context or contexts. For example, a context can be related to development of a reservoir and/or further development of a reservoir that has already been to some extent developed. As an example, a method such as the method 1100 may optionally be performed in real-time and/or periodically during one or more field operations such as one or more field operations associated with drilling a bore in a subterranean environment.

The method 1100 is shown in FIG. 11 in association with various computer-readable medium (CRM) blocks 1111, 1121, 1131, 1133, 1135, 1137, 1141, 1151, 1161 and 1171. Such blocks generally include instructions suitable for execution by one or more processors (or cores) to instruct a computing device or system to perform one or more actions. While various blocks are shown, a single medium may be configured with instructions to allow for, at least in part, performance of various actions of the method 1100. As an example, a computer-readable medium (CRM) may be a computer-readable storage medium that is non-transitory and not a carrier wave.

As mentioned, a candidate set may be referred to as a Pareto efficient set of candidates. As an example, an evolutionary algorithm can be flexible for implementation for performing a method as to drilling well path design.

As an example, a generation block can include generating an initial population from user input well surface location and target positions, and constraints. As an example, an initial candidate set of designed trajectories may be templated, for example, in a two targets case, starting from surface, vertically down to an available kick-off point (KOP), then a curve-straight-curve to the first target, and in the end a straight line to the second target. In such an example, an individual trajectory can differ from another individual trajectory according to different parameters such as, for example, KOP depth, dogleg severity (DLS) of curves, etc.

As an example, a method can include performing an initial environmental selection where such an environmental selection aims to extract unexpected trajectories from the initial candidate set according to their "strength" to be desired to be survived. As an example, a method can include performing one or more processes such as a mating selection process, a cross-over process, a mutation process, etc., which may be considered as one or more genetic or evolutionary processes. A method can include one or more iterations as to set generation in an effort to arrive at a converged set (e.g., with particular members or members that fall within some limits that determine convergence).

As an example, one or more evolutionary processes may be utilized as part of a method that includes searching globally of the Pareto frontier from existing candidates. One or more processes may provide for a new trajectory design from interpolation, or from one or more existing trajectories, or, from moving certain parts of an existing trajectory, or increasing/decreasing values of sensitive parameters, etc.

As an example, an evolutionary algorithm may be replaced by one or more other optimizers that may provide for convergence to the Pareto frontier.

As an example, a method of designing a trajectory to be drilled from a surface location to one or more targets can include defining two or more PIs relating to the planned trajectory, creating a set of possible trajectories from the surface location to the target(s), evaluating each possible trajectory against the defined PIs, and providing a means for a user to make a trade-off between the PIs and to select a single trajectory from the set. In such an example, surface location and targets may be specified as a single point, but may also be specified as a volume, or as an area that the trajectory is to pass through. As an example, trajectories in a set can satisfy one or more constraints. As an example, a set of trajectories can be filtered to produce a Pareto frontier before a user makes a trade-off analysis. As an example, the PIs can include one or more of a total length of the trajectory, the maximum rate of curvature (dog-leg severity) of a well, the depth of a kick-off point, a measure of an anti-collision risk (such as an oriented separate factor), a measure of a size of a mud-weight window, a measure of an average friction along a borehole, etc.

As an example, constraints can include one or more of the minimum depth of a kick-off point, a maximum allowable anti-collision risk, the maximum allowable rate of curvature of the trajectory, the maximum allowable rate of curvature of the trajectory as a function of depth.

As an example, an algorithm can be part of a framework for creating a set of possible trajectories. For example, consider a method that includes creating an initial set of trajectories, and then performing an iterative procedure of creating new trajectories by combining the characteristics of existing trajectories in the set, creating new trajectory by modifying the characteristics of existing trajectories in the set, and removing the least fit trajectories according to a fitness criterion As an example, a fitness criterion can include first evaluating the trajectories according to the set of constraints, and then evaluating them according to a measure of how close the set of trajectories matches a Pareto frontier As an example, a trade-off analysis can allow a user to specify values for one or more of the PIs where a proposed trajectory is a member of the set of trajectory that satisfies the specified PIs As an example, where a user repeatedly changes proposed values for one or more of the PIs, and after each change, a proposed trajectory may be the closest member of the set of the to the previously proposed trajectory that satisfies the specified PIs. As an example, a proposed trajectory may be edited manually or otherwise (e.g., by the user, etc.).

As an example, consider the following pseudo-code for a Pareto frontier approach as based on an evolutionary algorithm:

```
Inputs: well surface location (x, y, z), target positions <list> (x, y, z),
constraints:
minKOP, minDLS, maxDLS.
Procedure CalculateParetoFrontier(representer, paretoFrontierSize)
    /* generate initial population */
    representer.setSufaceLocation;
    representer.setTargetLocation;
    /* KOP interpolation */
    for i←0, 10, do
        /* DLS interpolation */
        for j←0, 10, do
            Starting from surface location (x, y, z), vertically hold to
            KOP_i;
            A curve-straight-curve to first target, with DLS_j;
            A straight line to the second target;
            Compute trajectory;
            if compute success
              Add this trajectory to population;
            end if
        end for
    end for
    bool convergence = false;
    while (!convergence) do
    /* Environmental selection*/
    foreach (trajectory in population) do
          calculate strength based on costs such as KOP, TD, and DLS;
    end for
    Extract unexpected trajectories, population size equals to
    paretoFrontierSize;
    /* Mating selection*/
    Perform binary tournament selection in population to fill the mating
    pool.
    /* Crossover & Mutation */
    foreach (trajectory in mating pool) do
          Moving one specified station to a new point, and recompute the
trajectory based on EOU, DLS and so on;
    end for
    Add new trajectories into population;
     /* Calculate convergence */
     Calculate the hyper volume value to detect the convergence,
     convergence = hyperVolumeError(population);
     end while
     return population
end procedure
```

Various tools may be implemented to perform a method or methods, which may be in the form of a workflow or workflows. For example, a tool can be a graphical user interface (GUI) that is rendered to a display where a human input device (HID) can generate signals, instructions, etc., responsive to human input. An HID may be operatively coupled to one or more devices and/or systems. As an example, an HID may be a touchscreen, a mouse, a trackpad, a roller, a stylus, a virtual reality (VR) system, etc.

Figure 12:
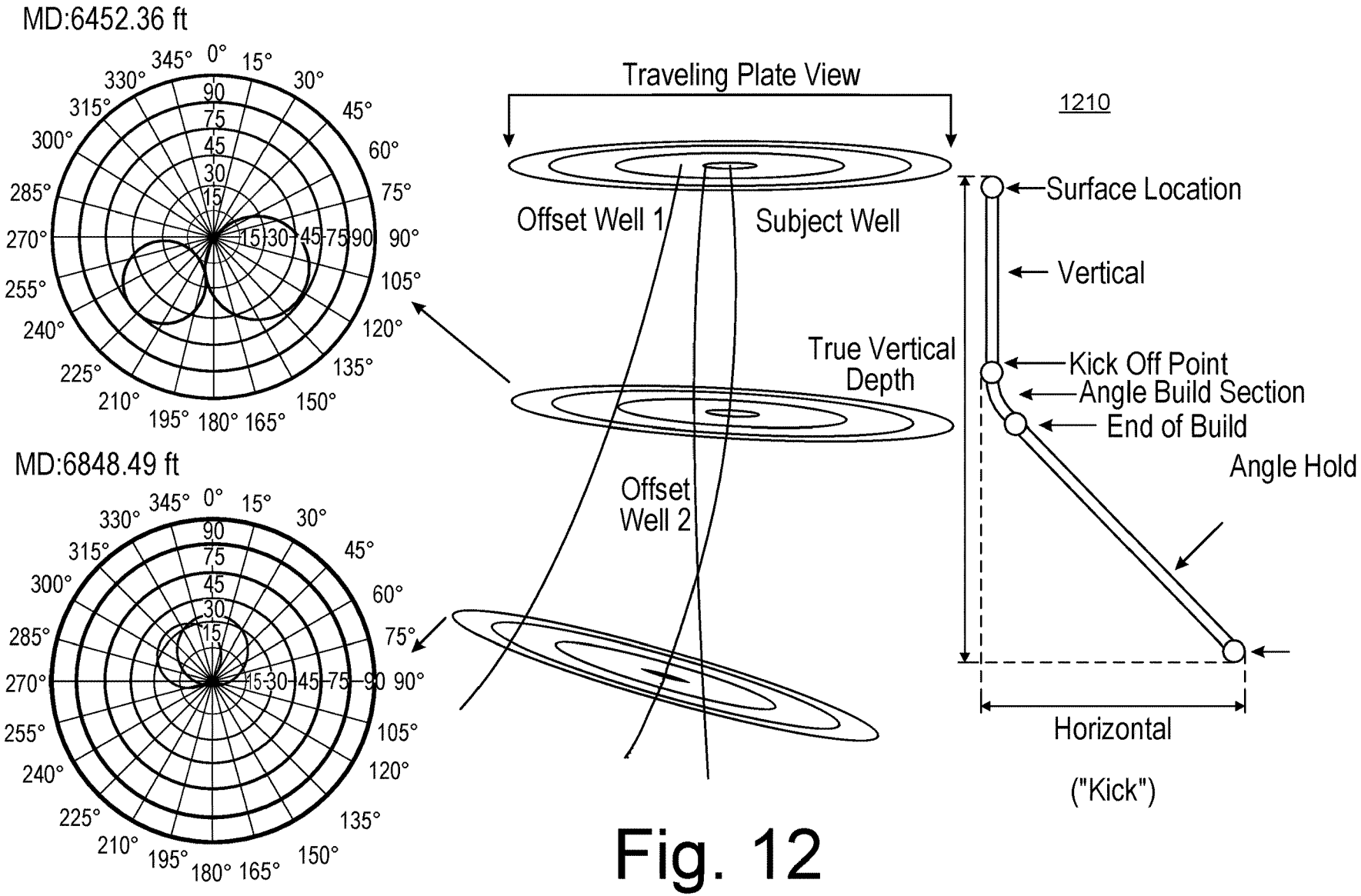
FIG. 12 illustrates an example of a graphical user interface (GUI) and an example of a graphic of a trajectory.

FIG. 12 shows an example of a graphical user interface (GUI) 1200 that may be rendered to a display as well as a graphic 1210 that illustrates various terms that may be utilized to describe a trajectory, a borehole, a well, a wellbore, etc. As an example, one or more parameters of a trajectory may correspond to one or more of the terms that are shown in the graphic 1210 (see also, e.g., the holes 272, 274, 276 and 278 of FIG. 2).

In the example of FIG. 12, the GUI 1200 can illustrate various wells such as a subject well and one or more offset wells. As shown, a traveling plate representation may be utilized for one or more of the wells. The traveling plate may be a planar representation with a boundary or circumference where a trajectory of a bore (e.g., a wellbore) may be within the boundary or circumference. As an example, a traveling plate may travel along a trajectory where the plate is a substantially planar representation that can maintain orthogonality to the trajectory, for example, a portion of the bore above and a portion of the bore below can be substantially normal to the plate (e.g., one an "upward" normal and the other a "downward" normal, which may be normal vectors).

As an example, at a particular length along a trajectory a view may be rendered such as one or more of the views to the left of the traveling plate view. In such an example, various types of information may be rendered in these views. As an example, a graphic can represent another well or graphics can represent other wells (e.g., bores or wellbores). As an example, as shown in FIG. 12, the graphics include no-go zones or no-go regions, which when circular may be referred to as no-go circles. These zones or regions can represent areas that are to be avoided by a selected subject well being planned, for example, to reduce risk of collision between trajectories.

FIG. 13 shows additional views of graphics 1310 and 1330 that may be part of a GUI or GUIs as may be associated with the GUI 1200 of FIG. 12. These graphics 1310 and 1330 show the subject well and regions associated with the offset well 1 for different distances, labeled "MD" (e.g., measured depth). As seen in FIG. 13, inclinations are rendered as in degrees where the graphic 1310 is at 6.5 degrees inclination at an MD of 6452.36 feet (e.g., 1967 m) while the graphic 1330 is at 8.5 degrees inclination at an MD of 6848.49 feet (e.g., 2087 m) further along the subject well trajectory from a surface. As an example, a field control can allow for entry of an inclination value. As an example, a direction may be rendered and/or, for example, a high side or low side indicator.

As an example, a method can include adjusting a trajectory that is, for example, a planned trajectory, which may be to be drilled or be part of a bore that is partially drilled. As an example, adjusting can include nudging. For example, a user may nudge a portion of a planned trajectory to thereby adjust the planned trajectory.

As an example, a nudge tool can be implemented using a computer, a computing system, etc. As an example, a nudge tool can include one or more associated GUIs that allow for visualization of a trajectory, for example, before, during and/or after nudging. As an example, a table view may provide points that define a trajectory such that, for example, a comparison may be made as to how nudging effects numeric values that may, at least in part, define a trajectory.

As an example, a nudge tool can be an interactive trajectory editing tool for one or more types of drilling software frameworks, packages, etc., that may find use in various industries (e.g., oil and gas, water, disposal, etc.). As an example, a nudge tool can provide a relatively intuitive way to move a planned well trajectory to a desired location on a 3D earth model, and provide a drillable well trajectory for a well planner.

As an example, a selected well or bore or wellbore may be referred to as a subject well. Such a well may be in planning and/or in execution. A subject well may be rendered to represent a way to reach one or more targets such as, for example, one or more difficult to reach, particularly in a tight anti-collision zone (multiple offset wells surrounding or near a subject well).

As an example, an offset well can be a well that has been drilled, which is in a neighborhood or vicinity to a subject well (e.g., according to a distance criterion, etc.). An offset well may affect a subject well be planned as they both occupy specific locations in a 3D earth model.

As mentioned, a method may implement a traveling plate view. A traveling plate view can be a type of a polar plot that is centered on a particular position of a subject well trajectory. As an example, a traveling plate view can be defined in a manner that can distinguish it from, for example, a traveling cylinder.

Referring again to the views in FIGS. 12 and 13, these views can include an intersection plane of the offset wells with the no-go circles (e.g., without including no-go circles projected from other depths).

As an example, a traveling plate view can be compatible with a traveling cylinder plot.

As to no-go circles, one or more no-go circles can be displayed on a traveling plate view to indicate one or more risky positions and areas associated with one or more offset wells (e.g., no-go circles from the offset wells).

Again, referring to FIG. 12, a reference (angle zero) of a polar plot can be set, for example, as high side or north reference of local coordinates, which may be switched via a pre-defined INC angle that a user may input for a traveling plate view.

As an example, consider a switch mechanism as follows: show the North reference for the polar plot if the trajectory INC<=the defined switch angle; and show the High side reference for the polar plot if the trajectory INC>the defined switch angle.

As an example, a parameter of a trajectory may be referred to as measured depth, abbreviated MD. As an example, measure depth can be a length of a wellbore. Such a measurement can differ from true vertical depth of a well (e.g., where the well is not entirely vertical). As an example, lengths of individual joints of drillpipe, drill collars and/or other drillstring elements may be measured with a tape measure and added together. As an example, length of pipe may be measured while in a derrick or laying on a pipe rack, in an untensioned, unstressed state. When pipe is screwed together and put into a wellbore, it can stretch under its own weight and that of the bottom hole assembly (BHA). Stretching of pipe may or may not be taken into account when reporting well depth. Where stretching is not accounted for, an actual wellbore can be slightly deeper than a reported depth.

Referring to FIG. 13, an example of orientation switch is illustrated in the views 1310 and 1330. For example, a user can define the switch angle as 8 degrees in the field control for the traveling plate view, where the first traveling plate of the view 1310 locates on the MD=6452.36 ft (e.g., 1967 m), the corresponding INC=6.5 degrees, which is less than 8 degrees, so that the North reference is the zero orientation of the polar plot. In the view 1330, the second traveling plate locates on the MD=6848.49 ft (e.g., 2087 m), the corresponding INC=8.5 degrees, which is greater than 8 degrees, so that the High side reference is the zero orientation of the polar plot.

As an example, a method can include automatically switching from a North reference to a High side reference based at least in part on a preset angle of inclination. As an example, a valid value range of a switch angle can be from about 0 to about 180 degrees. For example, where 180 degrees is input, the traveling plate view will show the North reference (e.g., a North reference "lock"); whereas, where 0 degrees is input, the traveling plate view will show the High side reference (e.g., a High side "lock"), except when the trajectory is vertical.

As an example, a nudge tool can provide for interactively pick a point on a trajectory, for example, to nudge the trajectory. As an example, a nudge tool can provide an interactive way to visualize a specified traveling plate view by picking a point on the trajectory, from a variety of views and plots on a GUI of a framework. Such an approach can allow a user to know a more precise positional condition in a high-risk area from a traveling plate view. Such an approach may also help a use to quickly address a point that can benefit from being nudged where, for example, the traveling plate view can provide notice as to which direction and how long of a distance to move the point or the point has been moved.

As an example, a method can include updating a traveling plate view, for example, by refreshing the view automatically to display corresponding content of a selected (picked) point.

As an example, a method can include nudging (e.g., adjusting) a point of a trajectory on a travelling plate view. As an example, a nudge tool can provide an interactive way to edit a subject well trajectory by nudging a point on the trajectory.

As an example, according to a traveling plate view of a selected point, a user can be able to more readily decide which direction and how far a distance to move one or more points.

As an example, a method can include receiving the following inputs and then triggering a recalculation for the subject well trajectory: the angle and distance referencing the traveling plate view; and the desired dogleg severity around the nudge point.

Figure 14:
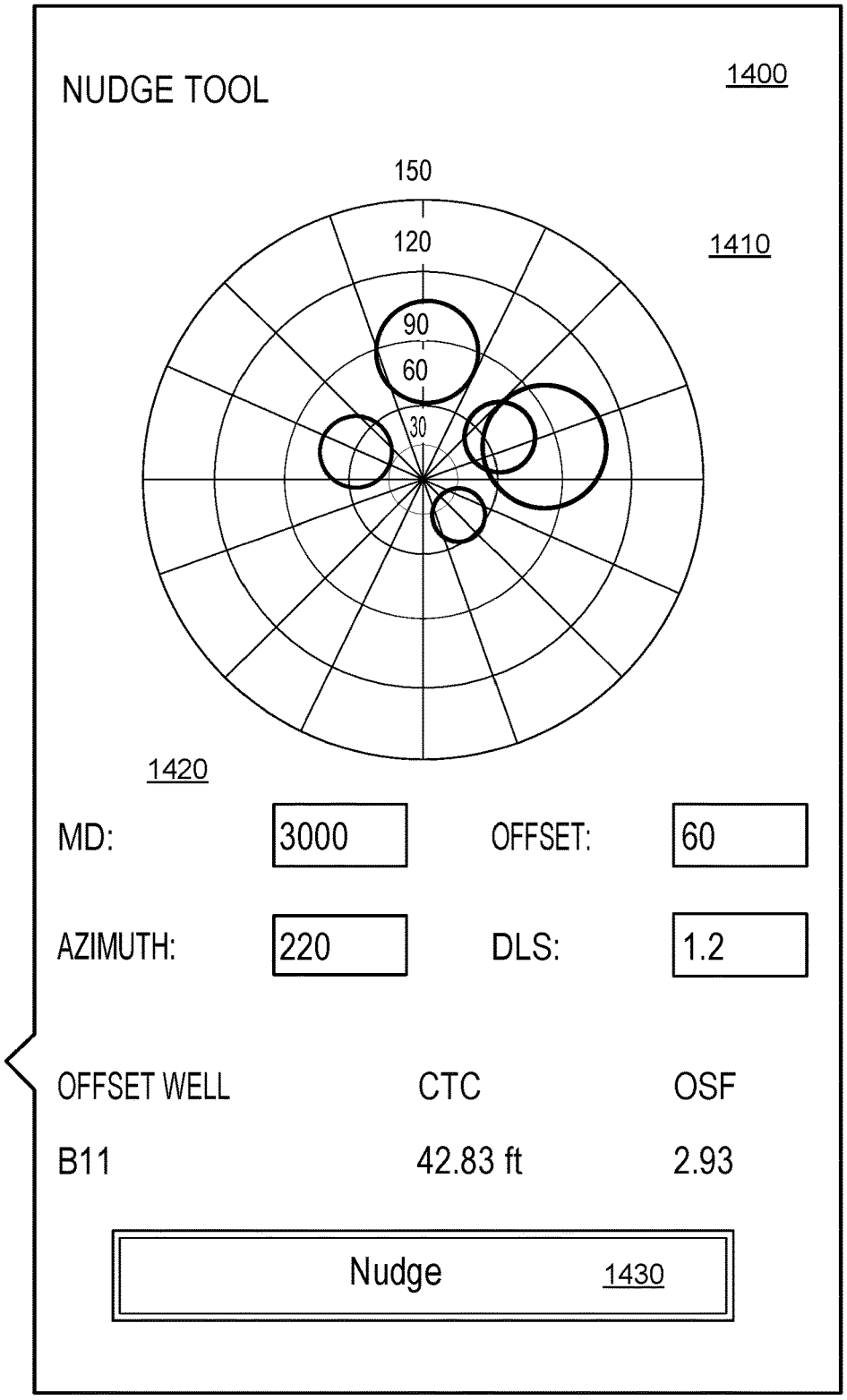
FIG. 14 illustrates an example of a GUI.
Figure 15:
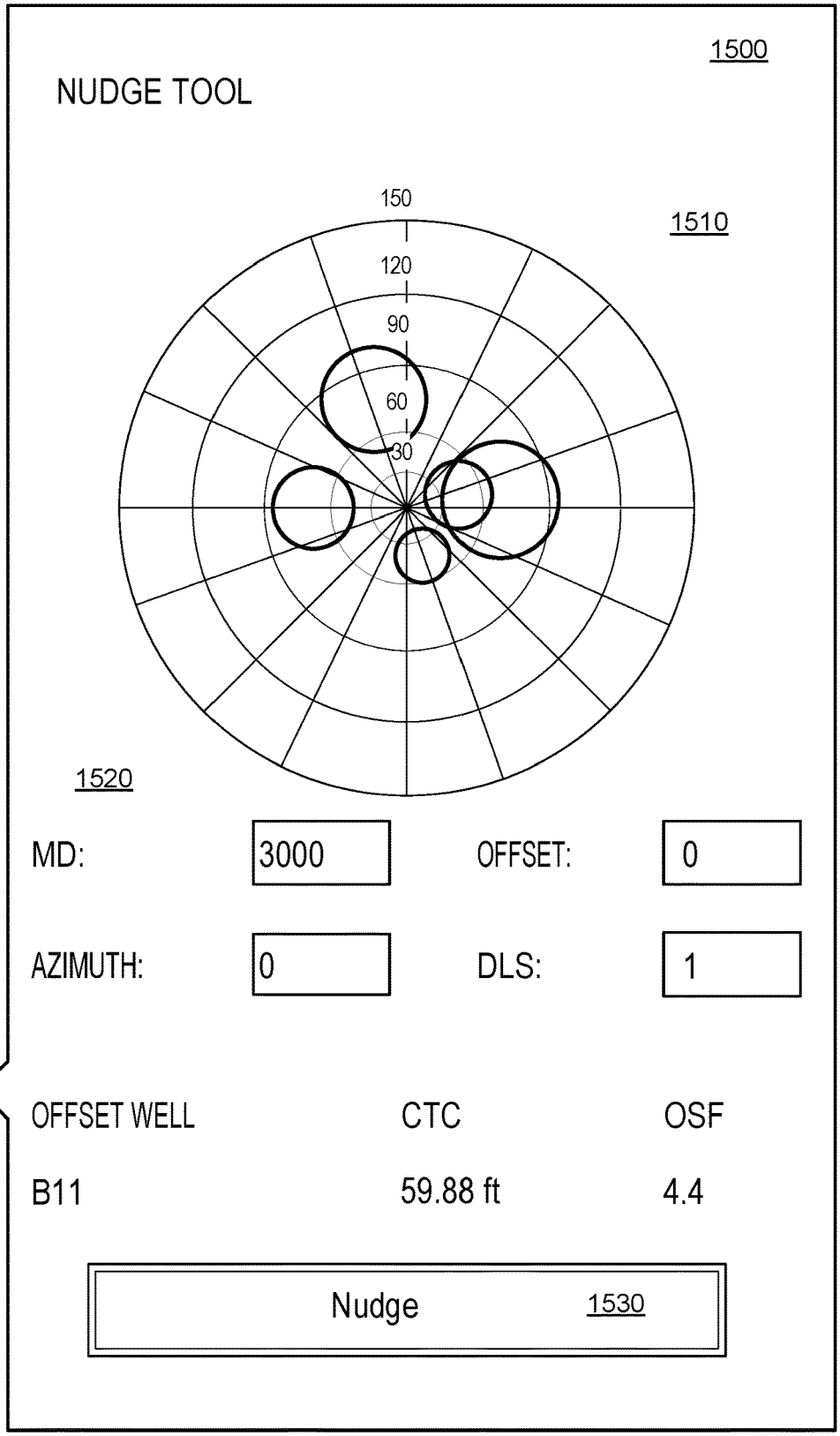
FIG. 15 illustrates an example of a GUI.

FIGS. 14 and 15 show example GUIs 1400 and 1500 of a nudge tool, as may be implemented via a planning framework, a drilling framework, etc.

As shown in FIG. 14, the GUI 1400 includes a plot 1410, a table 1420 and a nudge control button 1430. As shown in FIG. 15, the GUI 1500 includes a plot 1510, a table 1520 and a nudge control button 1530.

The GUI 1400 also shows information such as azimuth, offset and DLS (e.g., dogleg severity). Additionally, the GUI 1400 shows information such as well name (B11), CTC (e.g., 42.83 ft or 13 m) and OSF (e.g., 2.93). The GUI 1500 also shows information such as azimuth, offset and DLS (e.g., dogleg severity). Additionally, the GUI 1500 shows information such as well name (B11), CTC (e.g., 59.88 ft or 18.25 m) and OSF (e.g., 4.4).

As an example, a point on a subject well trajectory can be moved to a desired position and updated content of a design point can be displayed on a traveling plate after the trajectory is recalculated.

As an example, a nudge tool may be utilized to select a point of trajectory and to move the point along tangent of a trajectory (e.g., as defined by various other points of the trajectory). As an example, a nudge tool can allow for receipt of input to change a point perpendicularly to a travelling plate plane. As an example, a direction of movement may be specified or otherwise restricted. For example, a direction up or down may be specified by a user via an input mechanism, an input device, etc.

As an example, input may include a subject well trajectory (e.g., trajectory data), one or more targets that a well trajectory is to pass through or sufficiently close to, one or more drilling tool specifications (e.g., as to size, capabilities, operation, etc. thereof), survey program information, one or more offset wells optionally with their corresponding position uncertainties, an expected new location in a 3D earth model, one or more desired DLS constrains, etc.

As an example, output from a nudge tool can include, for example, a recalculated trajectory that may be satisfied by one or more constrains. As an example, a nudge tool can include a constraint selection feature where one or more constraints may be selected, optionally with adherence criterion or criteria. For example, a slider bar may allow for adjusting adherence to a constraint or constraints (e.g., from lax to strict).

As an example, a nudge tool may provide output in the form of a table such as, for example, a spreadsheet of points that may optionally be edited (e.g., manually, automatically, etc.). As an example, a GUI may provide a control that can trigger an anti-collision analysis (e.g., anti-collision, spatial calculations). As an example, a framework that can implement a nudge tool may include features to create a travelling cylinder plot.

As an example, a nudge tool may be rendered as a GUI that may be a pop-up GUI that overlays one or more other interfaces (e.g., one or more other GUIs, etc.). As an example, a nudge tool may provide for interactive trajectory editing, automated trajectory design, automated anti-collision analysis, automated no-go zone calculation, etc.

As an example, a workflow can include input from a user to specify a well surface and, for example, two targets, an expected location in a 3D earth model, and desired DLS. In such an example, a framework may output a recalculated trajectory, which may be output in the form of data in a table, a graphic, a table and a graphic, etc.

As an example, a trajectory calculation algorithm can aim to satisfy an expected location(s) in a 3D earth model (e.g., consider a PETREL® framework model or other model of a geologic environment). As an example, a travelling plate view may be selectable for various points of a subject well.

As an example, an interactive method of editing a trajectory to an expected location(s) in an earth model from a surface location to one or more targets can include rendering a nudge tool GUI to a display. In such an example, a method can include interactively pick a point on a subject well where automated calculations are performed and results based at least in part thereon rendered to a display or displays. In such an example, one or more no-go graphics (e.g., zones, regions, circles, etc.), which may be rendered in a travelling plate view. As an example, a method can include interactively specifying an expected location on the travelling plate view (e.g., a desired location for a portion of a subject well trajectory, etc.) and, for example, automatically, or in response to input, calculating a new trajectory (e.g., a revised or updated trajectory, etc.) from the surface location to one or more targets. Such an approach may follow a desired dogleg severity (DLS).

As an example, a dogleg may refer to a particularly crooked place in a wellbore where the trajectory of the wellbore in three-dimensional space changes relatively rapidly (e.g., with respect to distance along the trajectory). In surveying wellbore trajectories, calculation of dogleg severity may be made, for example, expressed in two-dimensional degrees per 100 feet (e.g., degrees per 30 m) of wellbore length. As an example, doglegs may give rise to a wellbore not being located in along at least a portion of a planned path (e.g., a planned trajectory) and/or a possibility that a planned casing string may not easily fit through the curved section. As an example, a dogleg may lead to repeated abrasion by a drillstring in a particular location of the dogleg, which may result in a worn spot called a keyseat, in which the bottom hole assembly components may become stuck as they are pulled through the section. As another example, casing successfully cemented through a dogleg may wear in a manner more quickly due to higher contact forces between a drillstring and the inner diameter (ID) of the casing through the dogleg. As yet another example, a relatively stiff bottom hole assembly (BHA) may not easily fit through the dogleg section drilled with a relatively limber BHA. Additionally, excessive doglegs can increase overall friction with respect to a drillstring, which can increase likelihood of getting stuck or not reaching a planned total depth.

As an example, a method can include picking a point on a subject well trajectory in a rendering of a portion of a 3D earth model that includes a representation of the trajectory. As an example, a method can include picking on a subject well trajectory in a 2D vertical section and/or a top view chart. As an example, a method can include picking a row of a trajectory spreadsheet (e.g., design point or control point). As an example, a method can include picking on the a view of proximity analysis result.

As an example, a method can include automated offset well analysis to find one or more risky offset wells. As an example, a method can include automated Anti-collision calculation and analysis. As an example, a method can include travelling plate visualization, for example, by rendering information to a display. As an example, a method can include no-go zone, region, circle, etc. visualization, for example, by rendering information to a display.

As an example, a method can include receiving input that specifies an expected location in a 3D earth model on a travelling plate view.

Figure 16:
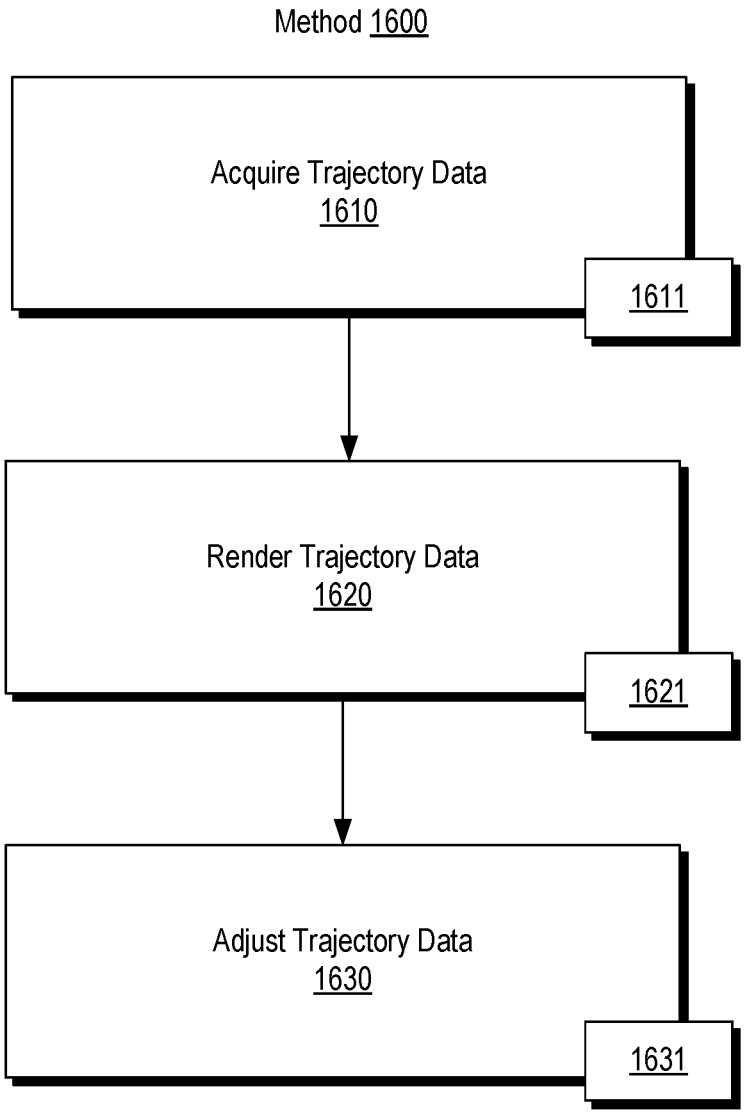
FIG. 16 illustrates an example of a method.

FIG. 16 shows an example of a method 1600 that include a reception block 1610 for receiving trajectory data, a render block 1620 for rendering trajectory data to a display along with a graphical user interface (GUI) and an adjustment block 1630 for adjusting the trajectory data, for example, to adjust a trajectory of a bore (e.g., a wellbore, etc.).

As an example, a method such as the method 1600 can include receiving trajectory data; rendering at least a portion of the trajectory data to a display as a trajectory according to a coordinate system associated with a geologic environment; selecting a point of the trajectory; and rendering a traveling plate graphic to the display for the selected point.

The method 1600 is shown in FIG. 16 in association with various computer-readable medium (CRM) blocks 1611, 1621 and 1631. Such blocks generally include instructions suitable for execution by one or more processors (or cores) to instruct a computing device or system to perform one or more actions. While various blocks are shown, a single medium may be configured with instructions to allow for, at least in part, performance of various actions of the method 1600. As an example, a computer-readable medium (CRM) may be a computer-readable storage medium that is non-transitory and not a carrier wave.

As an example, a method can include revising a trajectory (e.g., generating a new trajectory) by passing a user specified position. For example, according to a new position, a method can include identifying which section of the trajectory is to be nudged. For example, such a method can call a trajectory engine and get position, for example, using interpolation of a trajectory. As an example, consider division into three sections: KOP section, S3D section and Target section. In addition, as an example, with the nudge direction and distance, it is possible to get the new position that new trajectory is to pass (e.g., at or proximate to within an acceptable neighborhood or error).

As an example, as to trajectory profile selection and combination, based at least in part on a user's desired specification(s), a method can include selecting different profiles to replace a section to be nudged. In such an example, the profile can be made to pass through the new position (e.g., at or proximate to within an acceptable neighborhood or error). As an example, for a KOP section nudge, if the nudge direction is vertical, a method can include holding a profile to connect the new position. As an example, if the direction is not vertical, then a method may use hold, which can be the new KOP section, plus a S3D profile to the new position. Then, hold to the TVD of original KOP vertically.

As an example, for a S3D section nudge, a method can try to use a S3D profile as possible to pass through the new point (e.g., at or proximate to within an acceptable neighborhood or error). If such an approach fails, then the method may utilize a curve plus a S3D profile or, for example, a curve-hold plus a S3D profile to replace the original section.

As to a target section, as an example, a method can include using a curve plus hold profile to connect the new point and target. In such an example, a method may try to control the DLS of this section to be as small as possible (e.g., less than a limit, etc.).

As an example, for each situation, other sections may remain consistent to an original trajectory. In such an example, a method may use the same profiles and parameters to generate such one or more non-nudged sections.

As an example, a method may be implemented on a section-by-section basis. As an example, a new section or sections can be combined together to form a new trajectory (e.g., an updated or revised trajectory).

As an example, after combination of sections, a method can include calling a trajectory engine to compute a new trajectory, for example, based on minimum curvature method. For example, a minimum curvature method may aim to minimize curvature of a trajectory via point fitting, point adjustment (e.g., which may be relatively smaller compared to nudged deviations), etc.

As an example, where an engine does not adequately compute a trajectory, it may throw error message for a user or otherwise propose one or more adjustments that may allow for adequate computation of a trajectory. As an example, a GUI may render words such as "Nudging failed, your nudging point is too close to minKOP" or, for example, "Nudging failed. Please ensure the nudging point is not too far away." As an example, a user or users may adjust one or more of their inputs to trigger a new nudging calculation.

Figure 17:
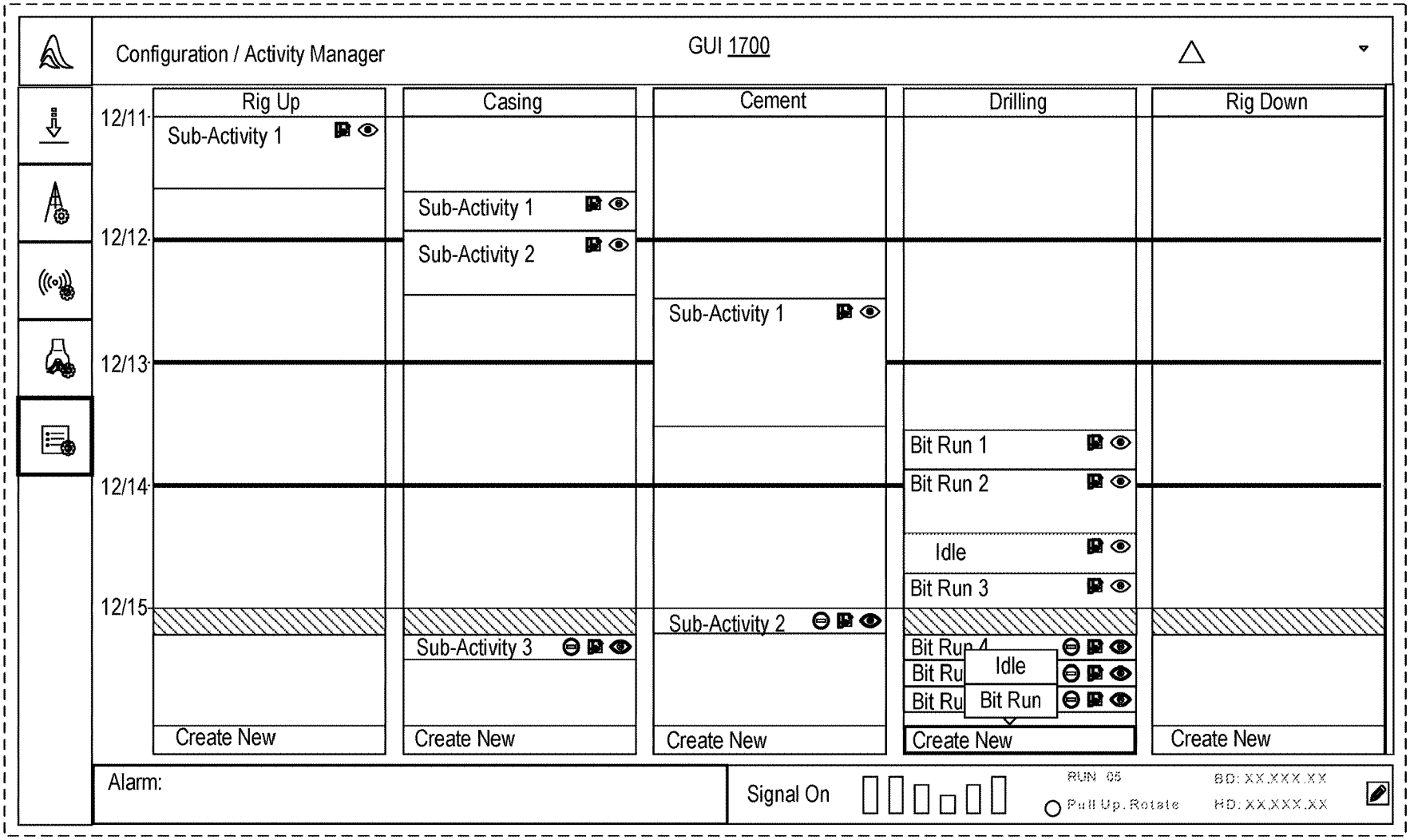
FIG. 17 illustrates an example of a GUI.

FIG. 17 shows an example of a graphical user interface (GUI) 1700 that includes various subsystem tasks as may be part of a well plan. For example, a rig up subsystem, a casing subsystem, a cement subsystem, a drilling subsystem and a rig down subsystem are illustrated as some possible examples of subsystems that can include associated tasks. As shown in the example of FIG. 17, the GUI 1700 includes a timeline, which can be incremented by minute, hour, day, etc. In the example of FIG. 17, the GUI 1700 can be render information as to scheduled tasks that are organized by subsystem type where a scheduled task may aim to achieve a desired state of wellsite equipment.

In the example of FIG. 17, the various tasks are shown as Sub-Activities and as other types of tasks (e.g., Idle, Bit Run, etc.), which may be considered to be Sub-Activities. As an example, graphical controls can allow for addition of one or more new activities (e.g., scheduling of new tasks). As an example, graphical controls can allow for rescheduling one or more tasks.

As an example, the GUI 1700 can include control graphics for options analyses as to implementation options as to one or more tasks. For example, a user may touch a touchscreen display as to the Sub-Activity 2 graphic under the Casing subsystem heading and call for selection of an implementation option.

In the example of FIG. 17, a dashed box represents a display device onto which the GUI 1700 can be rendered. For example, consider a flat panel display, which may be, for example, a touchscreen display.

As an example, one or more features illustrated in FIG. 17 may be linked to trajectory information and, for example, optionally update, revised, etc., in response to nudging of a portion of a trajectory, etc.

Figure 18:
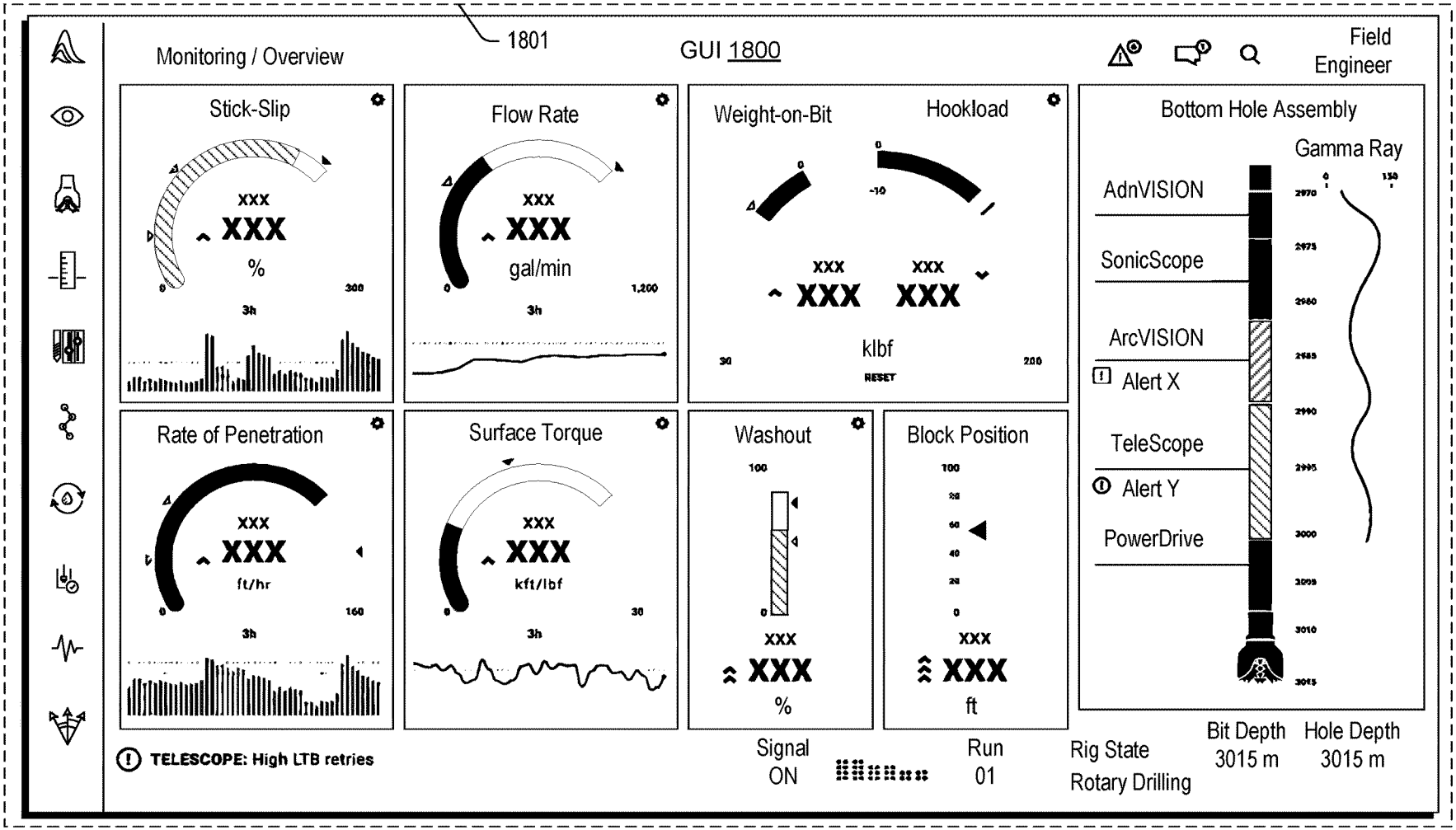
FIG. 18 illustrates an example of a GUI.

FIG. 18 shows an example of a GUI 1800 that is rendered to a display device 1801, represented by a dashed box. For example, consider a flat panel display, which may be, for example, a touchscreen display.

In the example of FIG. 18, the GUI 1800 may be an operational dashboard where the state of one or more pieces of equipment, operations, etc. may be rendered visually, for example, via graphics and/or numbers. As an example, various colors may be utilized to convey state information. As an example, audio may be associated with the GUI 1800 and changes thereto, etc. For example, where a parameter reaches a limit, a color change may occur to a graphic of the display device 1601 and an audio alarm may be rendered via one or more speakers.

As an example, information in the GUI 1800 may be transmitted to, received by, etc., a nudging system that can be utilized to nudge a trajectory of a well, etc.

As an example, a nudging system may be operatively coupled to a graphical user interface (GUI) such as, for example, the GUI 1700 of FIG. 17 and/or the GUI 1800 of FIG. 18. As an example, a nudging system may include one or more GUIs as part of a framework. As an example, such a framework may be part of and/or operatively coupled to one or more other frameworks.

FIGS. 19 to 26 shows various illustrations, which can be or include GUIs, that are utilized in a workflow or workflows.

Figure 19:
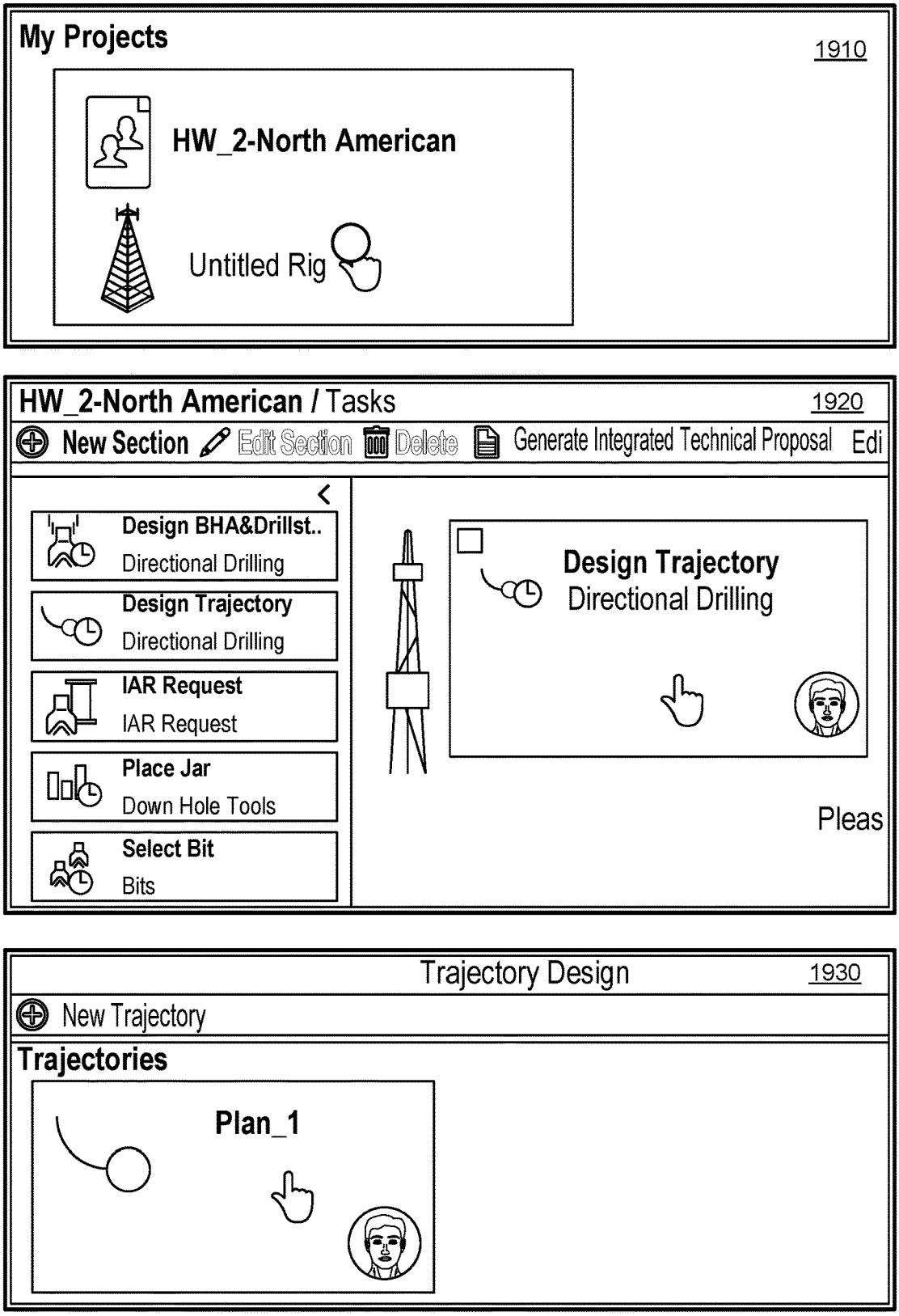
FIG. 19 illustrates examples of GUIs of an example of a workflow.

FIG. 19 shows example GUIs 1910, 1920 and 1930, which may be part of a method or a workflow where input may be received by a computing system or a portion thereof to cause a framework to render the GUI 1910, to proceed to rendering of the GUI 1920 and to proceed to rendering the GUI 1930. As shown, the GUIs 1910, 1920 and 1930 allow for selection of a plan as part of a trajectory design workflow.

Figure 20:
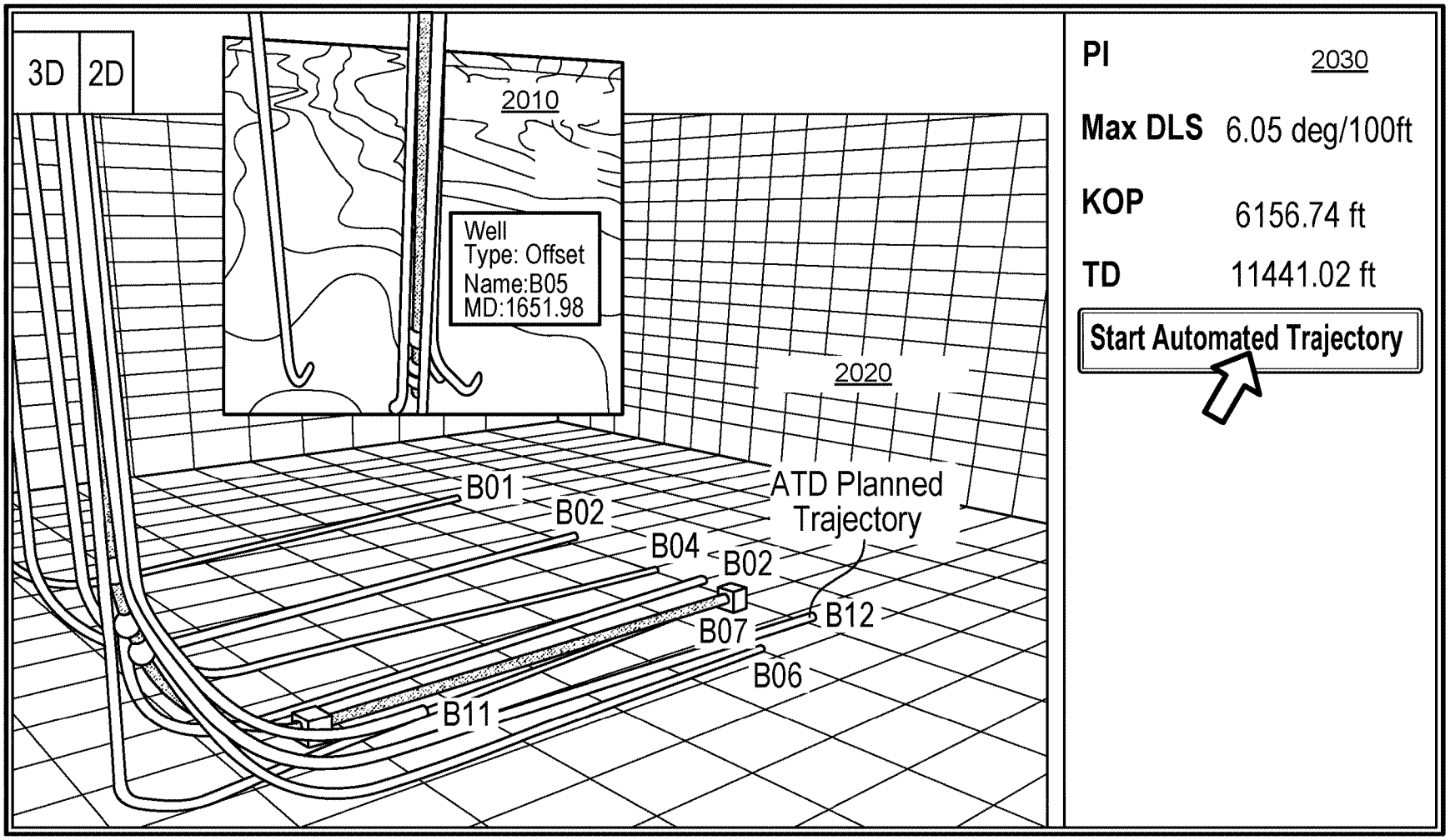
FIG. 20 illustrates examples of GUIs of an example of a workflow.

FIG. 20 shows example GUIs 2010, 2020 and 2030 that can be rendered, for example, in response to input received via the GUI 1930 of FIG. 19. In such an example, trajectories are shown where a graphic control may be actuated via input to commence an automated trajectory routine. As shown in the GUI 1930, maximum DLS, KOP and TD are specified.

Figure 21:
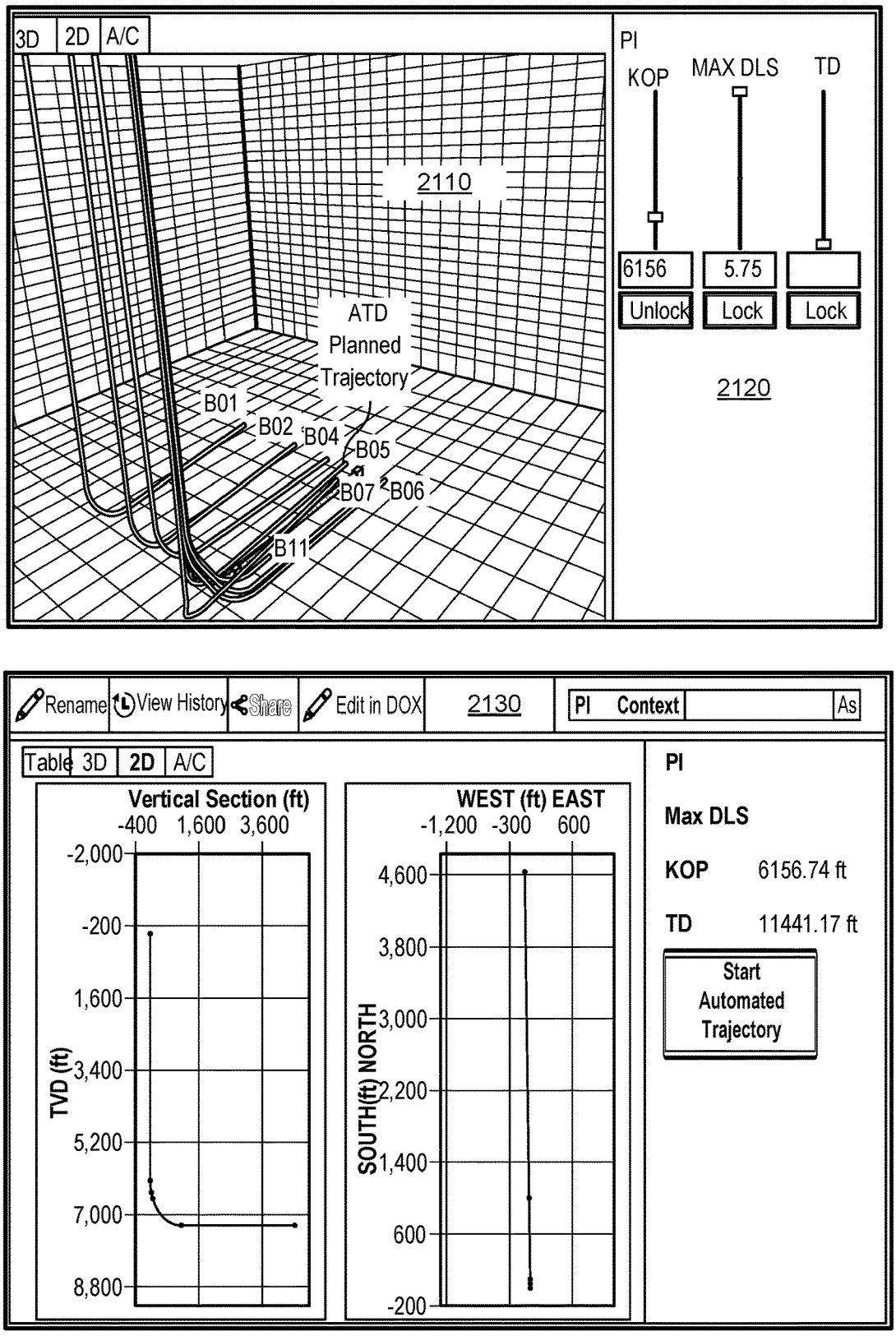
FIG. 21 illustrates examples of GUIs of an example of a workflow.

FIG. 21 shows example GUIs 2110, 2120 and 2130 where the GUI 2110 shows trajectories and where the GUI 2120 shows slider graphic controls that are adjustable, for example, to adjust KOP, maximum DLS and TD. As an example, a slider graphic control may be in a locked stated (e.g., pinned) or in an unlocked state (e.g., unpinned). As an example, such controls may be linked such that when one control is adjusted one or more of the other controls may change where, for example, the one or more others are in unlocked states. As shown, numeric values may be rendered to the GUI 2120 to provide numeric/quantitative feedback to a user. As an example, the GUI 2110 can be linked to the GUI 2120 such that a change to a slider results in a change to one or more of the trajectories in the GUI 2110.

In FIG. 21, the GUI 2130 shows planar or projected views to respective planes for a well trajectory. As an example, where a slider graphic control is provided, changes made via that control may be used to update a projected view or views.

Figure 22:
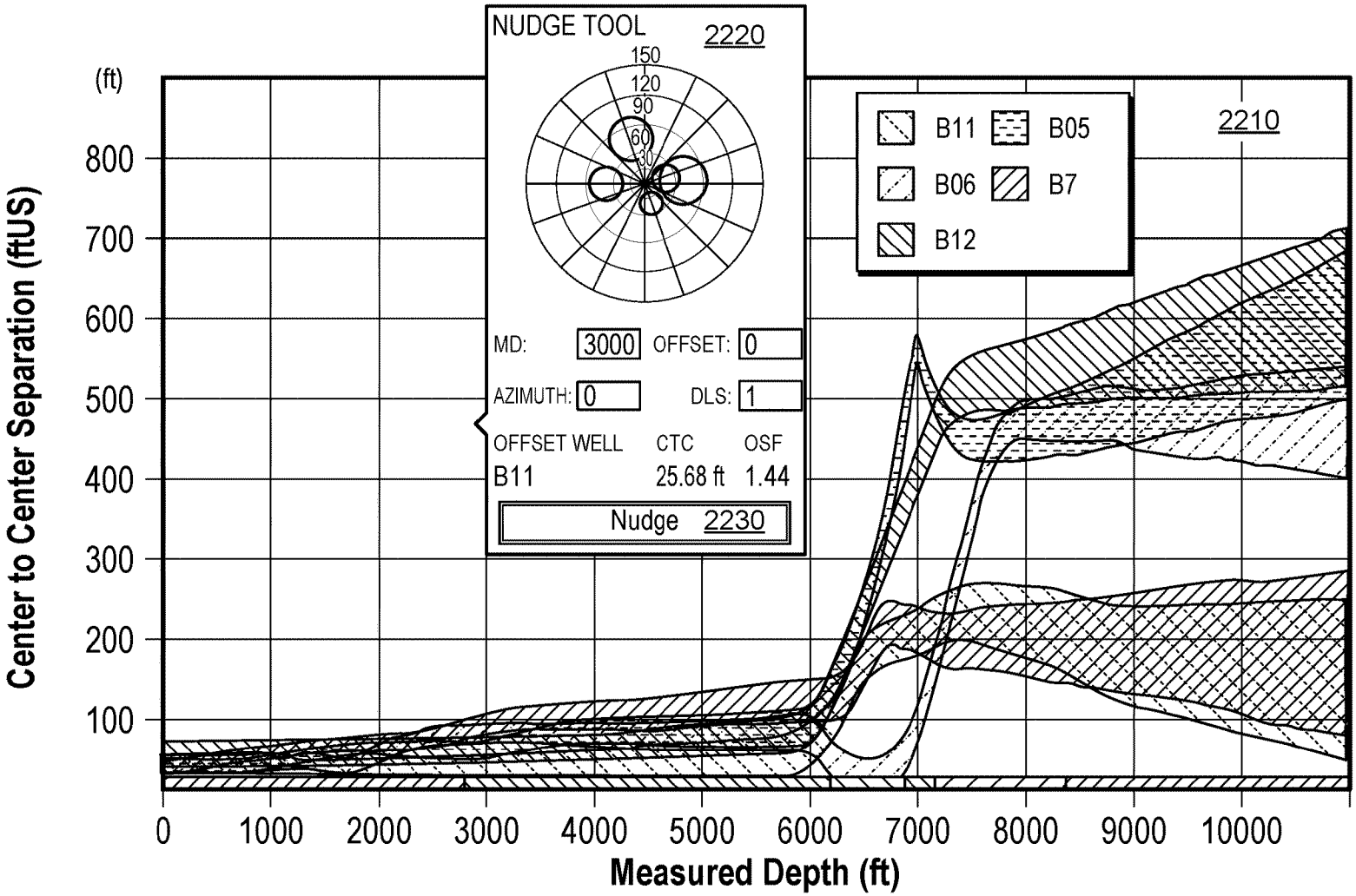
FIG. 22 illustrates examples of GUIs of an example of a workflow.
Figure 23:
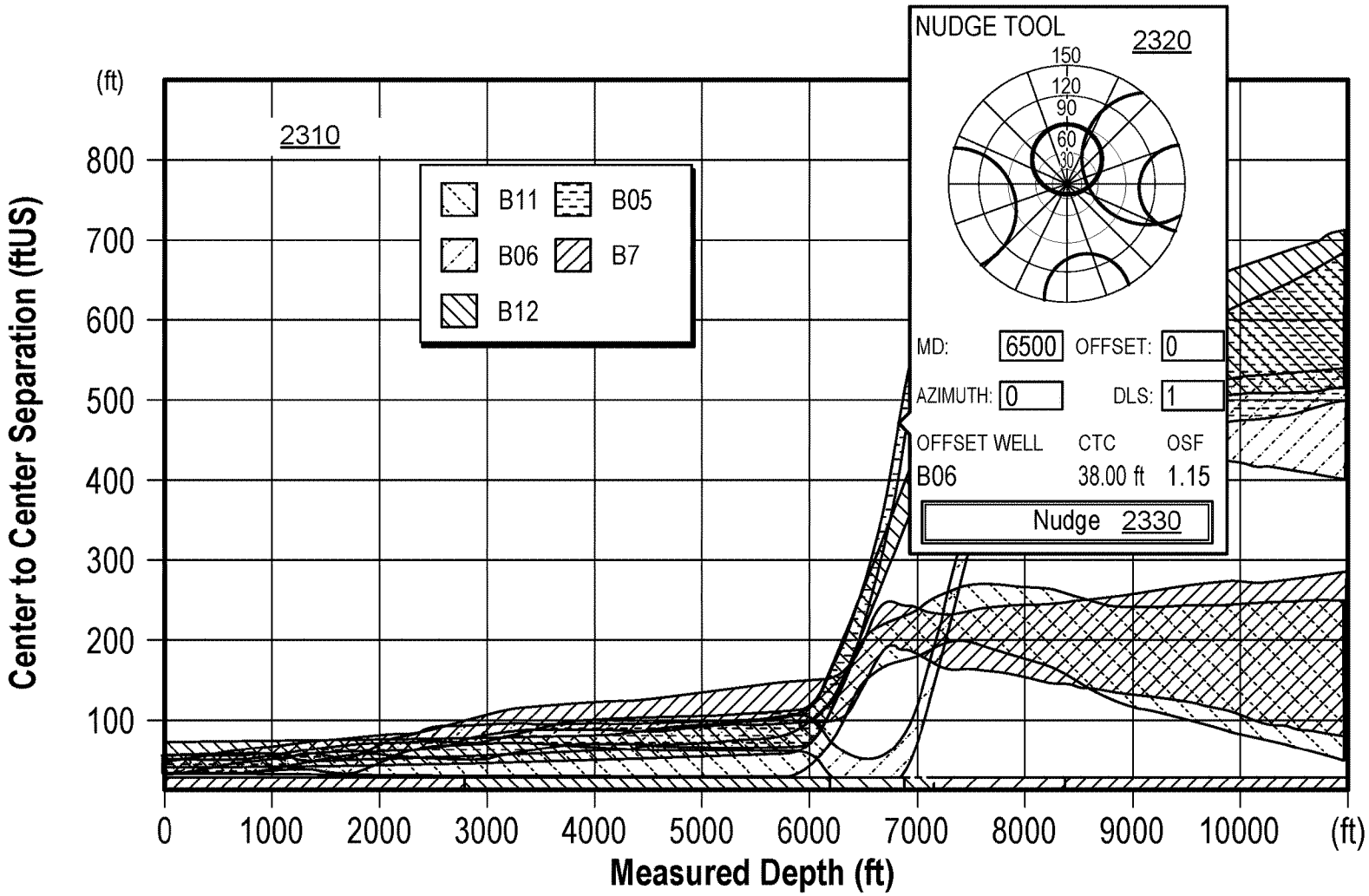
FIG. 23 illustrates examples of GUIs of an example of a workflow.
Figure 24:
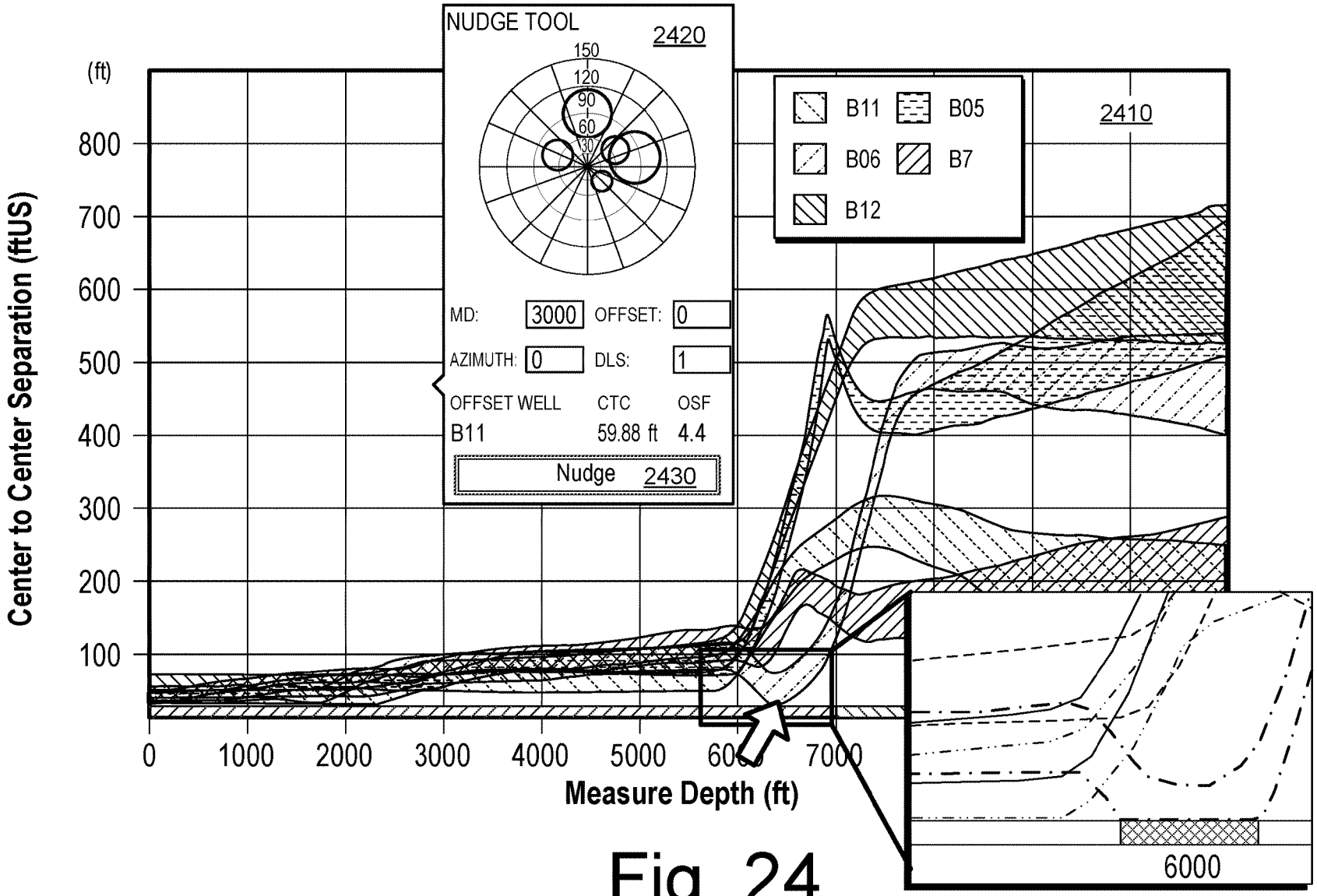
FIG. 24 illustrates examples of GUIs of an example of a workflow.

FIGS. 22, 23 and 24 are a series of GUIs that include the nudge tool GUI shown in various states 2220, 2320 and 2420, which correspond to various actions. For example, in the GUI 2210, a pointer graphic may be controlled via touch, a mouse, etc. to select a value at a measured depth for one of the named well trajectories (see names in upper left). Upon selection, the nudge tool GUI 2220 can render associated information including, for example, a traveling plate view with associated information such as no-go zones. As an example, a user may enter information to be received by a computer or computing system such that a point on a selected trajectory (e.g., subject well) is to be nudged. In such an example, a nudge graphic control button 2230 may be actuated to effectuate the nudge and, for example, calculate updated or revised points of the trajectory.

FIG. 23 shows another example where the pointer graphic is at a different location along the measured depth (MD) axis of the GUI 2310 and where the nudge tool GUI 2320 renders associated information, along with a nudge graphic control button 2330.

FIG. 24 shows an example where an update has occurred (e.g., compare GUIs 2210 and 2310 to the GUI 2410, see inset where a change has been implemented). The GUIs 2210, 2310 and 2410 may include color coding along the measured depth (MD) axis. Such coding can indicate regions that may be adjusted, for example, to reduce risks. For example, as risk is reduced, calculated values may be utilized to determine a color for a portion of a trajectory such as, for example, changing a color from red to green, red to blue, red to orange, etc. As shown, the GUI 2410 can include receiving input (e.g., via one or more human input devices (HIDs)) and rendering an enlarged graphic of a region, which may include color or other coding that highlights one or more portions of a trajectory (e.g., or trajectories) that may be nudged, etc. In such an example, the GUI 2420 may optionally change to a MD of the region to facilitate nudging, etc.

FIGS. 25 and 26 show examples of GUIs 2510 and 2610, which are shown as tables of data where, for example, the GUI 2510 may be for a before scenario and the GUI 2610 may be for an after scenario (e.g., after nudging). As an example, the values (e.g., data) in the GUIs 2510 and 2610 may be selectable and editable.

Figure 28:
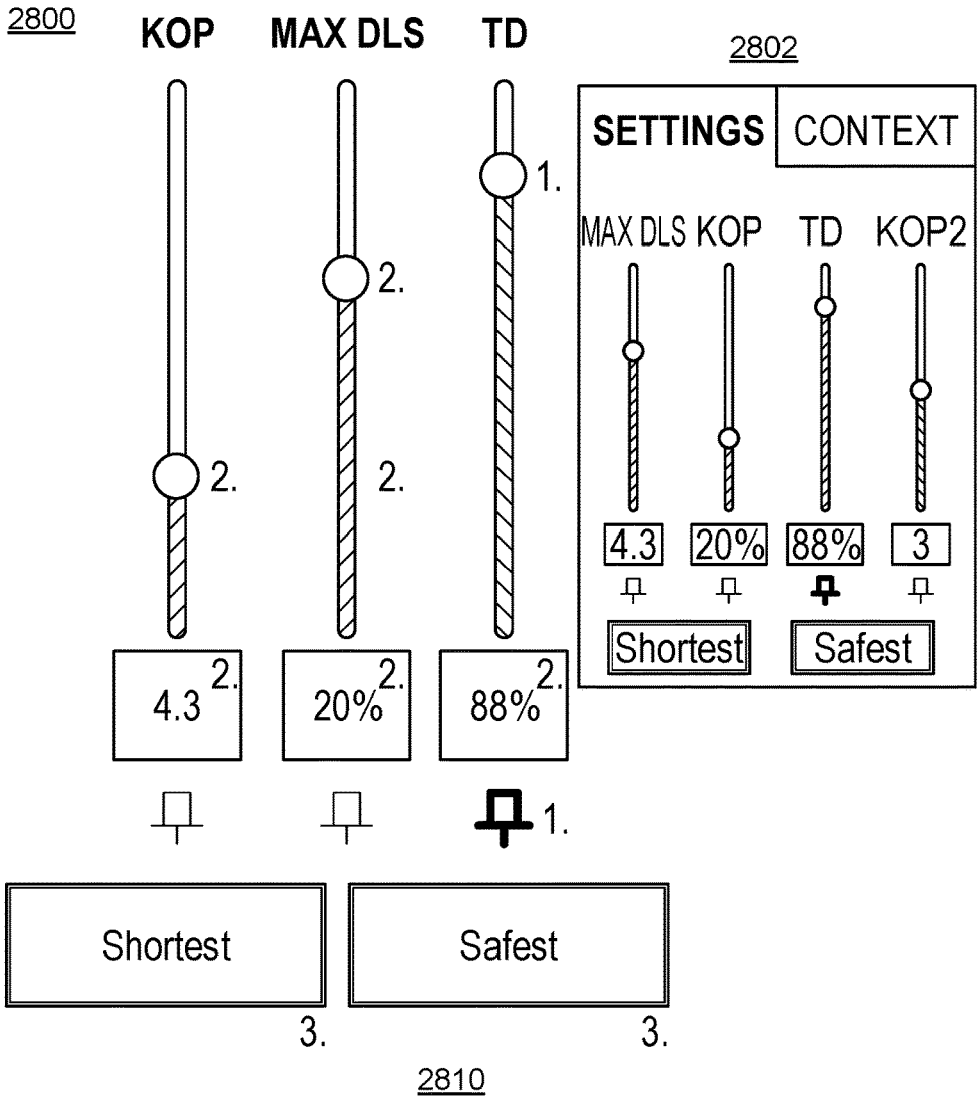
FIG. 28 illustrates an example of a GUI.

FIGS. 27 and 28 show example GUIs 2710, 2720 and 2800, which can correspond to the GUI 2720. FIG. 28 also shows an example GUI 2802, which includes slider graphic controls for maximum DLS, KOP, TD and KOP2.

As shown, the slider graphic controls, which may be implemented via one or more other types of graphics (e.g., dials, etc.), correspond to values, which may be numeric, percent, etc. As an example, a slider may be color coded. For example, a pinned or locked slider may be black or gray and an unpinned slider or unlocked slider may be a color such as, for example, blue. As an example, a pin graphic may be actuatable to cause locking or pinning and/or unlocking or unpinning of a graphic control (e.g., a slider, a wheel, etc.). In the slider example, relative changes may be discerned visually by location of sliders (e.g., circles or slider bars that may be moved up or down).

As an example, a wellbore trajectory can be a geometric trace that connects a well surface and one or more drilling targets. As an example, when a wellbore trajectory is designed by a drilling engineer, various rules (e.g., or Performance Indexes, abbreviated PIs) that a trajectory may expect to follow, for example, its kickoff point is to be below the mudline, it is not to have a collision issue with another existing well or wells, and its dogleg severity (DLS) is to be within the ability that drilling tools can turn, etc.

In the example of FIG. 28, a method can be performed, for example, according to the example method 2810 where, for example, (1) when the pushpin icon is activated, the slider locks its position, (2) where changing of values occurs, such a change can change one or more slider positions (e.g., optionally linked to state such as being locked or unlocked, pinned or unpinned, etc.) where changing one or more slider positions can change one or more underlying value or values, and (3) where selecting one of the buttons (e.g., shortest or safest), a framework can automatically change values and slider positions (e.g., optionally linked to state, etc.). In such an example, one or more graphic control buttons, etc., may be rendered to a display, for example, to explore one or more options. As an example, a GUI may render a view of a trajectory or trajectories to a display such as a 3D type of rendering in a coordinate system of a 3D earth model.

As an example, the GUI 2720 and/or the GUI 2800 may be operatively coupled to an automated design framework for a borehole trajectory. As an example, a set of trajectories may be automatically generated that aim to meet particular criteria. Such an approach can be accomplished via modeling as a multi-objective optimization problem. For example, performance indicators (PIs) can be put into cost functions and rules into constraints.

FIGS. 29 to 35 provide various examples of processes and tools that can be utilized for planning one or more trajectory. Such examples may utilize a method or part of a method as in FIG. 10 and/or FIG. 11.

Figure 29:
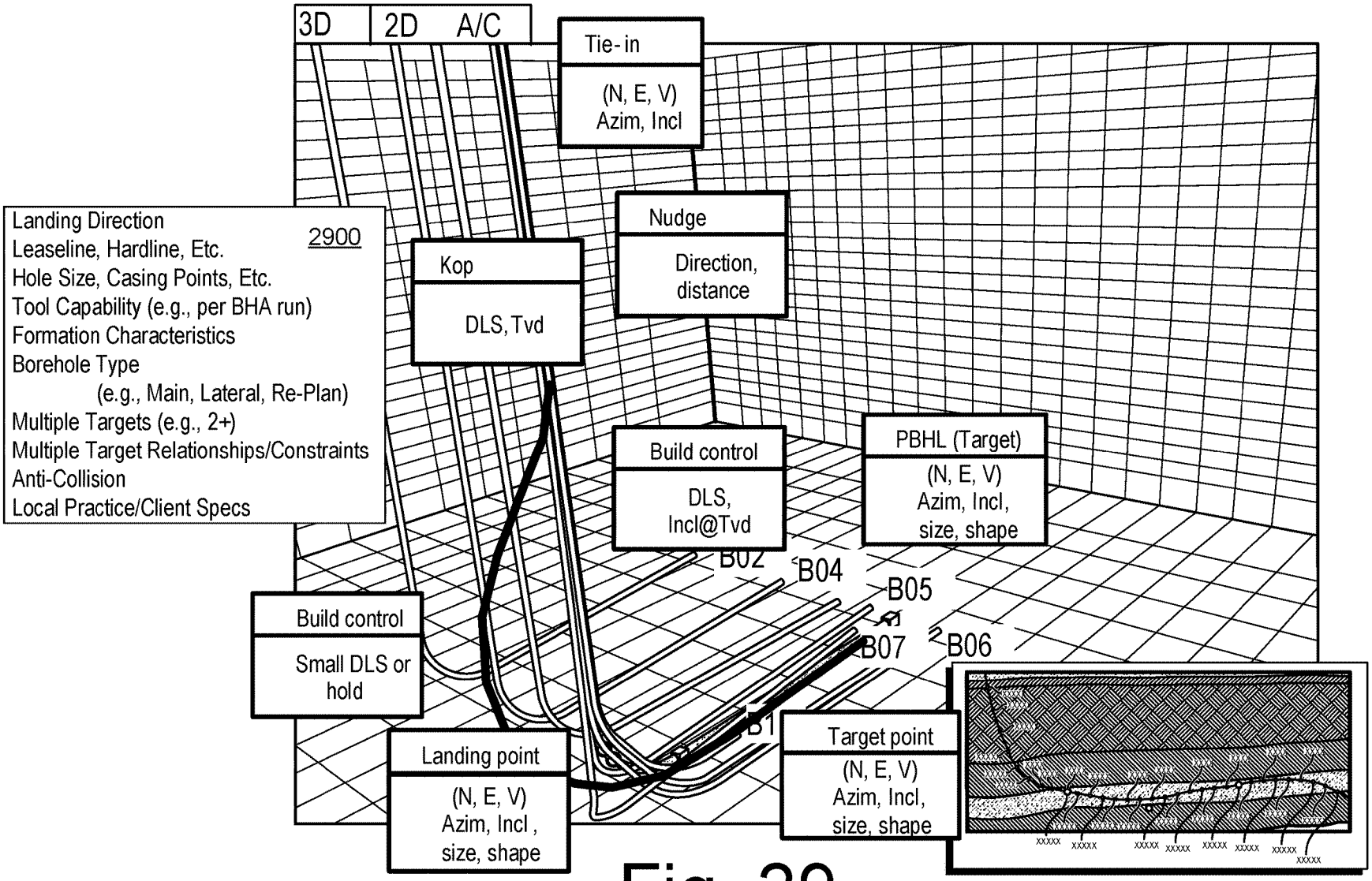
FIG. 29 illustrates an example of a GUI.

FIG. 29 shows an example of a graphical user interface (GUI) 2900 that includes a graphic of an environment that includes one or more wells along with associated factors germane to trajectory design. For example, the factors in the example of FIG. 29 include a tie-in factor, a KOP factor, a nudge factor, various build control factors, a landing point factor, a target point factor and a predicted bottom hole location (PBHL) target factor.

As an example, various constraints may be imposed on a method that can design one or more trajectories. For example, consider one or more of the following types of constraints: a landing direction constraint, a leadline constraint, a hardline constraint, a hole size constraint, a casing point constraint, a tool capability of a BHA constraint, a formation characteristic constraint, a bore type constraint, a number of targets constraint, a type of targets constraint, an anti-collision constraint, etc.

As to a bore constraint, consider one or more of a main bore constraint, a lateral bore constraint, and a re-planning bore constraint. As to multiple targets, one or more particular constrains may consider a relationship or relationships between the targets. As an example, a constraint may be imposed as to one or more local practices and/or client preferences.

FIG. 30 shows an example of a multi-objective optimization scheme 3000 that includes a trajectory graphic, a plan graphic and an optimization graphic, which may optionally be graphics of one or more graphical user interfaces (GUIs). As shown in FIG. 30, the plan can include various segments such as a starting segment, a build segment and a target segment. The trajectory graphic includes a visual presentation in two-dimensions of a multi-segment trajectory with various factors identified with respect to position (e.g., in 2D and/or 3D). Such factors may be utilized within a multi-objective optimization problem that aims to generate a trajectory, which may be a trajectory selected from a set of candidate trajectories (e.g., a Pareto efficient set, etc.).

As an example, constraints from user or other input can be translated as a sequence of several control points, which contain the geometric parameters as constraints. As an example, an automated trajectory design (ATD) engine can be a computerized engine that can read geometric constraints and output one or multiple optimal candidate trajectories.

As an example, geometric parameters can include one or more of NS, EW, Tvd, DLS (Curvature), Inclination, and Azimuth. As an example, an optimal solution may be calculated based on the constraints defined by one or more control points, As more complex constraints are imposed, a method may organize them in a hierarchy. For example, one or more constraints may be local (e.g., affect a part of a trajectory), one or more may be relatively local, which affect two adjacent parts of a trajectory, one or more may be relatively global, which may affect more parts of one or more trajectories. As an example, a hierarchy can include layers where a trajectory design may be determined by parts associated with layers.

Figure 31:
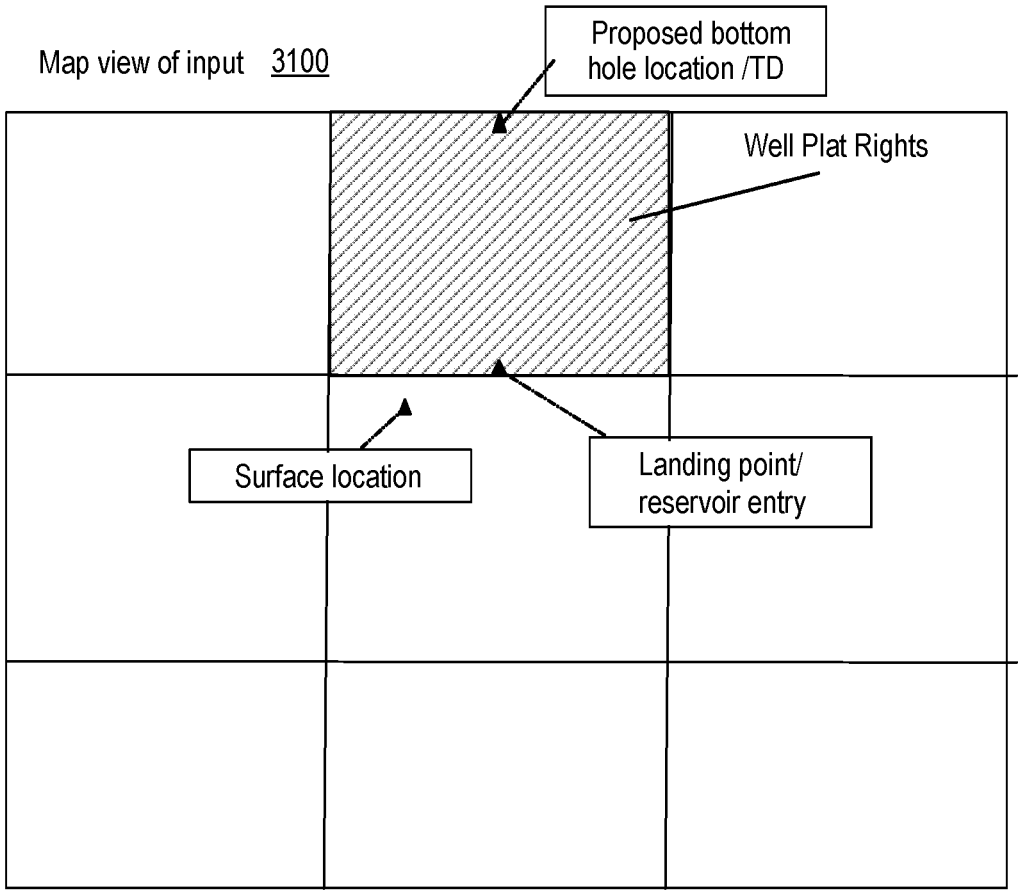
FIG. 31 illustrates an example of a GUI.

FIG. 31 shows an example of a graphic of a map view of input 3100, which may be part of a GUI. In the example of FIG. 31, a grid is present that includes various information such as a surface location, a landing point/reservoir entry location, a proposed bottom hole (e.g., total depth) location and a region in which ownership/permission for drilling is permitted.

Figure 32:
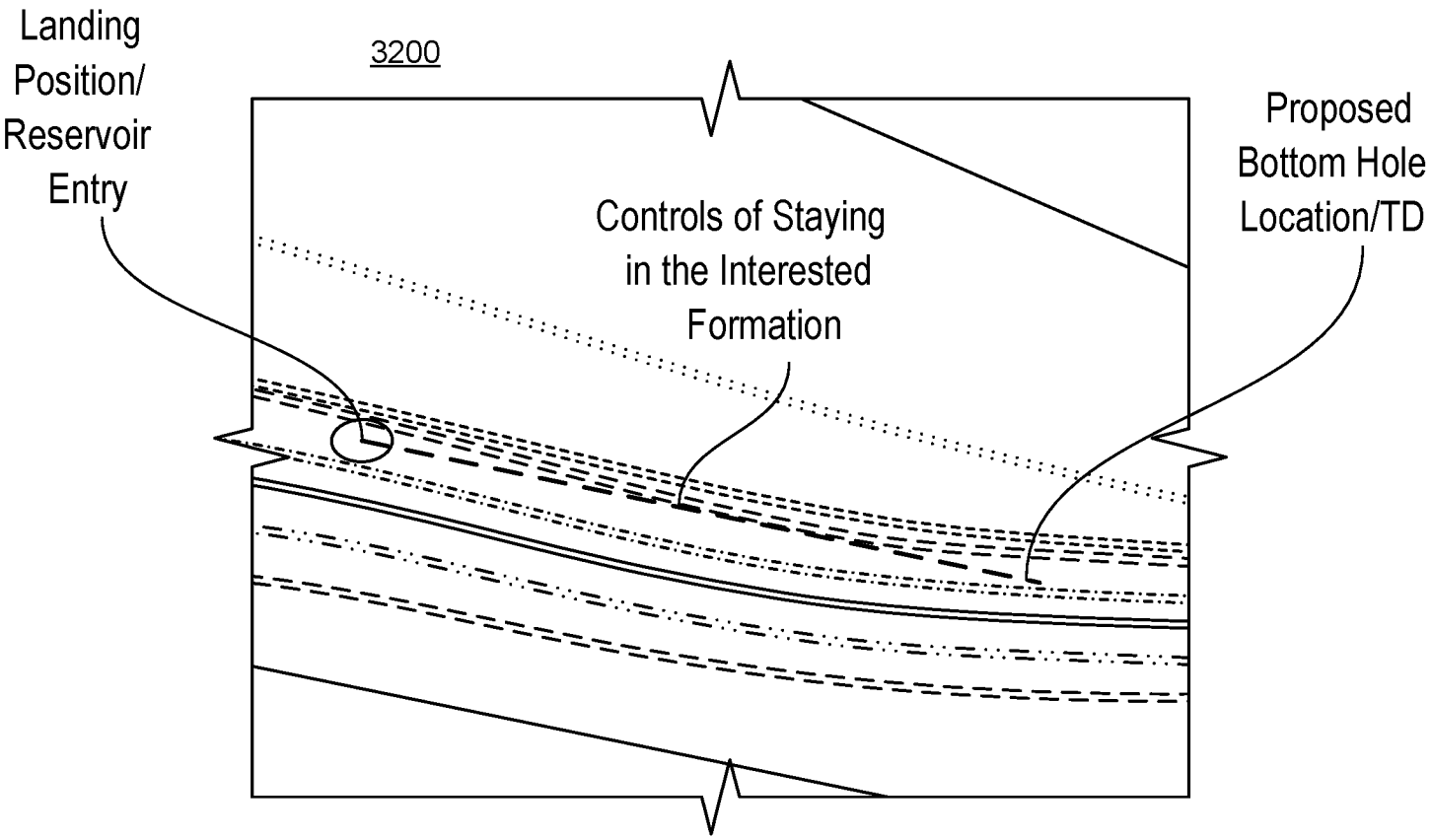
FIG. 32 illustrates an example of a GUI.

FIG. 32 shows an example of a graphic of a vertical view of input 3200, which may be part of a GUI. In the example of FIG. 32, layers of earth are illustrated along with a landing position/reservoir entry location, a proposed bottom hole location (e.g., a total depth location), and various controls of styling in a formation of interest. As an example, a GUI may provide for views as in FIGS. 29, 30, 31 and/or 32 during execution of a method that can design one or more trajectories.

Figure 33:
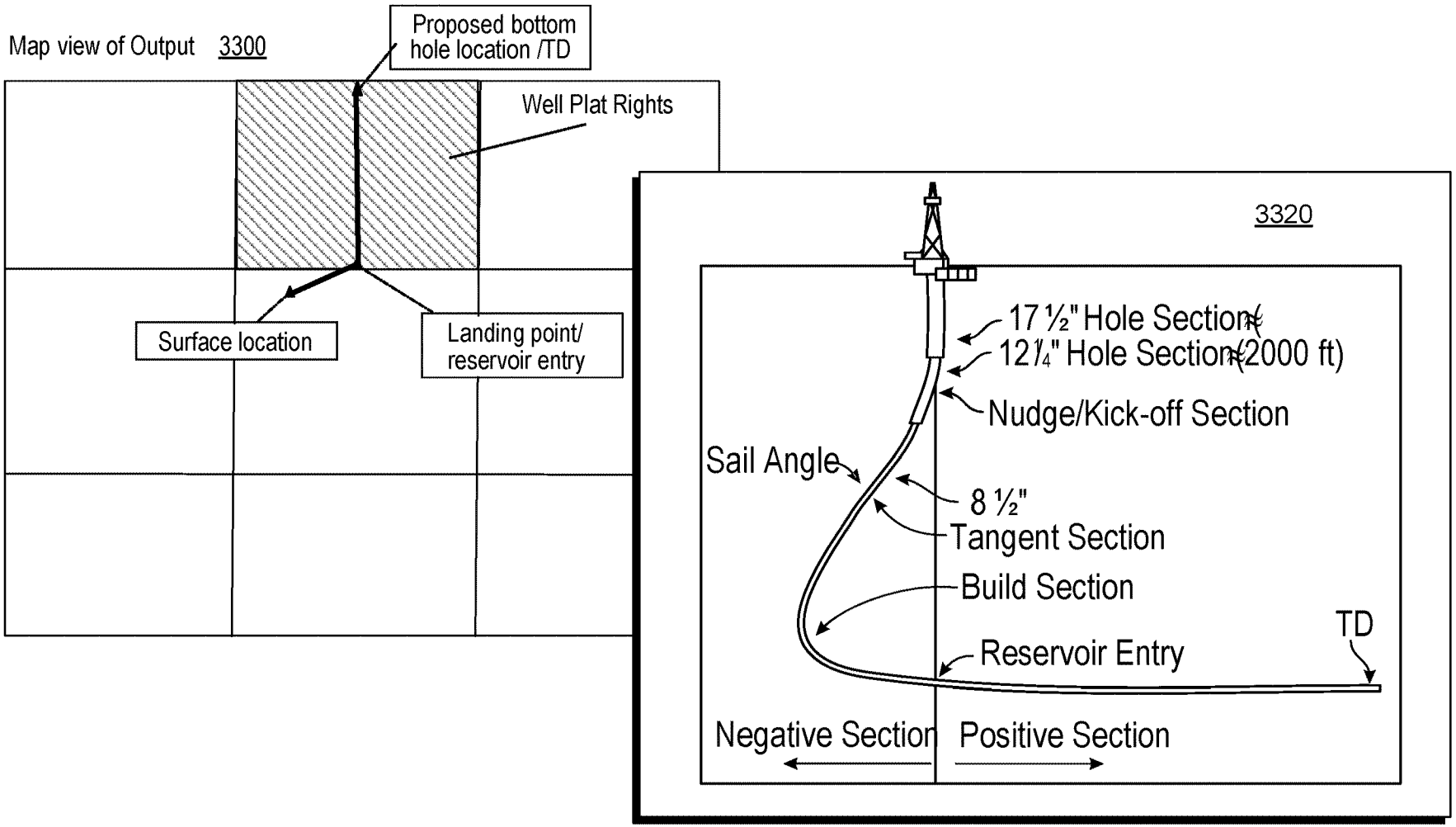
FIG. 33 illustrates examples of GUIs.

FIG. 33 shows an example of a graphic of a map view of output 3300 along with a vertical (e.g., cross-sectional) view 3320. In the example of FIG. 33, a user may implement a nudge tool, for example, to nudge a portion of the trajectory before entering the reservoir. Such a nudge may be for purposes of maximizing the stay in a desired reservoir zone (e.g., to maximize contact between a well drilled according to the trajectory and reservoir rock). Such a nudge may not be because of an anti-collision issue, though, where one or more additional trajectories are to be drilled, an anti-collision algorithm may place one or more limits on a nudge and/or on one or more trajectories to be planned (e.g., or planned and limited in their modification to avoid collision).

FIG. 34 shows an example of a table 3400 of information. In a non-assisted approach, a well designer can manually input parameters in various fields of the table 3400 to manually iterate to seek converge to the values that appear in black circles and boxes. Such an approach may be based on an individual's knowledge and experiences (e.g., as she may have drafted shapes and parameters).

FIG. 35 shows an example of a GUI 3500 and an example of a GUI 3520. In these examples, the GUIs 3500 and 3520 may be part of a workflow that includes one or more automated process. For example, an automated process may be exposed at least in part to a user via rendering of one or more GUIs to a display or displays. In such an example, a user may input directly what they know about a trajectory (e.g., rather than creating a table manually).

Figure 36:
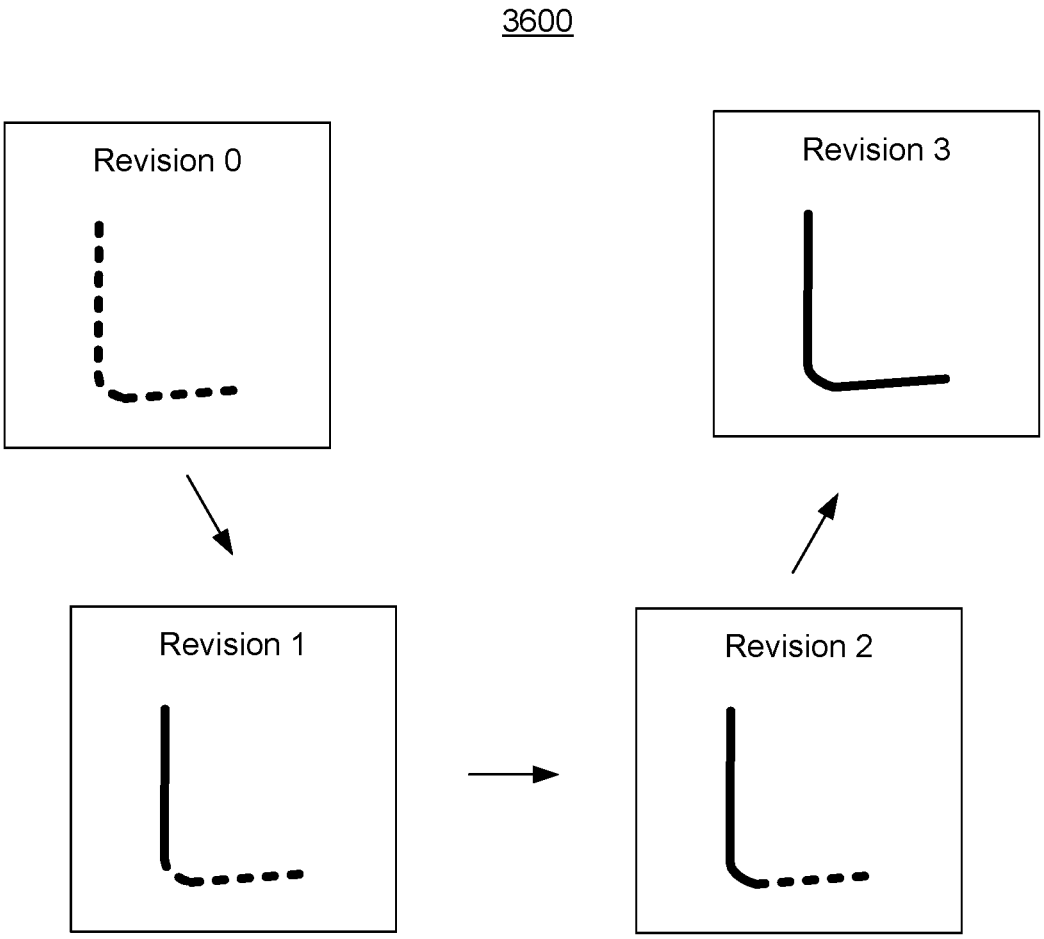
FIG. 36 illustrates an example of a scenario.

FIG. 36 shows an example of a revision process 3600. In the example of FIG. 36, parts of trajectories that are in blue are the planned parts, orange parts are the actual drilled trajectories according to the initial plans. Re-plans are made during the drilling operation, for one or more of various reasons. For example, consider a scenario where one or more actual trajectories tend to deviate substantially from a plan or plans or, for example, one or more geological features (e.g., fractures, faults, geobodies, etc.) may be found.

As an example, a Pareto frontier approach may be utilized, for example, as to designed trajectories candidates (see, e.g., the method 1100 of FIG. 11, which may be part of a method such as the method 1000 of FIG. 10). For example, a planning objective can be to design a well trajectory that is drillable and with its PIs deemed to be best possible, in other words, a planned trajectory can be drilled with lowest costs and risks. As an example, an assumption may be made that for various scenarios, a best trajectory (e.g., a top ranked candidate) is not necessarily discernable but rather various candidates may be suitable (e.g., also consider PIs that may contradict each other). As an example, less DLS and less total depth can be desired PIs, however, less DLS may result in a greater total depth. In such a situation, a determination as to which set of DLS and total depth is the best may be problematic; rather, an analysis may consider sets of possible parameter values where those sets include a plurality of suitable sets of parameter values. As an example, where a trajectory corresponds to each set, a set of trajectories can represent the sets of possible parameter values.

As an example, a Pareto frontier can be defined to be the set of trajectories whose PIs are not "worse" than others in the same set. Such an approach can be used to make focused tradeoffs within a constrained set of designs, which may be accomplished without considering full ranges of designs.

As an example, an automated trajectory design framework may include a solver for a multi-objective problem, which can try to find its Pareto frontier using optimizers (e.g., one or more evolutionary algorithms). As an example, an evolutionary algorithm can be capable of domain based crossover, mutation, and/or mating processes to ensure that an optimization search is global and more practical.

As an example, a workflow can include a traveling plate approach and a Pareto frontier approach to adjusting one or more trajectories.

As an example, parameters may be denoted that decide and represent a trajectory plan as a vector X, e.g., one vector X defines a trajectory plan, and vice versa.

For a trajectory X, an individual PI can be cast as a cost function of $f_i(X)$ (i=1, . . . , k). For example, one PI can be the maximum DLS of a trajectory, or its KOP (kick off point) depth, or its total depth, etc.

$$Z = F(X) = \begin{pmatrix} \max(\min) f_1(X) \\ \max(\min) f_2(X) \\ \vdots \\ \max(\min) f_k(X) \end{pmatrix}.$$

As an example, rules that a planned trajectory are to follow can be cast as constraints. One constraint can be denoted as a constraint function of $\varphi_j(X)$ (j=1, . . . , m). An individual constraint can have a limitation on its range. For example, the DLS of a trajectory is one constraint, its value can be within the BHA tool turning ability limits (e.g., as accessed via a database, user input, etc.). For example, consider:

$$\Phi(X) = \begin{pmatrix} \varphi_1(X) \\ \varphi_1(X) \\ \vdots \\ \varphi_m(X) \end{pmatrix} \leq G = \begin{pmatrix} g_1 \\ g_2 \\ \vdots \\ g_m \end{pmatrix}.$$

As an example, an automated trajectory design problem can be modelled as:

$$\max(\min) Z = F(X) s.t.\ \Phi(X) \leq G.$$

As an example, consider a minimization problem.

$$\min F(X) s.t.\ \Phi(X) \leq G. (P1)$$

Pareto Frontier of (P1)

For problem (P1), assume $Y=\{y \in R^k : y=F(X), \text{ and } \Phi(X) \leq G\}$ is the feasible set of vectors in the PI list space.

As an example, define that a designed trajectory X1 is more desirable as to another one X2, if and only if:

$$f_i(X1) \leq f_i(X2), \text{ for all } i \leq k,$$

and there exists at least one i0, such that $$f_{i0}(X1) < f_{i0}(X2).$$

Such an approach means, if the PIs of trajectory X1 are no worse than those of X2, and there exists at least one PI of trajectory X1 is strictly better than that of X2: trajectory X1 is more desirable to X2.

A Pareto frontier is the set S of such X's that it cannot be more desirable to any other individuals in the same set. That is: For $X \in S$, there does not exist $X' \in S$, such that X is more desirable to X'.

As to practical meaning, as to introduction of the Pareto frontier, it is possible that various PIs or cost functions in (P1) may contradict with each other. For example, as mentioned earlier, less DLS can result in a greater total depth. As an example, to honor such a contradiction and use Pareto frontier as solutions of (P1) can be a rationale manner to undertake trajectory design.

As an example, a method can include receiving trajectory data; rendering at least a portion of the trajectory data to a display as a trajectory according to a coordinate system associated with a geologic environment; selecting a point of the trajectory; and rendering a traveling plate graphic to the display for the selected point. In such an example, the method can include receiving offset trajectory data for an offset trajectory. Such an example may include determining a region within the geologic environment having a risk of collision between the trajectory and the offset trajectory. In such an example, the method can include rendering a representation of the region to the traveling plate graphic. In such an example, the method can include adjusting the point based at least in part on the region. In such an example, the method can include revising the trajectory data based at least in part on the adjusting and rendering a revised trajectory to the display (e.g., via selection of a nudge graphic control button, etc.).

As an example, a method can include adjusting a point by adjusting the point as rendered to a traveling plate graphic. For example, a traveling plate graphic can include one or more no-go regions that allow for visualizing where a point may be moved without increasing risk of collision with one or more offset trajectories (e.g., offset wells).

As an example, a method can include an automated North and high side mechanism based at least in part on inclination angle of the trajectory. For example, an inclination parameter may be set where, depending on inclination of a point of trajectory, a view may switch from a North view to a High side view or vice versa.

As an example, a traveling plate graphic can be a plane where a portion of a trajectory extending from a selected point (e.g., of the trajectory that is in the plane), is substantially normal to the plane. In such an example, a traveling plate graphic can appear tilted or inclined in a 3D view and may be rendered as a flat plate in a view for that tilt or inclination. For example, where the plate is a circle, the plate may be rendered as a circle in a 2D view with, for example, the selected point of the trajectory at the center (e.g., origin) of the circle.

As an example, where a traveling plate graphic is a plane, portions of a trajectory extending from a selected point (e.g., at the center of the traveling plate graph) can be substantially normal to the plane. In such an example, the traveling plate graphic can be tilted or inclined in a 3D view (e.g., where a horizon or surface of the Earth is horizontal) and where the trajectory deviates from vertical. As an example, a trajectory can be a trajectory of a deviated well or planned well, etc.

As an example, a system can include one or more processors; memory operatively coupled to the one or more processors; and processor-executable instructions stored in the memory and executable by at least one of the processors to instruct the system to: receive trajectory data; render at least a portion of the trajectory data to a display as a trajectory according to a coordinate system associated with a geologic environment; select a point of the trajectory; and render a traveling plate graphic to the display for the selected point. In such an example, the system can include instructions to receive offset trajectory data for an offset trajectory. In such an example, the system can include instructions to determine a region within the geologic environment having a risk of collision between the trajectory and the offset trajectory. In such an example, a system can include instructions to render a representation of the region to the traveling plate graphic. As an example, a system can include instructions to render North or high side views to the display based at least in part on inclination angle of the trajectory.

As an example, one or more computer-readable storage media can include computer-executable instructions executable to instruct a computing system to: receive trajectory data; render at least a portion of the trajectory data to a display as a trajectory according to a coordinate system associated with a geologic environment; select a point of the trajectory; and render a traveling plate graphic to the display for the selected point. In such an example, a computer-readable storage medium is not carrier wave, not a signal and is non-transitory.

As an example, a method can include acquiring trajectory information; based at least in part on a portion of the trajectory information, generating a set of candidate trajectories with associated performance indicator values; rendering a graphical user interface to a display; via the graphical user interface, receiving input that adjusts one of the performance indicator values; and, responsive to the adjustment of the one of the performance indicator values, selecting one of the set of candidate trajectories.

In such an example, the associated performance indicator values may optionally be stored in a memory device that is operatively coupled to one or more processors, one or more network interfaces, etc. where, for example, the selecting can determine a closest match of the performance indicator values (e.g., as adjusted) and the performance indicator values as stored to determine which of a plurality of candidate trajectories to select. As an example, the candidate trajectories can be of a set of Pareto efficient trajectories, for example, as determined at least in part by solving a multi-objective optimization problem.

As an example, a method can include generating a set of candidate trajectories at least in part by solving a multi-objective optimization problem. In such an example, the set of candidate trajectories can be a Pareto efficient set.

As an example, a method can include generating a set of candidate trajectories by implementing at least one evolutionary process. Such a process may include a genetic type of algorithm that can generate a different population of candidates, which may optionally be further processed. In such an example, a set of candidate trajectories may represent a more global set via evolutionary processing. As an example, an evolutionary process may utilize one or more environmental pressures, which may be, for example, part of a selection process that can select one or more members of a set.

As an example, a method can include, responsive to selecting one of a set of candidate trajectories, rendering a graphical representation of the selected one of the set of candidate trajectories to a display. In such an example, the method can include receiving additional input that adjusts one of a plurality of performance indicator values; responsive to the receiving additional input, selecting another one of the set of candidate trajectories; and, responsive to the selecting of the other one of the set of candidate trajectories, rendering the selected other one of the set of candidate trajectories to the display. As an example, a method may be a real-time method where a display changes a rendering of a trajectory (e.g., position, shape, locations, etc.) responsive to input received via one or more graphical controls rendered to a display. For example, a method can include receiving input via a control and selecting a member of a set based at least in part on the received input and rendering a representation of the member to a display.

As an example, a candidate trajectory can include a surface location and at least one target location. As an example, at least one candidate trajectory of a set can include a target location as a criterion where the target location is intermediate a trajectory surface location and a trajectory bottom hole location. As an example, a trajectory may include a plurality of intermediate targets, which may be defined as being related to one or more characteristics of a formation, a tool, a tool assembly, etc.

As an example, candidate trajectories in a set can be generated in a manner that satisfies one or more constraints. In such an example, the one or more constraints may be part of a multi-objective optimization problem where a solution to the problem provides a set of candidate trajectories. In such an example, the problem may be complex in that no "best" trajectory exists but rather a set of trajectories exist where each trajectory of the set may be as good of a solution as the other trajectories of the set.

As an example, a method can include utilizing one or more performance indicators. As an example, a performance indicator may be chosen from a group that includes, for example, a total length of a trajectory, a maximum rate of curvature of a trajectory, a depth of a kick-off point of a trajectory, a measure of anti-collision risk of a trajectory, a measure of size of a mud-weight window associated with a trajectory, and a measure of an average friction with respect to a formation along a trajectory.

As an example, a method can include generating a set of candidate trajectories that satisfy constraints where at least one of the constraints is chosen form a group that includes, for example, a minimum depth of a kick-off point, a maximum allowable anti-collision risk, a maximum allowable rate of curvature, and a maximum allowable rate of curvature as a function of depth.

As an example, a method can include generating a set of candidate trajectories by creating an initial set of candidate trajectories and performing an iterative procedure to generate the set of candidate trajectories. In such an example, the iterative procedure can include combining characteristics of the initial set of trajectories and modifying the characteristics to generate a processed set of candidate trajectories and removing the least fit of the candidate trajectories according to at least one fitness criterion (e.g., an environmental fitness criterion, etc.).

As an example, a method can include performing a trade-off analysis by specifying values for one or more performance indicators and selecting a proposed trajectory that is a member of a set of candidate trajectories that satisfies the specified performance indicator values (e.g., that may best satisfy the specified performance indicator values).

As an example, a method can include editing a selected trajectory of the set of candidate trajectories. As an example, editing can include receiving input associated with a nudge tool graphic rendered to a display.

As an example, a system can include one or more processors; memory operatively coupled to the one or more processors; and processor-executable instructions stored in the memory and executable by at least one of the one or more processors to instruct the system to: acquire trajectory information; based at least in part on a portion of the trajectory information, generate a set of candidate trajectories with associated performance indicator values; render a graphical user interface to a display; via the graphical user interface, receive input that adjusts one of the performance indicator values; and, responsive to the adjustment of the one of the performance indicator values, select one of the set of candidate trajectories. In such an example, the system may include instructions to render a nudge tool graphical user interface to the display that includes at least one graphical control to position at least a portion of the selected one of the set of candidate trajectories.

As an example, one or more computer-readable storage media can include computer-executable instructions executable to instruct a computing system to: acquire trajectory information; based at least in part on a portion of the trajectory information, generate a set of candidate trajectories with associated performance indicator values; render a graphical user interface to a display; via the graphical user interface, receive input that adjusts one of the performance indicator values; and, responsive to the adjustment of the one of the performance indicator values, select one of the set of candidate trajectories. In such an example, the instructions can include instructions to render a nudge tool graphical user interface to the display that includes at least one graphical control to position at least a portion of the selected one of the set of candidate trajectories.

As an example, as to a trajectory, it may be defined in part by a surface location that is represented as a point and, for example, a target location that is represented as a point, an area or a volume.

As an example, a method can include filtering a set of candidate trajectories to generate a Pareto efficient set of candidate trajectories. As an example, a method can include generating a set of candidate trajectories at least in part by generating a Pareto efficient set of candidate trajectories.

As an example, a method can include removing one or more candidate trajectories from a set by evaluating candidate trajectories according to a set of constraints and evaluating the candidate trajectories according to a measure of how close the set of candidate trajectories matches a Pareto frontier.

As an example, a method can include repeatedly adjusting values for one or more of the performance indicators, and after each adjustment, selecting a proposed trajectory is the closest member of a set of a plurality of previously proposed trajectories that satisfies specified performance indicator values.

As an example, a method can include generating an initial set of candidate trajectories according to criteria; performing an environmental selection process to select a strong set of candidate trajectories from the initial set of candidate trajectories; performing at least one evolutionary process on at least a portion of the candidate trajectories of the strong set to generate a processed set of candidate trajectories; performing an environmental selection process to select a stronger set of candidate trajectories from the processed set; and outputting at least one or more of the candidate trajectories of the stronger set. In such an example, the method may include comparing the stronger set and the strong set and, responsive to the comparing, deciding whether to perform an iteration that generates another stronger set. As an example, a method can include deciding that decides not to perform an iteration where outputting may output a converged set of candidate trajectories.

As an example, a method can include rendering a graphical user interface to a display and interrogating one or more of candidate trajectories of a stronger set via the graphical user interface. In such an example, the graphical user interface may include slider graphics that correspond to performance indicators. Such a method may include receiving input to adjust a value of one of the performance indicators and automatically changing a value of at least one of the other performance indicators.

Figure 37:
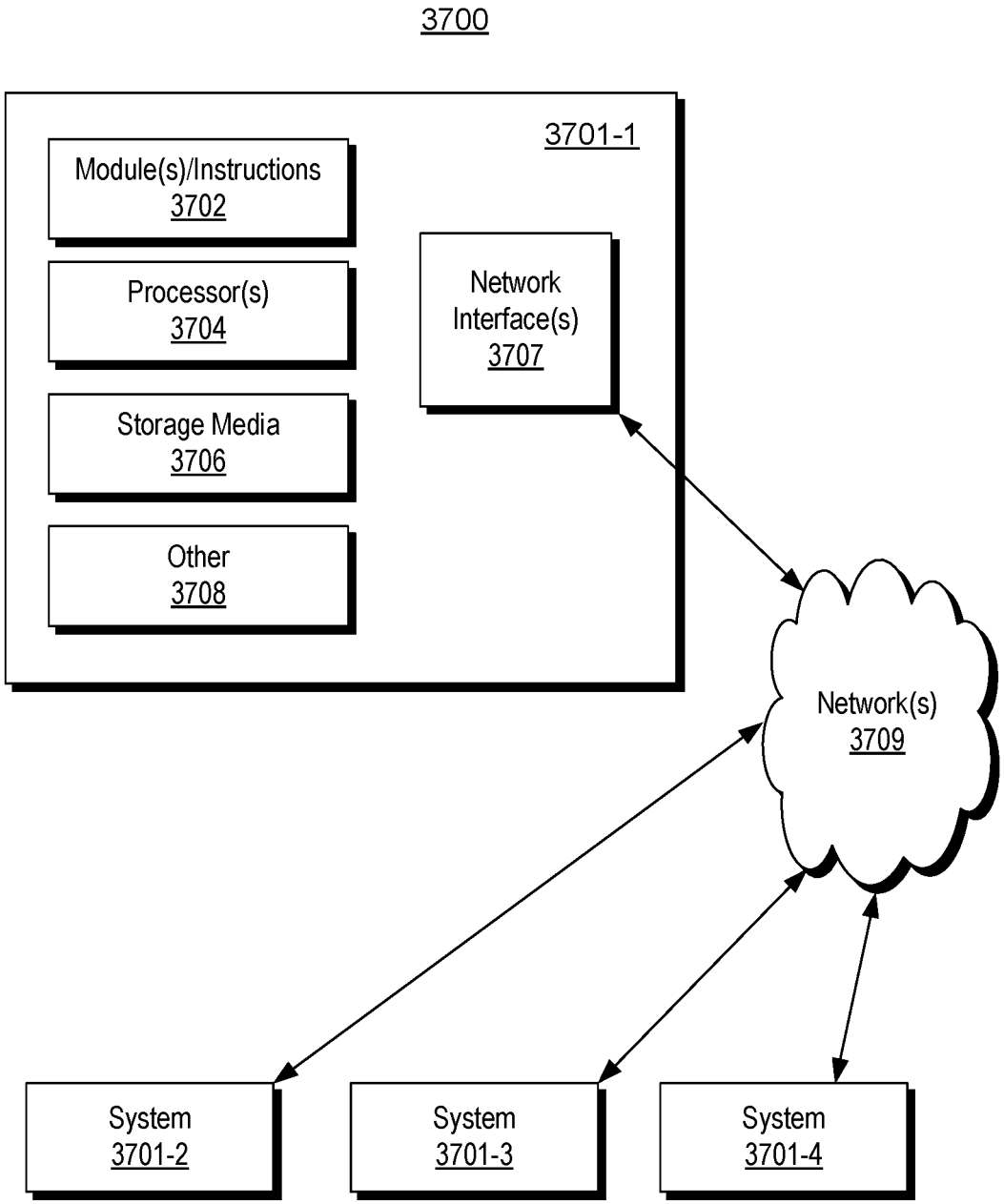
FIG. 37 illustrates examples of computing and networking equipment.

In some embodiments, a method or methods may be executed by a computing system. FIG. 37 shows an example of a system 3700 that can include one or more computing systems 3701-1, 3701-2, 3701-3 and 3701-4, which may be operatively coupled via one or more networks 3709, which may include wired and/or wireless networks.

As an example, a system can include an individual computer system or an arrangement of distributed computer systems. In the example of FIG. 37, the computer system 3701-1 can include one or more modules 3702, which may be or include processor-executable instructions, for example, executable to perform various tasks (e.g., receiving information, requesting information, processing information, simulation, outputting information, etc.).

As an example, a module may be executed independently, or in coordination with, one or more processors 3704, which is (or are) operatively coupled to one or more storage media 3706 (e.g., via wire, wirelessly, etc.). As an example, one or more of the one or more processors 3704 can be operatively coupled to at least one of one or more network interface 3707. In such an example, the computer system 3701-1 can transmit and/or receive information, for example, via the one or more networks 3709 (e.g., consider one or more of the Internet, a private network, a cellular network, a satellite network, etc.).

As an example, the computer system 3701-1 may receive from and/or transmit information to one or more other devices, which may be or include, for example, one or more of the computer systems 3701-2, etc. A device may be located in a physical location that differs from that of the computer system 3701-1. As an example, a location may be, for example, a processing facility location, a data center location (e.g., server farm, etc.), a rig location, a wellsite location, a downhole location, etc.

As an example, a processor may be or include a microprocessor, microcontroller, processor module or subsystem, programmable integrated circuit, programmable gate array, or another control or computing device.

As an example, the storage media 3706 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general purpose processors or application specific chips (e.g., or chipsets), such as ASICs, FPGAs, PLDs, or other appropriate devices.

FIG. 38 shows components of a computing system 3800 and a networked system 3810. The system 3800 includes one or more processors 3802, memory and/or storage components 3804, one or more input and/or output devices 3806 and a bus 3808. According to an embodiment, instructions may be stored in one or more computer-readable media (e.g., memory/storage components 3804). Such instructions may be read by one or more processors (e.g., the processor(s) 3802) via a communication bus (e.g., the bus 3808), which may be wired or wireless. The one or more processors may execute such instructions to implement (wholly or in part) one or more attributes (e.g., as part of a method). A user may view output from and interact with a process via an I/O device (e.g., the device 3806). According to an embodiment, a computer-readable medium may be a storage component such as a physical memory storage device, for example, a chip, a chip on a package, a memory card, etc.

According to an embodiment, components may be distributed, such as in the network system 3810. The network system 3810 includes components 3822-1, 3822-2, 3822-3, . . . 3822-N. For example, the components 3822-1 may include the processor(s) 3802 while the component(s) 3822-3 may include memory accessible by the processor(s) 3802. Further, the component(s) 3822-2 may include an I/O device for display and optionally interaction with a method. The network may be or include the Internet, an intranet, a cellular network, a satellite network, etc.

As an example, a device may be a mobile device that includes one or more network interfaces for communication of information. For example, a mobile device may include a wireless network interface (e.g., operable via IEEE 802.11, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that can be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A method comprising:

acquiring planned trajectory information for a planned wellbore trajectory, wherein the planned wellbore trajectory is a planned path from a first location to a target location below the earth surface;

based at least in part on a portion of the planned trajectory information, generating a set comprising a plurality of candidate trajectories for the planned wellbore trajectory, the candidate trajectories having associated performance indicator values for at least curvature and depth and providing the path from the first location to the target location, and the set of candidate trajectories solving a multi-objective optimization problem for objectives that comprise at least a curvature objective and a depth objective of the planned wellbore trajectory wherein a single candidate trajectory does not exist that simultaneously optimizes each of the objectives;

rendering a graphical user interface to a display;

via the graphical user interface, receiving input that adjusts one or more of the performance indicator values; and responsive to the adjustment of the one of the performance indicator values, selecting one of the set of candidate trajectories based at least in part on the multi-objective optimization.

2. The method of claim 1 wherein the set of candidate trajectories comprises a Pareto efficient set.

3. The method of claim 1 wherein the generating the set of candidate trajectories comprises implementing at least one evolutionary algorithm.

4. The method of claim 1 comprising, responsive to the selecting one of the set of candidate trajectories, rendering a graphical representation of the selected one of the set of candidate trajectories to a display.

5. The method of claim 4 comprising receiving additional input that adjusts one of the performance indicator values; responsive to the receiving additional input, selecting another one of the set of candidate trajectories; and, responsive to the selecting of the other one of the set of candidate trajectories, rendering the selected other one of the set of candidate trajectories to the display.

6. The method of claim 1 wherein each of the candidate trajectories comprises a surface location and at least one target location that aims to satisfy the target location of the planned path.

7. The method of claim 1 wherein at least one of the candidate trajectories comprises an intermediate target location as a criterion wherein the intermediate target location is intermediate a trajectory surface location and a trajectory bottom hole location.

8. The method of claim 1 wherein the performance indicators comprise at least one member selected from a group consisting of a total length of a trajectory, a maximum rate of curvature of a trajectory, a depth of a kick-off point of a trajectory, a measure of anti-collision risk of a trajectory, a measure of size of a mud-weight window associated with a trajectory, and a measure of an average friction with respect to a formation along a trajectory.

9. The method of claim 1 wherein the generated set of candidate trajectories satisfy constraints that comprise at least one member selected from a group consisting of a minimum depth of a kick-off point, a maximum allowable anti-collision risk, a maximum allowable rate of curvature, and a maximum allowable rate of curvature as a function of depth.

10. The method of claim 1 wherein generating the set of candidate trajectories comprises creating an initial set of candidate trajectories and performing an iterative procedure to generate the set of candidate trajectories.

11. The method of claim 10 wherein the iterative procedure comprises combining characteristics of the initial set of trajectories and modifying the characteristics to generate a processed set of candidate trajectories and removing the least fit of the candidate trajectories according to at least one fitness criterion.

12. The method of claim 1 comprising performing a trade-off analysis by specifying values for one or more of the performance indicators and selecting a proposed trajectory that is a member of the set of candidate trajectories that satisfies the specified performance indicator values.

13. The method of claim 1 comprising editing a selected trajectory of the set of candidate trajectories.

14. The method of claim 13 wherein the editing comprises receiving input associated with a nudge tool graphic rendered to a display.

15. A system comprising:

one or more processors;

memory operatively coupled to the one or more processors; and processor-executable instructions stored in the memory and executable by at least one of the one or more processors to instruct the system to:

acquire planned trajectory information for a planned wellbore trajectory, wherein the planned wellbore trajectory is a planned path from a first location to a target location below the earth surface;

based at least in part on a portion of the planned trajectory information, generate a set comprising a plurality of candidate trajectories for the planned wellbore trajectory, the candidate trajectories having associated performance indicator values for at least curvature and depth and the set of candidate trajectories solving a multi-objective optimization problem for objectives that comprise at least a curvature objective and a depth objective of the planned wellbore trajectory wherein a single candidate trajectory does not exist that simultaneously optimizes each of the objectives;

render a graphical user interface to a display;

via the graphical user interface, receive input that adjusts one or more of the performance indicator values; and responsive to the adjustment of the one of the performance indicator values, select one of the set of candidate trajectories based at least in part on the multi-objective optimization.

16. The system of claim 15 wherein the instructions comprise instructions to render a nudge tool graphical user interface to the display that comprises at least one graphical control to position at least a portion of the selected one of the set of candidate trajectories.

17. One or more computer-readable storage media comprising computer-executable instructions executable to instruct a computing system to:

acquire planned trajectory information for a planned wellbore trajectory, wherein the planned wellbore trajectory is a planned path from a first location to a target location below the earth surface;

based at least in part on a portion of the planned trajectory information, generate a set comprising a plurality of candidate trajectories for the planned wellbore trajectory, the candidate trajectories having associated performance indicator values for at least curvature and depth and the set of candidate trajectories solving a multi-objective optimization problem for objectives that comprise at least a curvature objective and a depth objective of the planned wellbore trajectory wherein a single candidate trajectory does not exist that simultaneously optimizes each of the objectives;

render a graphical user interface to a display;

via the graphical user interface, receive input that adjusts one or more of the performance indicator values; and responsive to the adjustment of the one of the performance indicator values, select one of the set of candidate trajectories based at least in part on the multi-objective optimization.

18. The one or more computer-readable storage media of claim 17 wherein the instructions comprise instructions to render a nudge tool graphical user interface to the display that comprises at least one graphical control to position at least a portion of the selected one of the set of candidate trajectories.

19. The method of claim 1, wherein the generating generates a set of trajectories and filters the generated set of trajectories to produce the set of candidate trajectories such that a single candidate trajectory of the set of candidate trajectories does not exist that simultaneously optimizes each of the objectives.

20. The method of claim 1, wherein the selecting one of the set of candidate trajectories, wherein a single candidate trajectory of the set of candidate trajectories does not exist that simultaneously optimizes each of the objectives, comprises performing a trade-off analysis for the set of candidate trajectories.

* * * * *